US008192099B2

(12) United States Patent
Yamada et al.

(10) Patent No.: US 8,192,099 B2
(45) Date of Patent: Jun. 5, 2012

(54) PRINT TAPE AND A PRINT CASSETTE

(75) Inventors: Mariko Yamada, Inazawa (JP); Tsutomu Kato, Nagoya (JP); Tsuyoshi Nagae, Kasugai (JP); Kiyoichi Ohta, Chiryu (JP); Takashi Horiuchi, Kariya (JP); Akira Ito, Ashiya (JP); Koshiro Yamaguchi, Kakamigahara (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 711 days.

(21) Appl. No.: 12/227,273

(22) PCT Filed: Apr. 20, 2007

(86) PCT No.: PCT/JP2007/058631

§ 371 (c)(1),
(2), (4) Date: Nov. 10, 2008

(87) PCT Pub. No.: WO2007/135829

PCT Pub. Date: Nov. 29, 2007

(65) Prior Publication Data

US 2009/0129844 A1 May 21, 2009

(30) Foreign Application Priority Data

May 18, 2006 (JP) ..... 2006-138616
Nov. 8, 2006 (JP) ..... 2006-303306

(51) Int. Cl.
*B41J 15/00* (2006.01)

(52) U.S. Cl. ..... 400/613; 400/621

(58) Field of Classification Search ..... 400/613, 400/621; 428/40.1
See application file for complete search history.

(56) References Cited

U.S. PATENT DOCUMENTS 5,188,469 A * 2/1993 Nagao et al. ..... 400/615.2
5,653,542 A * 8/1997 Sugimoto et al. ..... 400/248
(Continued)

FOREIGN PATENT DOCUMENTS

EP 0470648 A2 2/1992
(Continued)

OTHER PUBLICATIONS

English Translation of JP 2002-366040.*

*Primary Examiner* — Thien M. Le
*Assistant Examiner* — Christopher Stanford
(74) *Attorney, Agent, or Firm* — Day Pitney LLP

(57) ABSTRACT

An object of the disclosure is to provide a print cassette for producing a print tape comprising a structure which can avoid a bad effect on a feeding performance of a film tape in the print cassette and handling of a print tape when stuck to an adherend even when an adopted to-be-printed medium is a thin-film. A print tape 5 produced in a print cassette is composed of a first tape 11 and a second tape 13. In the first tape 11, a first base material 31 and a to-be-printed medium 33 are stacked via a first adhesive layer 32. In the second tape 13, a second adhesive layer 51 is stacked to a second base material 52. Then, a printing surface 11A of the first tape 11 on which ink 41 is put and the second adhesive layer 51 are overlapped with each other, so that the second tape 13 adhered to the first tape 11 to compose the print tape 5.

18 Claims, 78 Drawing Sheets

U.S. PATENT DOCUMENTS

| | | | | |
|---|---|---|---|---|
| 5,957,597 | A * | 9/1999 | Kato | 400/621 |
| 6,099,927 | A * | 8/2000 | Freedman | 428/40.1 |
| 6,190,065 | B1 * | 2/2001 | Brzuskiewicz | 400/120.01 |

FOREIGN PATENT DOCUMENTS

| | | | |
|---|---|---|---|
| EP | 1403084 | A1 | 3/2004 |
| EP | 1403086 | A1 | 3/2004 |
| EP | 1522415 | A2 | 4/2005 |
| JP | 63135277 | | 6/1988 |
| JP | 07-112559 | | 5/1995 |
| JP | 7112559 | | 5/1995 |
| JP | 8058211 | | 3/1996 |
| JP | 10236007 | | 9/1998 |
| JP | 11071556 | | 3/1999 |
| JP | 11180071 | | 7/1999 |
| JP | 11-219116 | | 8/1999 |
| JP | 11219116 | | 8/1999 |
| JP | 2001088814 | | 4/2001 |
| JP | 2002175013 | | 6/2002 |
| JP | 2002307867 | | 10/2002 |
| JP | 2002-366040 | | 12/2002 |
| JP | 2002366040 | | 12/2002 |
| JP | 2002366040 | A * | 12/2002 |
| JP | 2003122258 | | 4/2003 |
| JP | 2003-295770 | | 10/2003 |
| JP | 2003295771 | | 10/2003 |
| JP | 2003-345249 | | 12/2003 |
| JP | 2004102188 | | 4/2004 |
| JP | 2006051797 | | 2/2006 |
| JP | 2007176013 | | 7/2007 |

* cited by examiner

PRINT TAPE AND A PRINT CASSETTE

TECHNICAL FIELD

The disclosure relates to a print cassette for producing either a laminated-type print tape (hereinafter, referred to as a "laminated tape") or a receptor-type print tape (hereinafter, referred to as a "non-laminated tape").

BACKGROUND ART

Conventionally, a tape printer in which a print cassette is installed has been used to produce a print tape on which characters and the like are printed. One of the various print tapes which can be produced in the tape printer is a "laminated tape" made of a film tape having a printing backside surface to which an adhesive tape adhered (see, for example, patent document 1).

Also, conventionally, a tape printer in which a print cassette is installed has been used to produce a print tape on which characters and the like are printed. On-e of the various print tapes which can be produced in the tape printer is a "non-laminated tape" made of a receptor sheet and a separator sheet adhered to each other with an adhesive agent (see, for example, patent document 2).

PATENT DOCUMENT 1: Japanese Patent Application Laid-Open No. H8 (1996)-58211 (pages 3 to 4 and FIG. 2)

PATENT DOCUMENT 2: Japanese Patent Application Laid-Open No. H8 (1996)-58211 (pages 6 to 7 and FIG. 4)

DISCLOSURE OF THE INVENTION

Problem to be Solved

As a problem to be solved, in the case of a conventional "laminated tape", the thickness of its film tape is approximately 38 μm and the thickness of its adhesive tape is approximately 50 μm to 60 μm (thickness of its base material: 12 μm to 20 μm), so that the thickness of a print tape is approximately 100 μm. For this reason, when the conventional "laminated tape" is stuck to a curved face of an adherend, the conventional "laminated tape" would be likely to gradually come unstuck from the curved surface of the adherend due to insufficient elasticity or the like resulting from the thickness of the print tape.

Also, a conventional "non-laminated tape", however, has a base film composing a receptor sheet as thick as 38 μm or more. Therefore, an outline of a receptor sheet tends to be visually identified when the conventional "non-laminated tape" is stuck to an adherend, even when a receptor sheet is arranged to be transparent to be invisible so that printed characters and the like can be emphasized.

Further, when the conventional "non-laminated tape" is stuck to a curved surface of an adherend, it would be likely to gradually come unstuck from the curved surface of the adherend due to insufficient elasticity or the like resulting from the thickness of a to-be-printed medium.

Accordingly, for example, the film tape or the base film is requested to be thin, but a film tape or a base film just arranged to be thin may have a bad effect on a feeding performance of the film tape in the print cassette and handling of a print tape when the print tape is stuck to the adherend.

The disclosure has been made in view of the above circumstances and has an object to overcome the above problems and to provide a print cassette for producing a print tape comprising a structure which can avoid a bad effect on a feeding performance of a film tape in the print cassette and handling of a print tape when stuck to an adherend even when an adopted to-be-printed medium is a thin-film.

Means for Solving the Problems

In order to achieve the above object, according to the disclosure of claim 1, there is provided a print tape comprising: a first base material; a to-be-printed medium; a first adhesive layer formed of a first adhesive agent interposed between the first base material and the to-be-printed medium; a second base material; and a second adhesive layer formed of a second adhesive agent applied to the second base material, wherein the to-be-printed medium adopts a rear face of the face to which the first adhesive layer adheres as its printing surface.

According to the disclosure, there is further provided the print tape according to claim 1, wherein adhesion force between the first adhesive layer and the to-be-printed medium is smaller than adhesion force between the second adhesive layer and the to-be-printed medium.

According to the disclosure, there is further provided a print tape comprising: a first base material; a to-be-printed medium; a first adhesive layer formed of a first adhesive agent interposed between the first base material and the to-be-printed medium; a third base material; a third adhesive layer formed of a third adhesive agent applied to a first face side of the third base material; a fourth base material; and a fourth adhesive layer formed of a fourth adhesive agent interposed between a second face side of the third base material and the fourth base material, wherein the to-be-printed medium adopts a rear face of the face to which the first adhesive layer adheres as its printing surface.

According to the disclosure, there is further provided the print tape, wherein adhesion force between the first adhesive layer and the to-be-printed medium is smaller than adhesion force between the third adhesive layer and the to-be-printed medium.

According to the disclosure, there is further provided the print tape, wherein the first adhesive agent is dispersed uniformly in a predetermined pattern.

According to the disclosure, there is further provided the print tape, wherein a print of thermosensitive coloring agent is made on the printing surface side of the to-be-printed medium.

According to the disclosure, there is further provided the print tape, wherein a print of ink is made on the printing surface side of the to-be-printed medium.

According to the disclosure, there is further provided the print tape, wherein the width of the first base material and the width of the to-be-printed medium are different from each other.

According to the disclosure, there is further provided the print tape, wherein the first base material is transparent.

According to the disclosure, there is further provided the print tape, where the first base material is opaque.

According to the disclosure, there is further provided the print tape, wherein the first base material is provided preliminarily with a mark indicating the up-down direction or right-left direction of the printing surface of the to-be-printed medium.

According to the disclosure, there is further provided the print tape, wherein a half cut is implemented preliminarily in the first base material.

According to the disclosure, there is further provided the print tape, wherein a half cut is implemented preliminarily in the second base material.

According to the disclosure, there is further provided the print tape, wherein a half cut is implemented preliminarily in the fourth base material.

According to the disclosure, there is further provided a print cassette accommodating a first tape and a second tape, designed to be mounted on a print device having a printing position, wherein the first tape includes: a first base material; a to-be-printed medium; and a first adhesive layer formed of a first adhesive agent interposed between the first base material and the to-be-printed medium, the second tape includes: a second base material; and a second adhesive layer formed of a second adhesive agent applied to the second base material, and the to-be-printed medium adopts a rear face of the face to which the first adhesive layer adheres as its printing surface.

According to the disclosure, there is further provided the print cassette, wherein adhesion force between the first adhesive layer and the to-be-printed medium is smaller than adhesion force between the second adhesive layer and the to-be-printed medium.

According to the disclosure, there is further provided a print cassette accommodating a first tape and a third tape, designed to be mounted on a print device having a printing position, wherein the first tape includes: a first base material; a to-be-printed medium; and a first adhesive layer formed of a first adhesive agent interposed between the first base material and the to-be-printed medium, the third tape includes: a third base material; a third adhesive layer formed of a third adhesive agent applied to a first face side of the third base material; a fourth base material; and a fourth adhesive layer formed of a fourth adhesive agent interposed between a second face side of the third base material and the fourth base material, wherein the to-be-printed medium adopts a rear face of the face to which the first adhesive layer adheres as its printing surface.

According to the disclosure, there is further provided the print cassette, wherein adhesion force between the first adhesive layer and the to-be-printed medium is smaller than adhesion force between the third adhesive layer and the to-be-printed medium.

According to the disclosure, there is further provided the print cassette, wherein the first adhesive agent is dispersed uniformly in a predetermined pattern.

According to the disclosure, there is further provided the print cassette, wherein a print of thermosensitive coloring agent is made on the printing surface side of the to-be-printed medium.

According to the disclosure, there is further provided the print cassette, further accommodating an ink ribbon having an ink face, wherein the ink face of the ink ribbon and the printing surface of the to-be-printed medium face each other at the print position of the print device.

According to the disclosure, there is further provided the print cassette, wherein a print head is disposed at the printing position of the print device, the width of the ink ribbon is wider than the width of the to-be-printed medium, and when the printing surface of the to-be-printed medium faces the printing head of the print device through the ink face of the ink ribbon, the to-be-printed medium is covered with the ink ribbon so that the to-be-printed medium is hidden with respect to the print head of the print device.

According to the disclosure, there is further provided the print cassette, wherein the width of the first base material and the width of the to-be-printed medium are different from each other.

According to the disclosure, there is further provided the print cassette, wherein the first base material is transparent.

According to the disclosure, there is further provided the print cassette, wherein the first base material is opaque.

According to the disclosure, there is further provided the print cassette, wherein the first base material is provided preliminarily with a mark indicating the up-down direction or right-left direction of the printing surface of the to-be-printed medium.

According to the disclosure, there is further provided the print cassette, wherein a half cut is implemented preliminarily in the first base material.

According to the disclosure, there is further provided the print cassette, wherein a half cut is implemented preliminarily in the second base material.

According to the disclosure, there is further provided the print cassette, wherein a half cut is implemented preliminarily in the fourth base material.

According to the disclosure, there is further provided a print cassette in which a both sides adhesive tape, an ink ribbon and a multilayer laminated tape are wound individually and mounted on a print device, wherein the multilayer laminated tape includes: a handling auxiliary film which is a base material; a thin laminated film having a printing surface to which ink of the ink ribbon is to be transferred on a first face side thereof; and a weak adhesive layer formed of a weak adhesive agent which is applied between the handling auxiliary film and a second face side of the thin laminated film and used for adhering such that the weak adhesive layer is separable from the thin laminated film, and the both sides adhesive tape includes: a base film; a first adhesive layer formed of a first adhesive agent which is applied to a first face side of the base film and used for adhering a first face side of the thin laminated film; a release sheet adhered to a second face side of the base film; and a second adhesive layer which is applied between the second face side of the base film and the release sheet and formed of a second adhesive agent, wherein the print tape is formed when the both sides adhesive tape and the multilayer laminated tape adhered together with the first adhesive layer and discharged from the print device.

According to the disclosure, there is further provided a print cassette in which a monolayer adhesive tape, an ink ribbon and a multilayer laminated tape are wound individually and mounted on a print device, wherein the multilayer laminated tape includes: a handling auxiliary film which is a base material; a thin laminated film having a printing surface to which ink of the ink ribbon is to be transferred on a first face side thereof; and a weak adhesive layer formed of a weak adhesive agent which is applied between the handling auxiliary film and a second face side of the thin laminated film and used for adhering such that the weak adhesive layer is separable from the thin laminated film, the monolayer adhesive tape includes: a release sheet; and a third adhesive layer which is applied to a first face side of the release sheet and formed of a third adhesive agent, wherein the print tape is formed when the monolayer adhesive tape and the multilayer laminated tape adhered together with the third adhesive layer and discharged from the print device.

According to the disclosure, there is further provided the print cassette, wherein the width of the handling auxiliary film and the width of the thin laminated film are different from each other.

According to the disclosure, there is further provided the print cassette, wherein the handling auxiliary film is transparent.

According to the disclosure, there is further provided the print cassette, wherein the handling auxiliary film is colored or patterned.

According to the disclosure, there is further provided the print cassette, wherein the handling auxiliary film is provided preliminarily with a mark indicating the up-down direction or right-left direction of the printing surface of the thin laminated film.

According to the disclosure, there is further provided the print cassette, wherein a half cut is implemented preliminarily in the handling auxiliary film.

According to the disclosure, there is further provided the print cassette, wherein a half cut is implemented preliminarily in the thin laminated film.

Effect of the Invention

In other words, in the print tape according to the disclosure, the second base material adheres to the printing surface of the to-be-printed medium with the second adhesive layer. Then, the second base material is removed from the to-be-printed medium and, with the exposed second adhesive layer stuck to an adherend, the first base material which adhered to the to-be-printed medium with the first adhesive layer is removed. As a result, the first adhesive layer is separated together with the first base material from the to-be-printed medium and then, the printing surface of the to-be-printed medium is stuck to the adherend with the second adhesive layer. Consequently, the "laminated tape" can be stuck to the adherend.

In the print tape, the third base material adheres to the printing surface of the to-be-printed medium with the third adhesive layer. Then, the fourth base material is removed from the third base material and, with the exposed fourth adhesive layer stuck to an adherend, the first base material which adhered to the to-be-printed medium with the first adhesive layer is removed from the to-be-printed medium. As a result, the first adhesive layer is separated together with the first base material from the to-be-printed medium and then, the printing surface side of the to-be-printed medium is in a state of adhering to the third base material with the third adhesive agent, the third base material is stuck to the adherend with the fourth adhesive layer. Consequently, the "laminated tape" can be stuck to the adherend.

In the print tape of the present disclosure, the to-be-printed medium adhered to the first base material with the first adhesive layer and can thus keep the rigidity at least by the thickness of the first base material.

When the to-be-printed medium is stuck to the adherend, the first base material adhered to the to-be-printed medium, so that the to-be-printed medium can thus keep the rigidity at least by the thickness of the first base material. Thus, however thin the to-be-printed medium constituting the "laminated tape" is, the work of sticking the "laminated tape" to the adherend securely can be carried out.

In the print tape, when the to-be-printed medium is stuck to the adherend, the first base material adhered to the to-be-printed medium with the first adhesive layer. Thus, the to-be-printed medium can thus keep the rigidity at least by the thickness of the first base material and however thin the to-be-printed medium is, the work of sticking the to-be-printed medium to the adherend securely can be carried out. The first adhesive agent for forming the first adhesive layer is dispersed uniformly in a predetermined pattern. Therefore, even if the to-be-printed medium is stuck to the adherend, the clue for releasing the first base material from the to-be-printed medium is easy to make and after that, the first base material is easy to remove from the to-be-printed medium.

Examples of the predetermined pattern include a striped pattern, a grid pattern, and a polka-dot pattern.

The print tape of the present disclosure includes, for example, a thermosensitive type and a thermal transfer type.

Because in the print tape according to the disclosure, the width of the first base material and the width of the to-be-printed medium are different from each other, the first base material can be distinguished easily and it is convenient when releasing the first base material from the to-be-printed medium.

In the print tape according to the disclosure, because the first base material is transparent, printed characters on the printing surface of the to-be-printed medium can be recognized visually and the up-down direction of the print tape can be confirmed. Thus, it is convenient when sticking the print tape to the adherend.

In the print tape according to the disclosure, the first base material adhered to the to-be-printed medium with the first adhesive layer. Then, the first base material is opaque, and thus has the hiding performance. Accordingly, the to-be-printed medium cannot be recognized visually via the first base material, so that the print content of the to-be-printed medium can be hidden. Consequently, the security effect to the print content of the to-be-printed medium is exerted.

In the print tape according to the disclosure, the first base material is provided preliminarily with the mark indicating the up-down direction or right-left direction of the printing surface of the to-be-printed medium. Thus, even if the to-be-printed medium cannot be recognized visually, the up-down direction or the right-left direction of the to-be-printed medium is never mistaken as long as this mark is used as a clue, so that the to-be-printed medium can be stuck to the adherend.

In the print tape, the first base material can be removed from the to-be-printed medium easily by the half cut.

In the print tape according to the disclosure, the second base material adhered to the to-be-printed medium with the second adhesive layer. Then, when part of the second base material is removed from the to-be-printed medium along the half cut in order to stick the to-be-printed medium to the adherend, part of the second adhesive layer is exposed, so that part of the to-be-printed medium can be stuck to the adherend with the part of the second adhesive layer. At this time, the left portion of the second base material still adhered to the to-be-printed medium and the to-be-printed medium can thus keep the rigidity by the stiffness of the left portion of the second base material. Consequently, however thin the to-be-printed medium is, the work of sticking part of the to-be-printed medium to the adherend securely without generation of wrinkles can be carried out.

After that, because the left portion of the second adhesive layer is exposed when the left portion of the second base material is removed from the to-be-printed medium, the left portion of the to-be-printed medium can be stuck to the adherend with the left portion of the second adhesive layer. At this time, the to-be-printed medium can thus keep the tension by part of the to-be-printed medium stuck to the adherend. Consequently, however thin the to-be-printed medium is, the work of sticking the left portion of the to-be-printed medium to the adherend securely without generation of wrinkles can be carried out.

In other words, by repeatedly releasing part of the second base material from the to-be-printed medium along the half cut, the to-be-printed medium can be stuck to the adherend step by step. This facilitates the work of securely sticking the to-be-printed medium to the adherend without generation of wrinkles.

In the print tape, the third base material adhered to the to-be-printed medium with the third adhesive layer, so that the to-be-printed medium and the third base material are integrally formed. Then, when part of the fourth base material adhered to the third base material with the fourth adhesive layer is removed from the third base material along the half cut in order to stick the to-be-printed medium to the adherend, part of the fourth adhesive layer is exposed, so that part of the to-be-printed medium integrated with the third base material can be stuck to the adherend with the part of the fourth adhesive layer. At this time, the left portion of the fourth base material still adhered to the to-be-printed medium via the third base material and the to-be-printed medium can thus keep the rigidity by the stiffness of the left portion of the fourth base material. Consequently, however thin the to-be-printed medium is, the work of sticking part of the to-be-printed medium to the adherend securely without generation of wrinkles can be carried out.

After that, because the left portion of the fourth adhesive layer is exposed when the left portion of the fourth base material is removed from the third base material integrated with the to-be-printed medium, the left portion of the to-be-printed medium integrated with the third base material can be stuck to the adherend with the left portion of the fourth adhesive layer. At this time, the to-be-printed medium can thus keep the tension by part of the to-be-printed medium stuck to the adherend. Consequently, however thin the to-be-printed medium is, the work of sticking the left portion of the to-be-printed medium to the adherend securely without generation of wrinkles can be carried out.

In other words, by repeatedly releasing part of the fourth base material from the third base material integrated with the to-be-printed medium along the half cut, the to-be-printed medium can be stuck to the adherend step by step. This facilitates the work of securely sticking the to-be-printed medium to the adherend without generation of wrinkles.

In the print cassette, the to-be-printed medium adhered to the first base material with the first adhesive layer, so that the to-be-printed medium can thus keep the rigidity at least by the thickness of the first base material. As a result, the feeding performance in the print cassette of the present disclosure can be secured.

When the to-be-printed medium is stuck to an adherend, the first base material adhered to the to-be-printed medium, so that the to-be-printed medium can thus keep the rigidity at least by the thickness of the first base material. Thus, however thin the to-be-printed medium is, the work of sticking the to-be-printed medium to the adherend securely can be carried out.

In the print cassette, when the print cassette is mounted in the print device, the print tape constituted of the first tape and the second tape can be discharged from the print device. With regard to the print tape discharged from the print device, the second base material adhered to the printing surface of the to-be-printed medium with the second adhesive layer. Then, the second base material is removed from the to-be-printed medium and, with the exposed second adhesive layer stuck to the adherend, the first base material which adhered to the to-be-printed medium with the first adhesive layer is removed from the to-be-printed medium. As a result, the first adhesive layer is separated together with the first base material from the to-be-printed medium and then, the printing surface of the to-be-printed medium is stuck to the adherend with the second adhesive layer. Consequently, the "laminated tape" can be stuck to the adherend.

In the print cassette, when the print cassette is mounted in the print device, the print tape constituted of the first tape and the third tape can be discharged from the print device. With regard to the print tape discharged from the print device, the third base material adhered to the printing surface of the to-be-printed medium with the third adhesive layer. Then, the fourth base material is removed from the third base material and, with the exposed fourth adhesive layer stuck to an adherend, the first base material which adhered to the to-be-printed medium with the first adhesive layer is removed from the to-be-printed medium. As a result, the first adhesive layer is separated together with the first base material from the to-be-printed medium and then, the printing surface side of the to-be-printed medium is in a state of adhering to the third base material with the third adhesive agent, the third base material is stuck to the adherend with the fourth adhesive layer. Consequently, the "laminated tape" can be stuck to the adherend.

In the print cassette, the to-be-printed medium adhered to the first base material with the first adhesive layer, so that the to-be-printed medium can thus keep the rigidity at least by the thickness of the first base material. As a result, the feeding performance in the print cassette of the present disclosure can be secured. The first adhesive agent for forming the first adhesive layer is dispersed uniformly in a predetermined pattern, so that the first adhesive agent never protrudes from between the to-be-printed medium and the first base material easily. Thus, the feeding performance of the to-be-printed medium in the print cassette of the present disclosure is further stabilized.

When the to-be-printed medium is stuck to the adherend, the first base material adhered to the to-be-printed medium with the first adhesive layer. Thus, the to-be-printed medium can thus keep the rigidity at least by the thickness of the first base material and however thin the to-be-printed medium is, the work of sticking the to-be-printed medium to the adherend securely can be carried out. The first adhesive agent for forming the first adhesive layer is dispersed uniformly in a predetermined pattern. Therefore, even if the to-be-printed medium is stuck to the adherend, the clue for releasing the first base material from the to-be-printed medium is easy to make and after that, the first base material is easy to remove from the to-be-printed medium.

Examples of the predetermined pattern include a striped pattern, a grid pattern, and a polka-dot pattern.

The print cassette of the present disclosure includes, for example, a thermosensitive type and a thermal transfer type.

In the print cassette, when print is made on the to-be-printed medium with the print head of the print device, the print face of the to-be-printed medium opposes the print head of the print device via the ink face of the ink ribbon. At this time, the to-be-printed medium is covered with the ink ribbon, so that the to-be-printed medium is hidden with respect to the print head of the print device. Further, the width of the ink ribbon is wider than the width of the to-be-printed medium. For this reason, even if the ink ribbon is shifted in the width direction at the time of printing, a state in which the to-be-printed medium is hidden with respect to the print head of the print device via the ink ribbon is maintained. Consequently, heat generated by the print head of the print device at the time of printing is transmitted to the to-be-printed medium via the ink ribbon, so that the heat is not transmitted directly to the to-be-printed medium. Thus, because print is made on the to-be-printed medium in a state of being unsusceptible to bad influence of heat, print quality is excellent and print appearance is also excellent.

Because in the print cassette, the width of the first base material and the width of the to-be-printed medium are different from each other, the first base material can be distinguished easily and it is convenient when releasing the first base material from the to-be-printed medium.

In the print cassette, because the first base material is transparent, printed characters on the printing surface of the to-be-printed medium can be recognized visually and the up-down direction of the print tape can be confirmed. Thus, it is convenient when sticking the print tape to the adherend.

In the print cassette, when the print cassette is mounted in the print device, the print tape constituted of the first tape and one of the second tape or the third tape can be discharged from the print device. With regard to the print tape discharged from the print device, the first base material adhered to the to-be-printed medium with the first adhesive layer. Then, the first base material is opaque, and thus has the hiding performance. Accordingly, the to-be-printed medium cannot be recognized visually via the first base material, so that the print content of the to-be-printed medium can be hidden. Consequently, the security effect to the print content of the to-be-printed medium is exerted.

In the print cassette, the first base material is provided preliminarily with the mark indicating the up-down direction or right-left direction of the printing surface of the to-be-printed medium. Thus, even if the to-be-printed medium cannot be recognized visually, the up-down direction or the right-left direction of the to-be-printed medium is never mistaken as long as this mark is used as a clue, so that the to-be-printed medium can be stuck to the adherend.

In the print cassette, the first base material can be removed from the to-be-printed medium easily by the half cut.

In the print cassette, when the print cassette is mounted in the print device, the print tape constituted of the first tape and the second tape can be discharged from the print device. With regard to the print tape discharged from the print device, the second base material adhered to the to-be-printed medium with the second adhesive layer. Then, when part of the second base material is removed from the to-be-printed medium along the half cut in order to stick the to-be-printed medium to the adherend, part of the second adhesive layer is exposed, so that part of the to-be-printed medium can be stuck to the adherend with the part of the second adhesive layer. At this time, the left portion of the second base material still adhered to the to-be-printed medium and the to-be-printed medium can thus keep the rigidity by the stiffness of the left portion of the second base material. Consequently, however thin the to-be-printed medium is, the work of sticking part of the to-be-printed medium to the adherend securely without generation of wrinkles can be carried out.

After that, because the left portion of the second adhesive layer is exposed when the left portion of the second base material is removed from the to-be-printed medium, the left portion of the to-be-printed medium can be stuck to the adherend with the left portion of the second adhesive layer. At this time, the to-be-printed medium can thus keep the tension by part of the to-be-printed medium stuck to the adherend. Consequently, however thin the to-be-printed medium is, the work of sticking the left portion of the to-be-printed medium to the adherend securely without generation of wrinkles can be carried out.

In other words, by repeatedly releasing part of the second base material from the to-be-printed medium along the half cut, the to-be-printed medium can be stuck to the adherend step by step. This facilitates the work of securely sticking the to-be-printed medium to the adherend without generation of wrinkles.

In the print cassette, when the print cassette is mounted in the print device, the print tape constituted of the first tape and the second tape can be discharged from the print device. With regard to the print tape discharged from the print device, the second base material adhered to the printing surface of the to-be-printed medium with the second adhesive layer. Then, as described above, the second base material is removed from the to-be-printed medium by using the half cut in the second base material and, with the exposed second adhesive layer stuck to the adherend, the first base material which adhered to the to-be-printed medium with the first adhesive layer is removed from the to-be-printed medium. As a result, the first adhesive layer is separated together with the first base material from the to-be-printed medium and then, the printing surface of the to-be-printed medium is stuck to the adherend with the second adhesive layer. Consequently, the "laminated tape" can be stuck to the adherend.

In the print cassette, the third base material adhered to the to-be-printed medium with the third adhesive layer, so that the to-be-printed medium and the third base material are integrally formed. Then, when part of the fourth base material adhered to the third base material with the fourth adhesive layer is removed from the third base material along the half cut in order to stick the to-be-printed medium to the adherend, part of the fourth adhesive layer is exposed, so that part of the to-be-printed medium integrated with the third base material can be stuck to the adherend with the part of the fourth adhesive layer. At this time, the left portion of the fourth base material still adhered to the to-be-printed medium via the third base material and the to-be-printed medium can thus keep the rigidity by the stiffness of the left portion of the fourth base material. Consequently, however thin the to-be-printed medium is, the work of sticking part of the to-be-printed medium to the adherend securely without generation of wrinkles can be carried out.

After that, because the left portion of the fourth adhesive layer is exposed when the left portion of the fourth base material is removed from the third base material integrated with the to-be-printed medium, the left portion of the to-be-printed medium integrated with the third base material can be stuck to the adherend with the left portion of the fourth adhesive layer. At this time, the to-be-printed medium can thus keep the tension by part of the to-be-printed medium stuck to the adherend. Consequently, however thin the to-be-printed medium is, the work of sticking the left portion of the to-be-printed medium to the adherend securely without generation of wrinkles can be carried out.

In other words, by repeatedly releasing part of the fourth base material from the third base material integrated with the to-be-printed medium along the half cut, the to-be-printed medium can be stuck to the adherend step by step. This facilitates the work of securely sticking the to-be-printed medium to the adherend without generation of wrinkles.

In the print cassette, the third base material adhered to the printing surface of the to-be-printed medium with the third adhesive layer. Then, as described above, the fourth base material adhered to the third base material with the fourth adhesive layer is removed by using the half cut in the fourth base material and, with the exposed fourth adhesive layer stuck to an adherend, the first base material which adhered to the to-be-printed medium with the first adhesive layer is removed from the to-be-printed medium. As a result, the first adhesive layer is separated together with the first base material from the to-be-printed medium and then, the printing surface side of the to-be-printed medium is in a state of adhering to the third base material with the third adhesive agent, the third base material is stuck to the adherend with the fourth adhesive layer. Consequently, the "laminated tape" can be stuck to the adherend.

In the print cassette, when the print cassette is mounted in the print device, the print tape can be discharged from the print device. With regard to the print tape discharged from the print device, the release sheet is removed from the both sides adhesive tape adhered to the multilayer laminated tape and, with the exposed second adhesive layer of the both sides adhesive tape stuck to an adherend, the handling auxiliary film is removed from the multilayer laminated tape. As a result, the weak adhesive layer is separated together with the handling auxiliary film from the thin laminated film and then, the first face side of the thin laminated film having the printing surface on which ink of the ink ribbon is thermally transferred is in a state of adhering to the base film with the first adhesive agent, the base film is stuck to the adherend with the second adhesive layer. Consequently, the "laminated tape" can be stuck to the adherend.

In the print cassette, when the print cassette is mounted in the print device, the print tape can be discharged from the print device. With regard to the print tape discharged from the print device, the release sheet is removed from the monolayer adhesive tape adhered to the multilayer laminated tape and, with the exposed third adhesive layer of the monolayer adhesive tape stuck to an adherend, the handling auxiliary film is removed from the multilayer laminated tape. As a result, the weak adhesive layer is separated together with the handling auxiliary film from the thin laminated film and then, the first face side of the thin laminated film having the printing surface on which ink of the ink ribbon is thermally transferred is stuck to the adherend with the third adhesive layer. Consequently, the "laminated tape" can be stuck to the adherend.

In the print cassette, the thin laminated film adhered to the handling auxiliary film with the weak adhesive layer, so that the thin laminated film can thus keep the rigidity at least by the thickness of the handling auxiliary film. Thus, the feeding performance in the print cassette of the present disclosure can be secured.

When the "laminated tape" is stuck to the adherend, the multilayer laminated tape adhered to one of the both sides adhesive tape or the monolayer adhesive tape, so that the "laminated tape" can thus keep the rigidity at least by the thickness of the multilayer laminated tape. Thus, however thin the thin laminated film constituting the "laminated tape" is, the work of sticking the "laminated tape" to the adherend securely can be carried out.

Because in the print cassette, the width of the handling auxiliary film and the width of the thin laminated film are different from each other, the handling auxiliary film can be distinguished easily and it is convenient when releasing the handling auxiliary film from the thin laminated film.

In the print cassette, because the handling auxiliary film is transparent, printed characters on the printing surface of the thin laminated film can be recognized visually and the up-down direction of the print tape can be confirmed. Thus, it is convenient when sticking the print tape to the adherend.

In the print cassette, if the handling auxiliary film is colored and transparent or patterned and transparent, existence of the handling auxiliary film as well as ink on the print face of the thin laminated film can be recognized visually. Thus, it is convenient when sticking the print tape to the adherend or releasing the handling auxiliary film from the thin laminated film.

In the print cassette, the handling auxiliary film is provided preliminarily with the mark indicating the up-down direction or right-left direction of the printing surface of the thin laminated film. Thus, even if the thin laminated film cannot be recognized visually, the up-down direction or the right-left direction of the thin laminated film is never mistaken as long as this mark is used as a clue, so that the thin laminated film can be stuck to the adherend.

In the print cassette, the handling auxiliary film can be removed from the thin laminated film easily by the half cut.

In the print cassette, the release sheet adhered to the thin laminated film with the third adhesive layer. Then, when part of the release sheet is removed from the thin laminated film along the half cut in order to stick the thin laminated film to the adherend, part of the third adhesive layer is exposed, so that part of the thin laminated film can be stuck to the adherend with the part of the third adhesive layer. At this time, the left portion of the release sheet still adhered to the thin laminated film and the thin laminated film can thus keep the rigidity by the stiffness of the left portion of the release sheet. Consequently, however thin the thin laminated film is, the work of sticking part of the thin laminated film to the adherend securely without generation of wrinkles can be carried out.

After that, because the left portion of the third adhesive layer is exposed when the left portion of the release sheet is removed from the thin laminated film, the left portion of the thin laminated film can be stuck to the adherend with the left portion of the third adhesive layer. At this time, the thin laminated film can thus keep the tension by part of the thin laminated film stuck to the adherend. Consequently, however thin the thin laminated film is, the work of sticking the left portion of the thin laminated film to the adherend securely without generation of wrinkles can be carried out.

In other words, by repeatedly releasing part of the release sheet from the thin laminated film along the half cut, the thin laminated film can be stuck to the adherend step by step. This facilitates the work of securely sticking the thin laminated film to the adherend without generation of wrinkles.

BRIEF DESCRIPTION OF THE DRAWINGS

FIG. 72A is a plan view illustrating another print tape according to the third embodiment.

FIG. 72B is a plan view illustrating another print tape according to the third embodiment.

FIG. 72C is a plan view illustrating another print tape according to the third embodiment.

FIG. 73A is an exemplary diagram illustrating a coating pattern of a second adhesive agent forming a second adhesive layer according to the third embodiment.

FIG. 73B is an exemplary diagram illustrating a coating pattern of the second adhesive agent forming the second adhesive layer according to the third embodiment.

FIG. 73C is an exemplary diagram illustrating a coating pattern of the second adhesive agent forming the second adhesive layer according to the third embodiment.

FIG. 73D is an exemplary diagram illustrating a coating pattern of the second adhesive agent forming the second adhesive layer according to the third embodiment.

FIG. 74 is a cross-sectional view of a print tape of thermosensitive type according to the third embodiment, taken along a line C2-C2 illustrated in FIG. 76.

FIG. 75 is a perspective view of a print cassette of thermosensitive type according to the third embodiment.

FIG. 76 is a plan view of the print cassette of thermosensitive type according to the third embodiment from which an upper cassette case is removed.

FIG. 77 is a schematic view illustrating a process of a first tape of thermosensitive type and a second tape being guided on a lower cassette case according to the third embodiment.

FIG. 78 is a cross-sectional view of the print tape of thermosensitive type according to the third embodiment being stuck to an adherend as a "non-laminated tape".

Figure 57A:
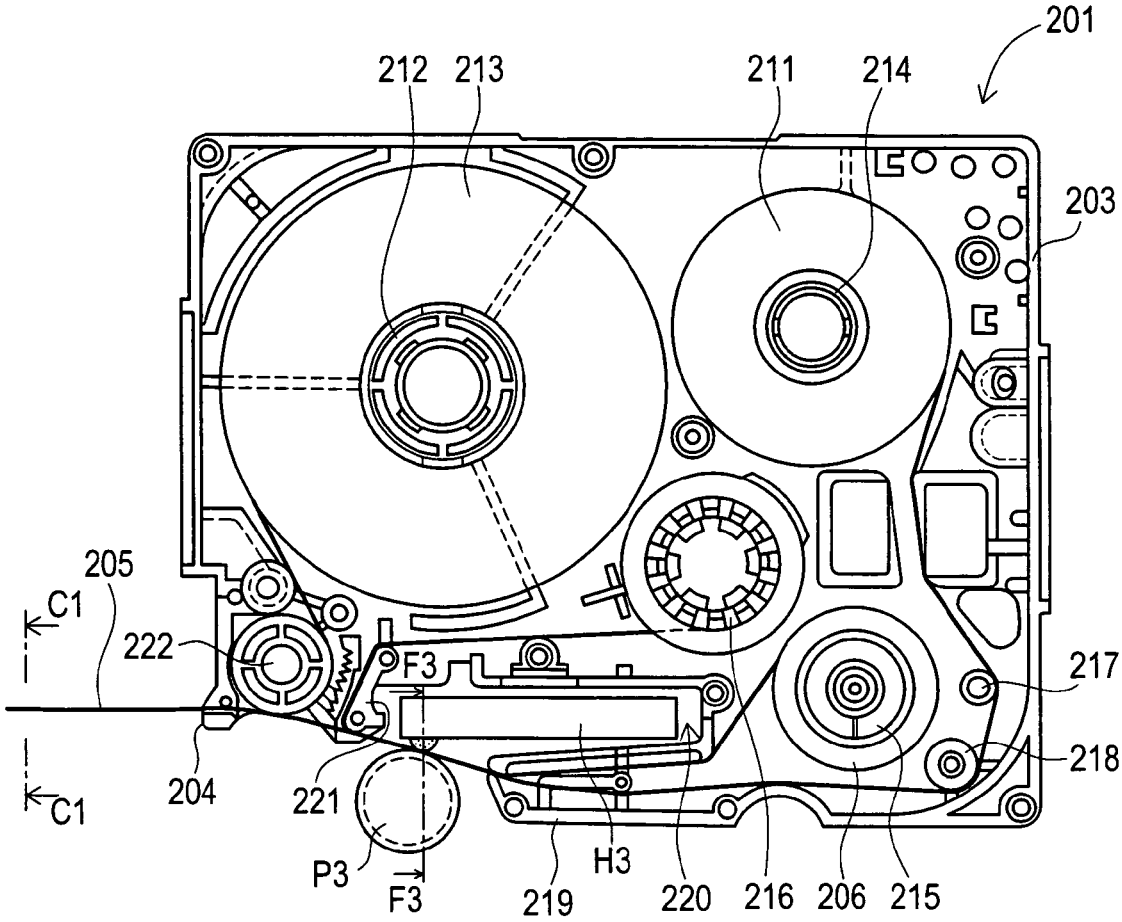
FIG. 57A is a plan view of the print cassette of thermal transfer type according to the third embodiment from which an upper cassette case is removed.
Figure 79:
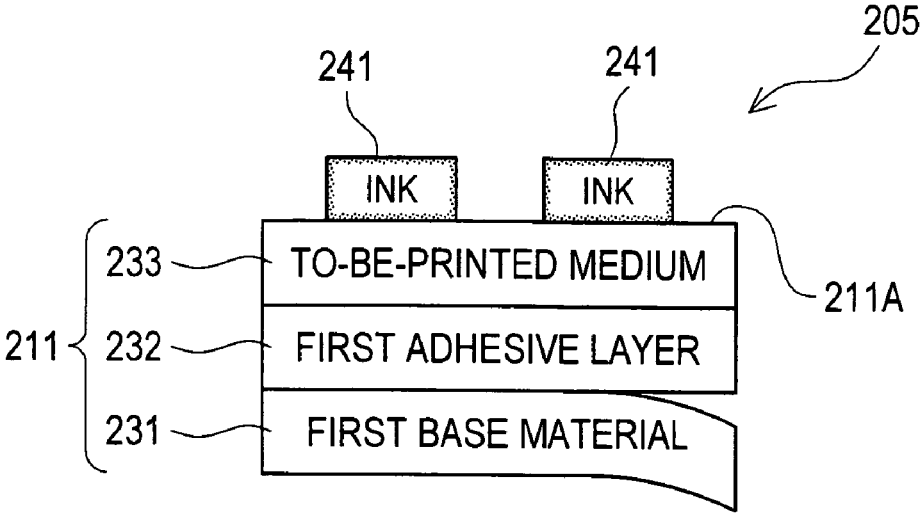

FIG. 79 is a cross-sectional view of a print tape not having a second base material according to the third embodiment, taken along the line C1-C1 illustrated in FIG. 57A.

Figure 80A:
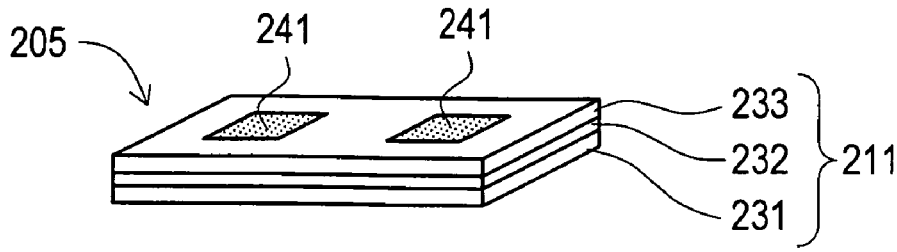

FIG. 80A is an explanatory diagram illustrating the way of using the print tape not having the second base material according to the third embodiment.

Figure 80B:
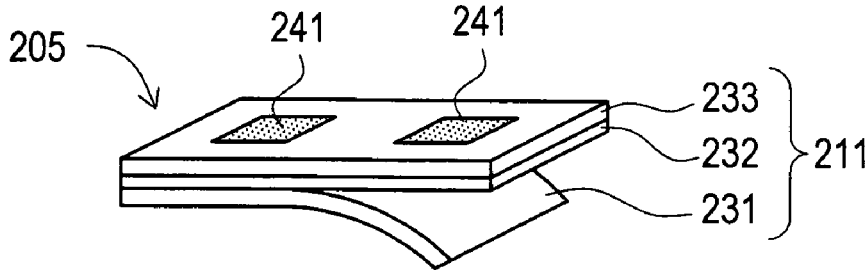

FIG. 80B is an explanatory diagram illustrating the way of using the print tape not having the second base material according to the third embodiment.

Figure 80C:
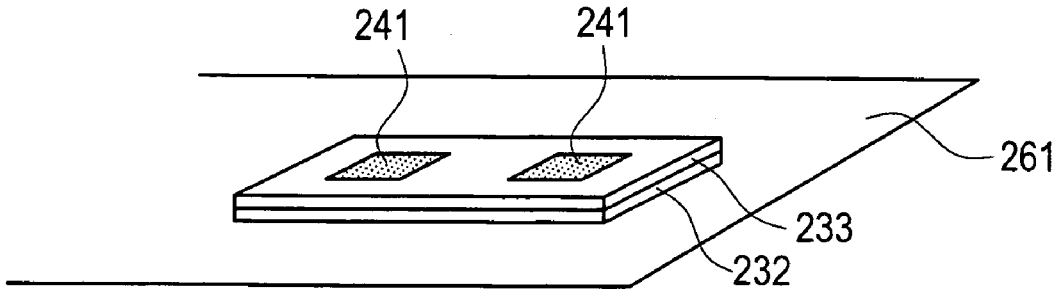

FIG. 80C is an explanatory diagram illustrating the way of using the print tape not having the second base material according to the third embodiment.

Figure 81:
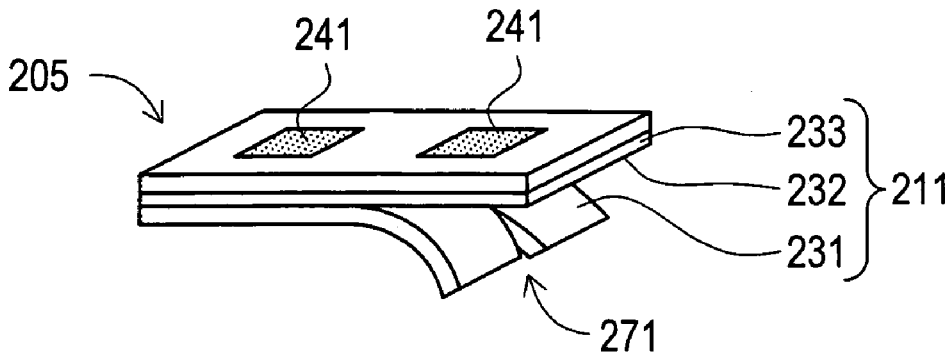

FIG. 81 is a perspective view illustrating the print tape not having the second base material according to the third embodiment.

Figure 82:
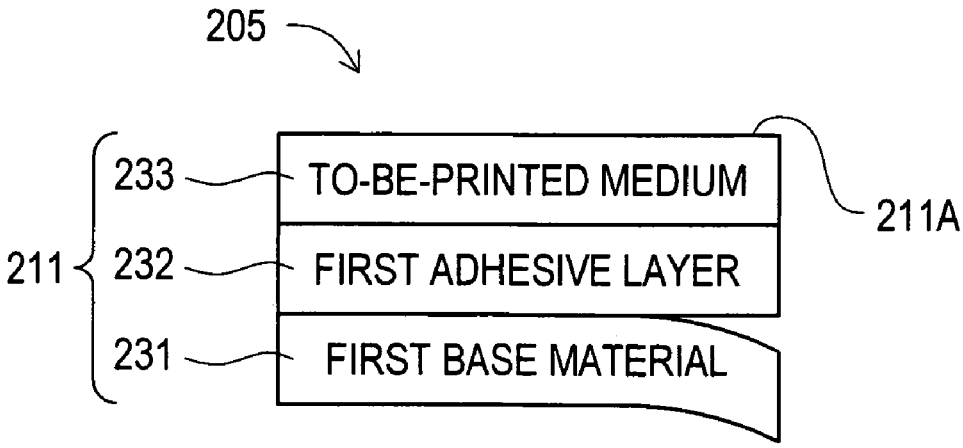

FIG. 82 is a cross-sectional view of the print tape not having the second base material according to the third embodiment being stuck to an adherend as a "non-laminated tape".

Figure 83:
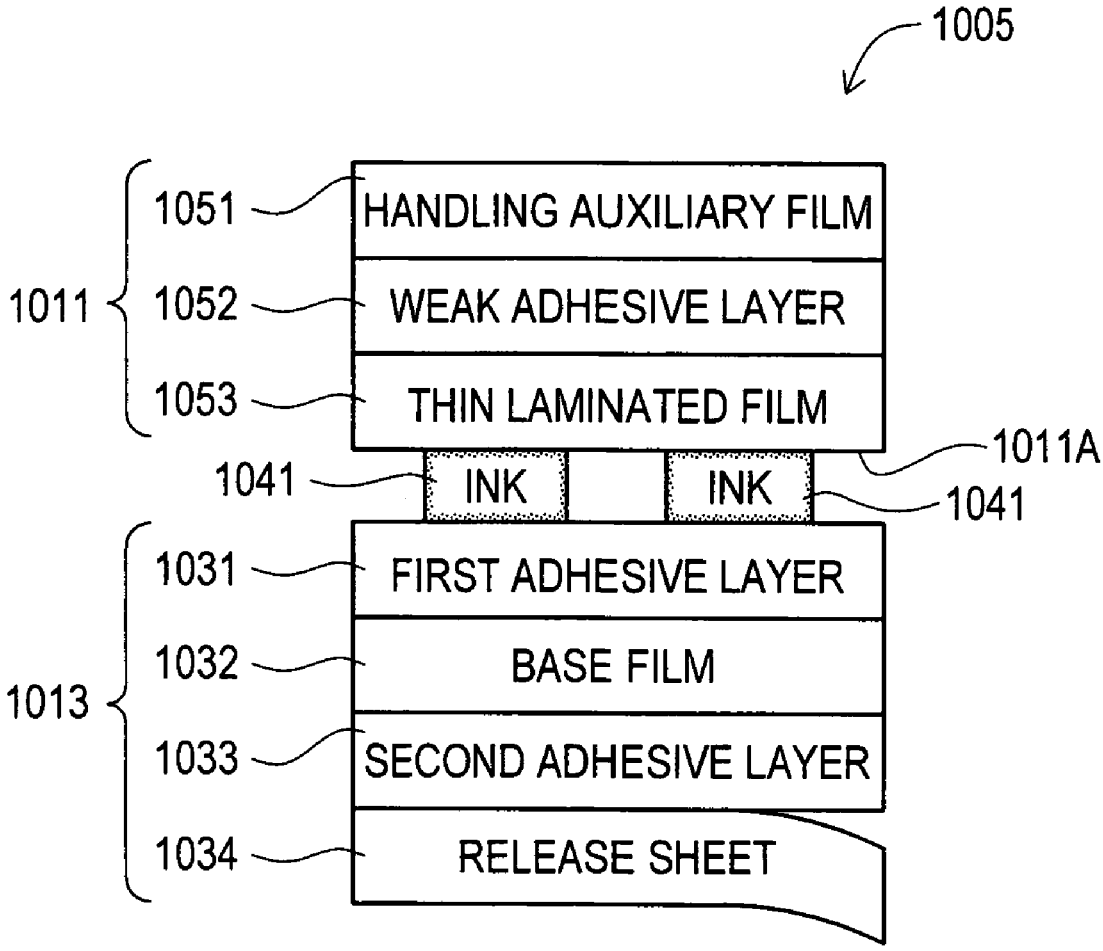
Figure 85:
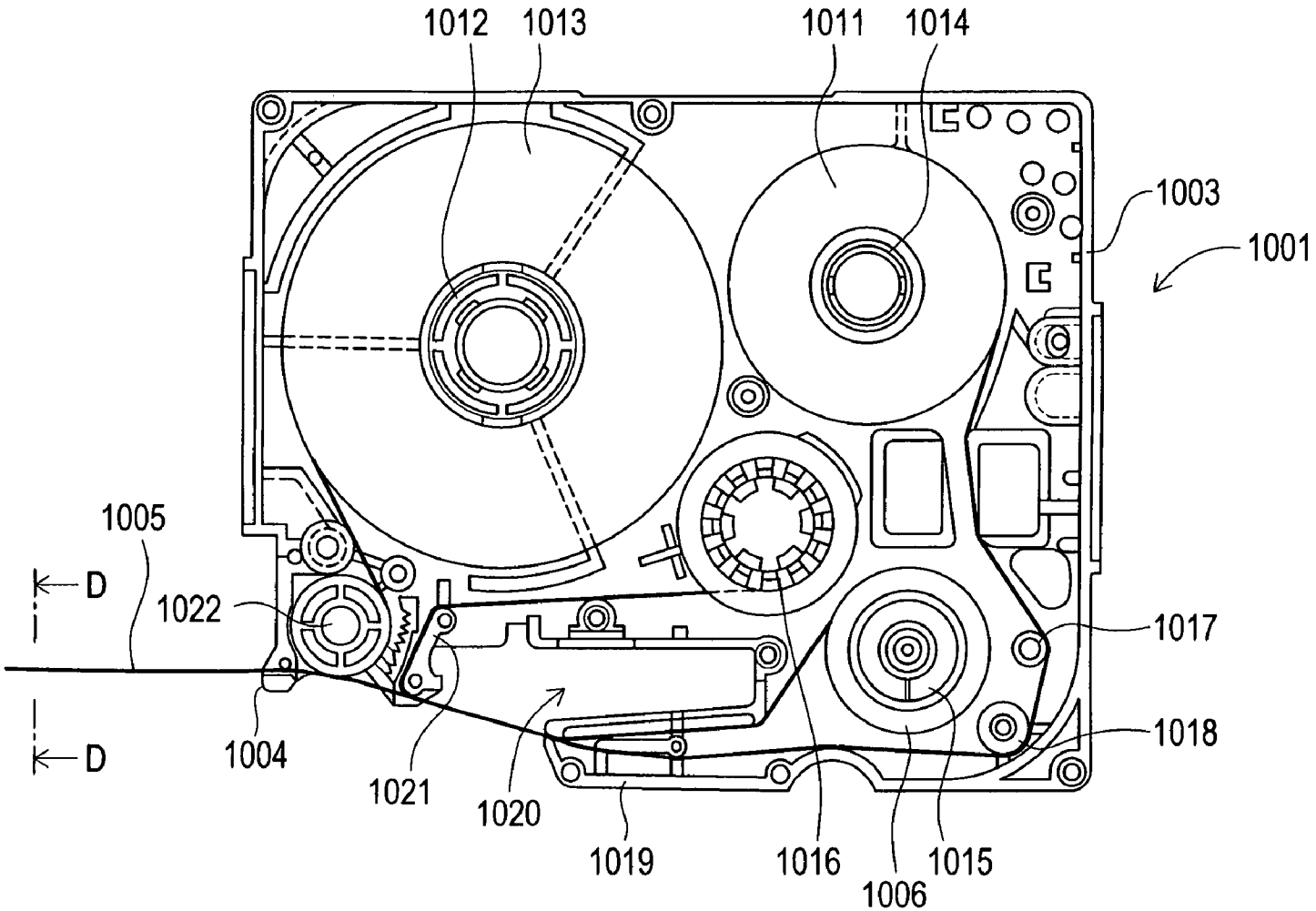

FIG. 83 is a cross-sectional view of a print tape according to a fourth embodiment taken along a line D-D illustrated in FIG. 85.

Figure 84:
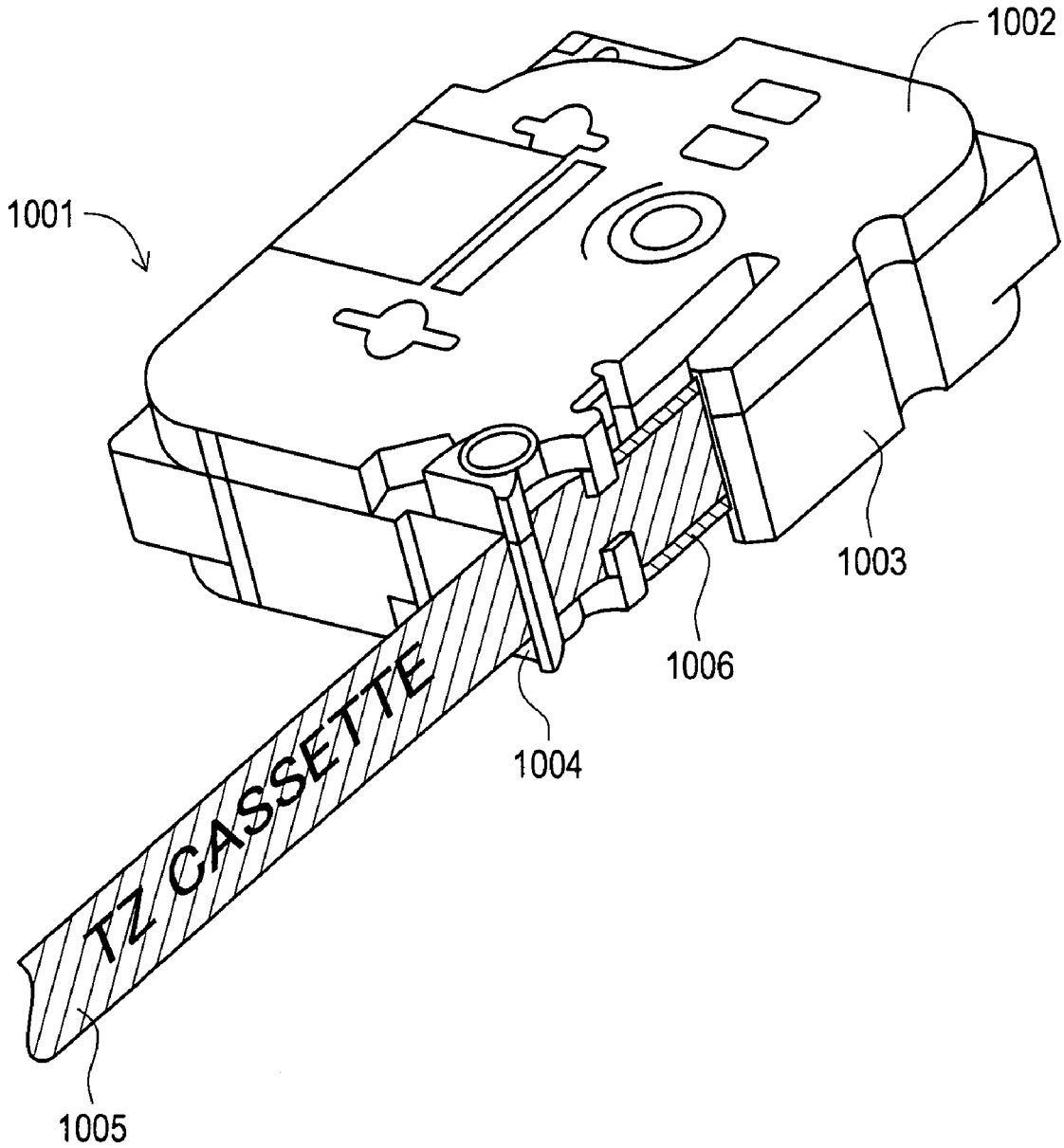

FIG. 84 is a perspective view of a print cassette according to the fourth embodiment.

FIG. 85 is a plan view of the print cassette according to the fourth embodiment from which the upper cassette case is removed.

Figure 86:
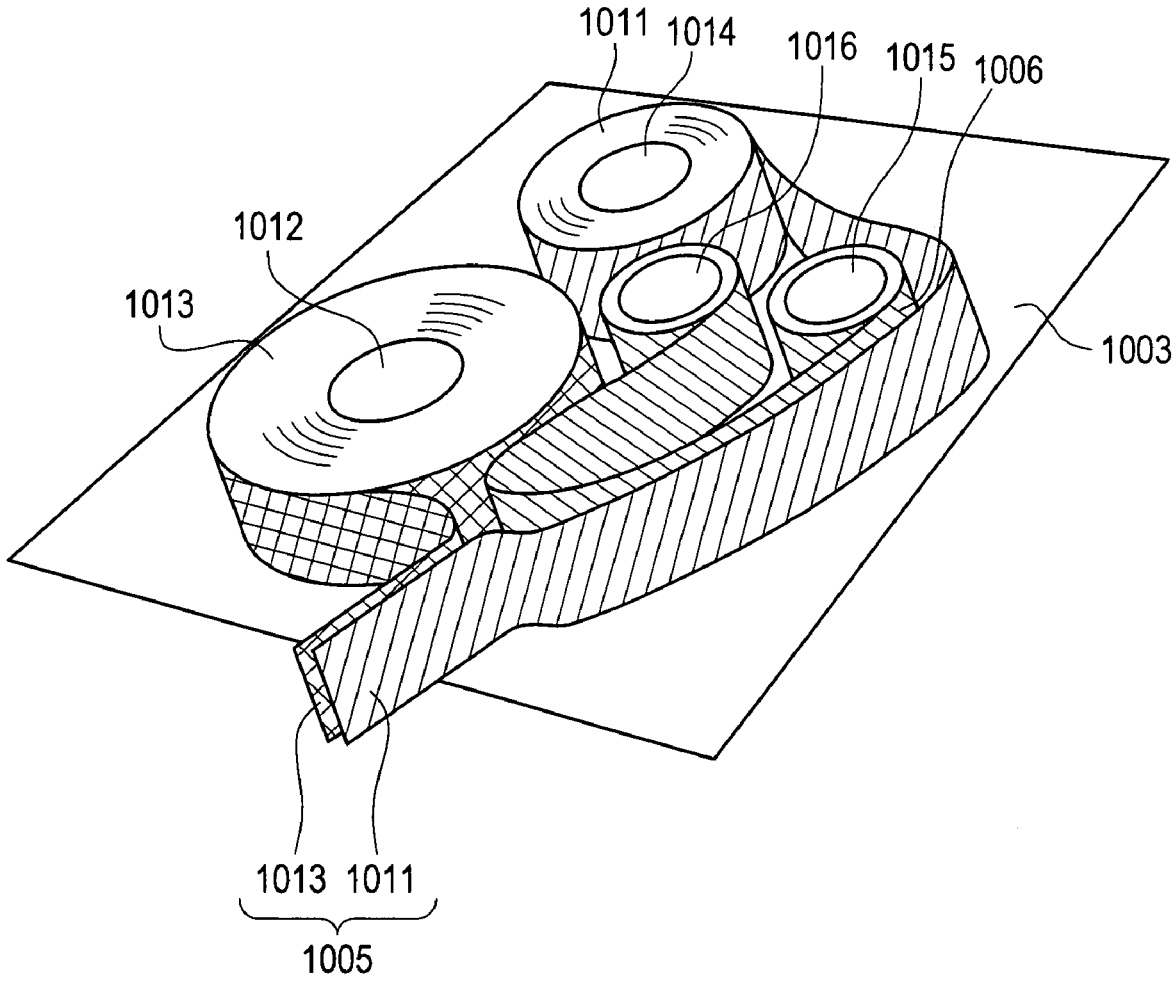

FIG. 86 is a schematic view illustrating a process of a multilayer laminated tape, a both sides adhesive tape and an ink ribbon being guided on a lower cassette case according to the fourth embodiment.

Figure 87:
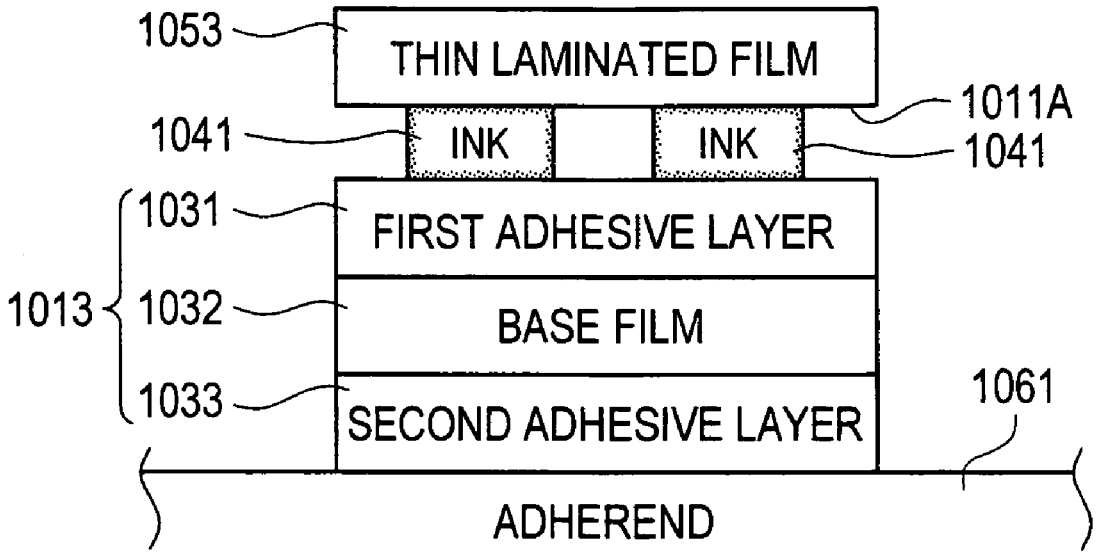

FIG. 87 is a cross-sectional view of the print tape according to the fourth embodiment being stuck to an adherend as a "laminated tape".

Figure 88A:
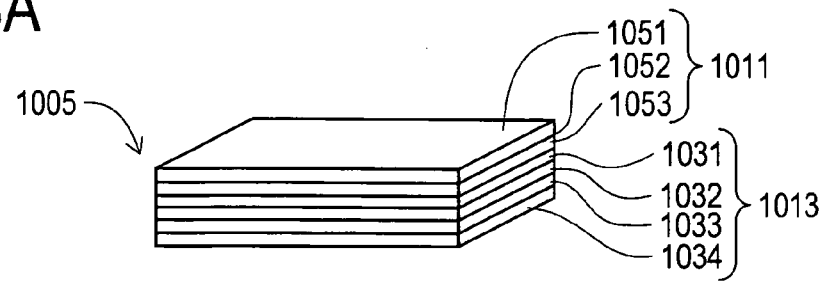

FIG. 88A is an explanatory diagram illustrating the way of using the print tape according to the fourth embodiment.

Figure 88B:
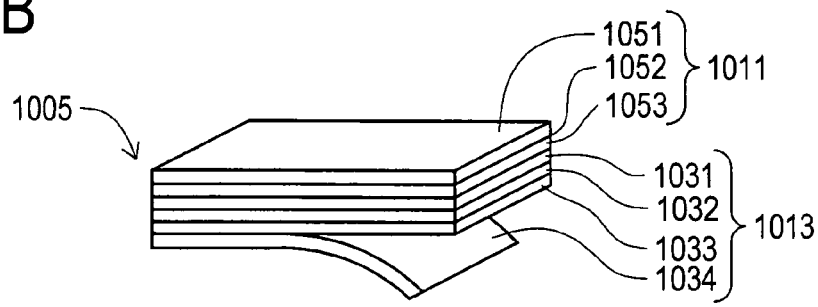

FIG. 88B is an explanatory diagram illustrating the way of using the print tape according to the fourth embodiment.

Figure 88C:
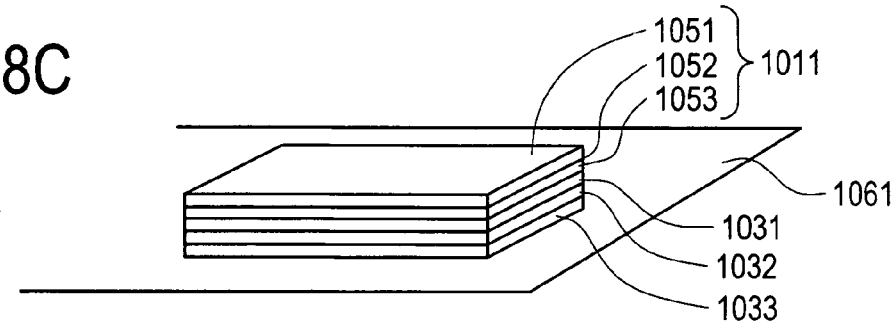

FIG. 88C is an explanatory diagram illustrating the way of using the print tape according to the fourth embodiment.

Figure 88D:
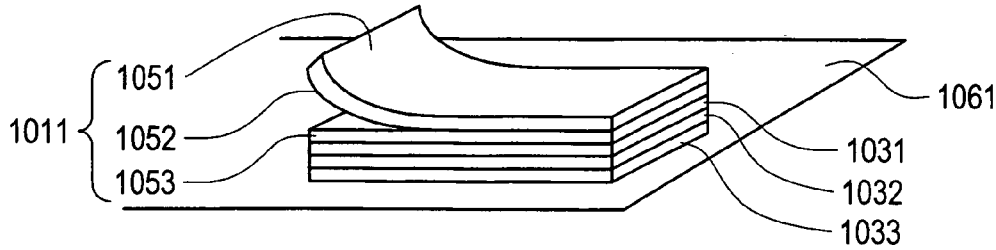

FIG. 88D is an explanatory diagram illustrating the way of using the print tape according to the fourth embodiment.

Figure 88E:
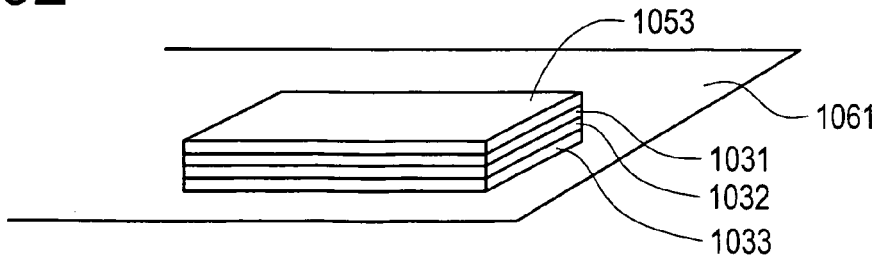

FIG. 88E is an explanatory diagram illustrating the way of using the print tape according to the fourth embodiment.

Figure 89:
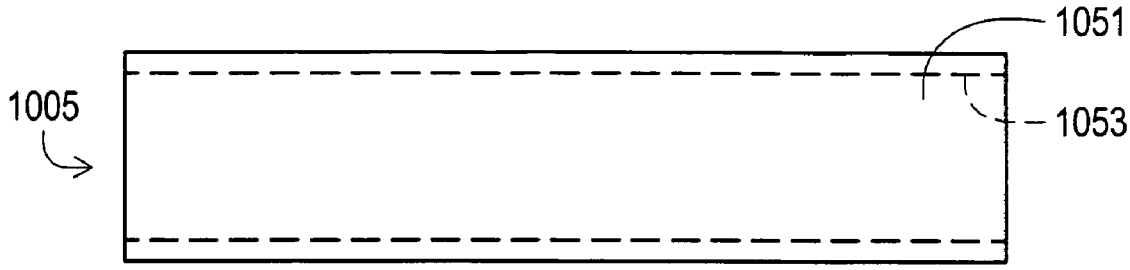

FIG. 89 is a plan view illustrating another print tape according to the fourth embodiment.

Figure 90:
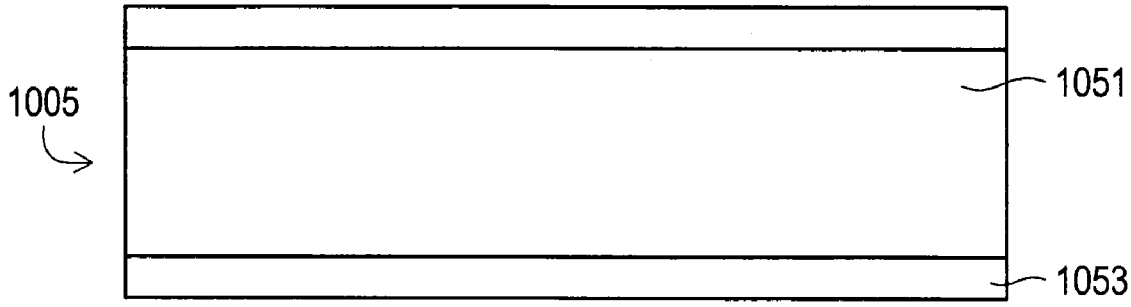

FIG. 90 is a plan view illustrating another print tape according to the fourth embodiment.

Figure 91:
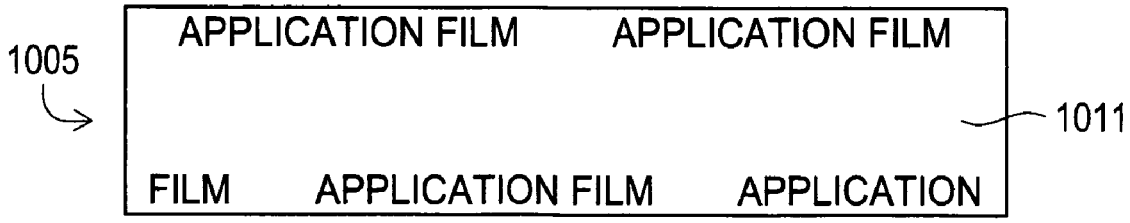

FIG. 91 is a plan view illustrating another print tape according to the fourth embodiment.

Figure 92:
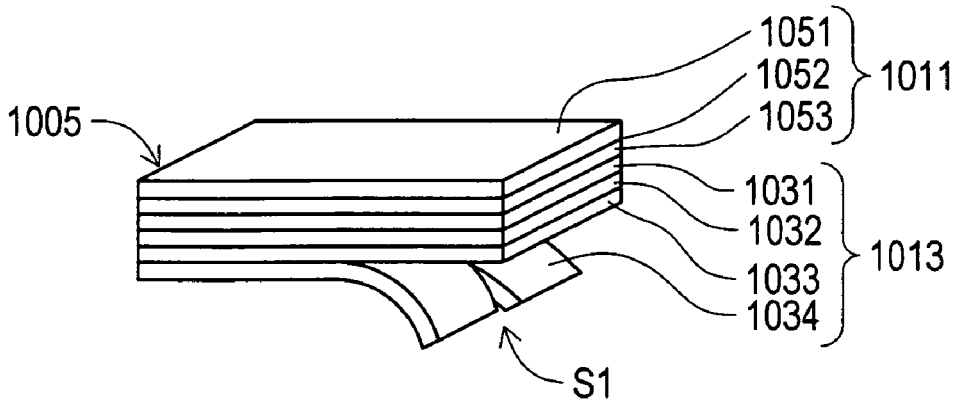

FIG. 92 is a perspective view illustrating another print tape according to the fourth embodiment.

Figure 93:
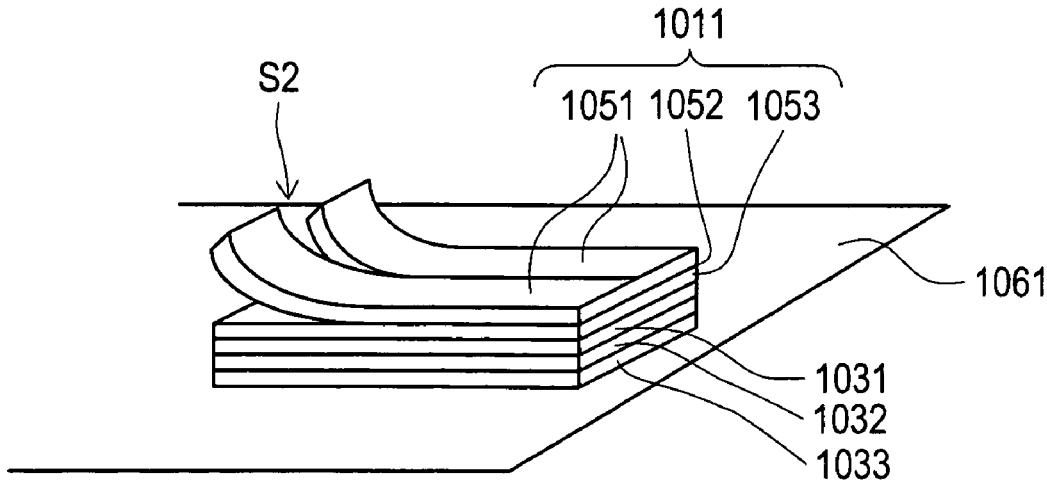

FIG. 93 is a perspective view illustrating another print tape according to the fourth embodiment.

Figure 94:
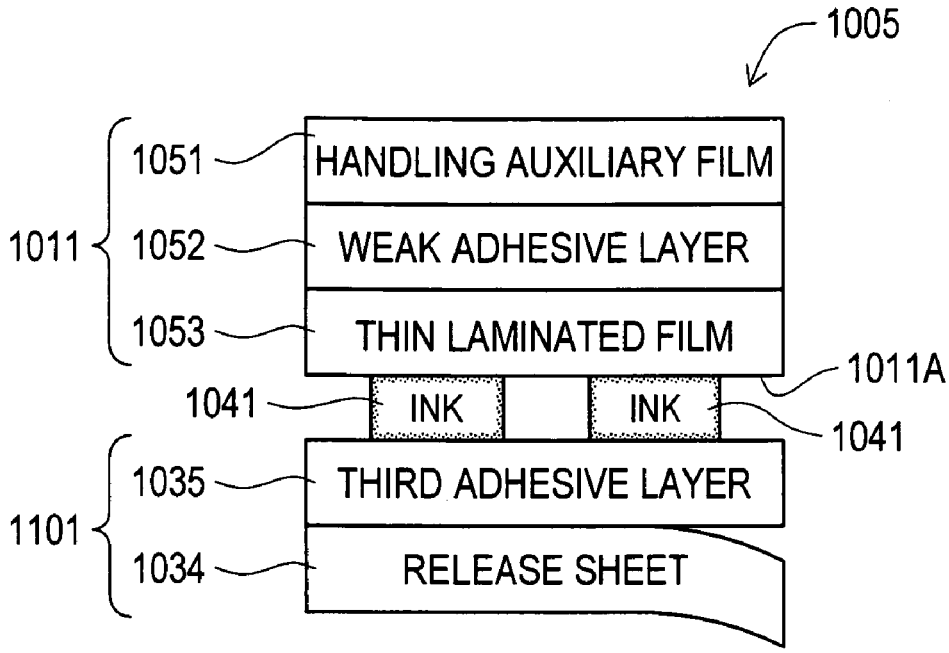

FIG. 94 is a cross-sectional view of another print tape according to the fourth embodiment, taken along the line D-D illustrated in FIG. 85.

Figure 95:
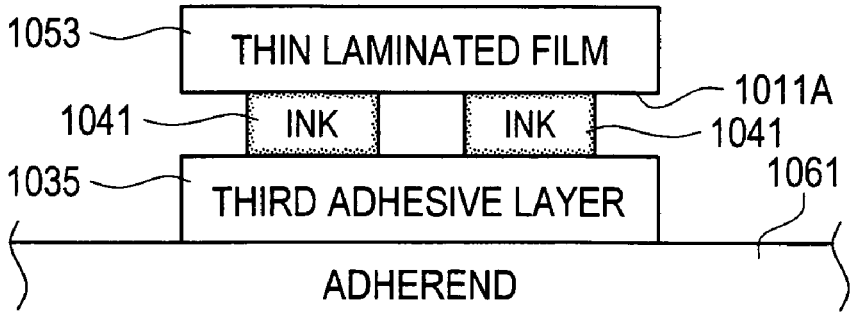

FIG. 95 is a cross-sectional view of another print tape according to the fourth embodiment being stuck to an adherend as a "laminated tape".

Figure 96:
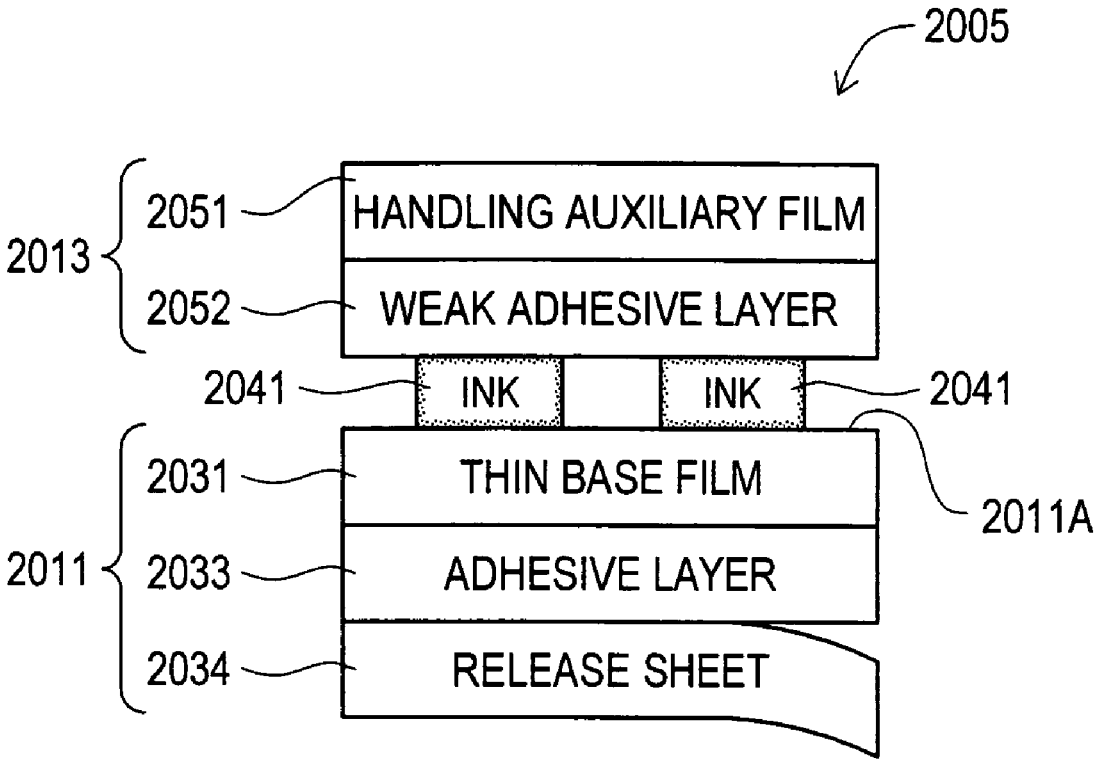
Figure 98:
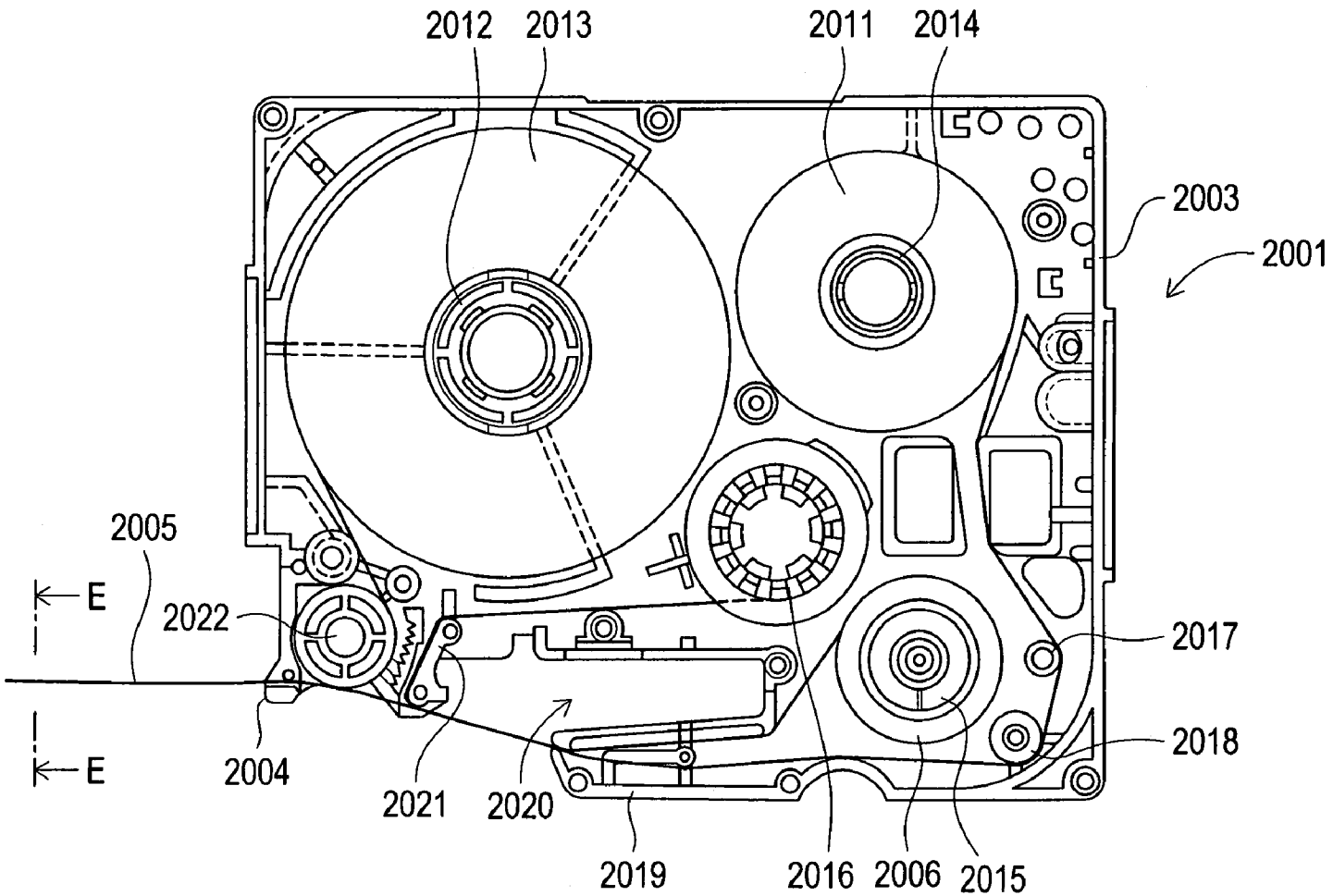

FIG. 96 is a cross-sectional view of a print tape according to a fifth embodiment taken along a line A-A illustrated in FIG. 98.

Figure 97:
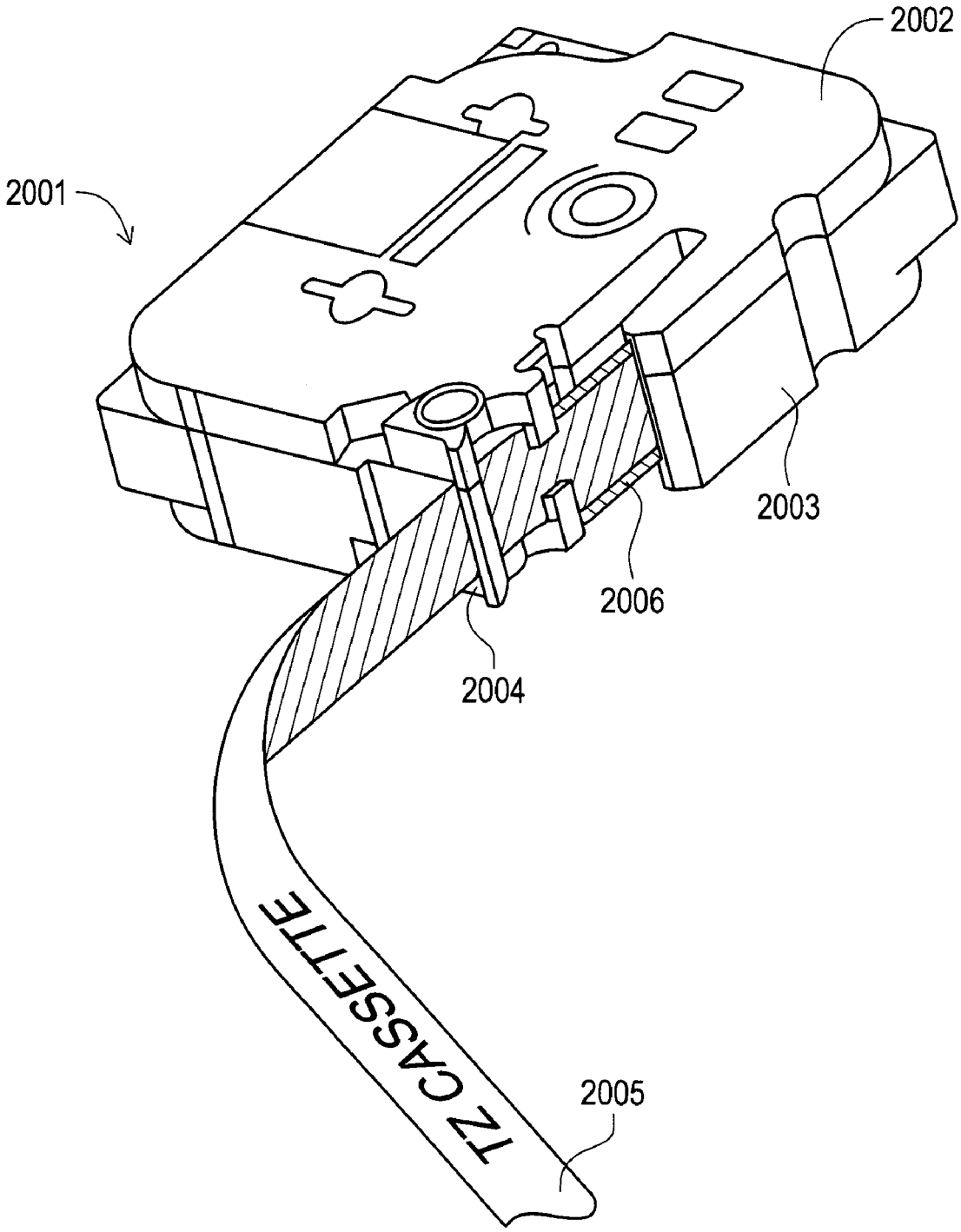

FIG. 97 is a perspective view of a print cassette according to the fifth embodiment.

FIG. 98 is a plan view of the print cassette according to the fifth embodiment from which an upper cassette case is removed.

Figure 99:
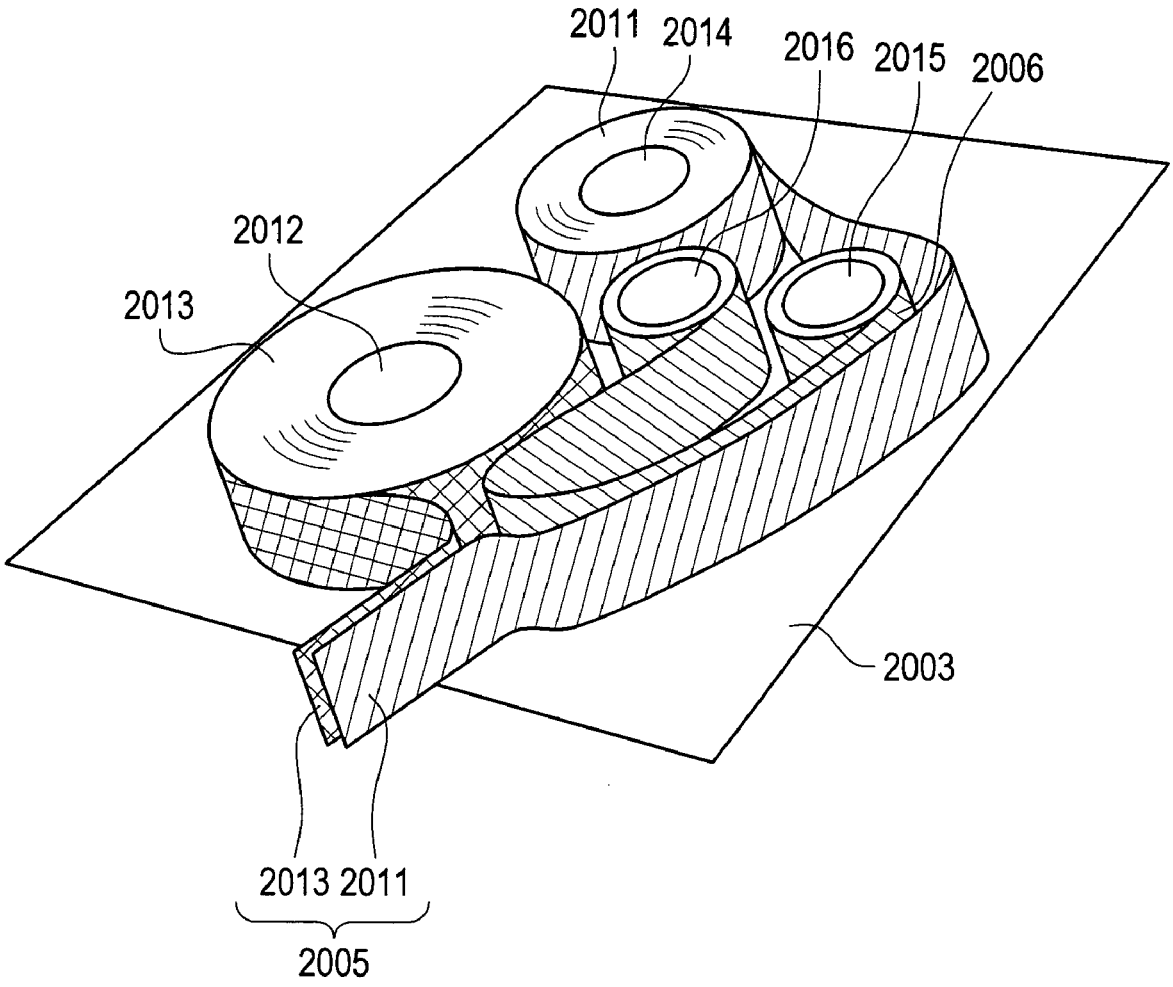

FIG. 99 is a schematic view illustrating a process of a thin tape, an application tape and an ink ribbon being guided on a lower cassette case according to the fifth embodiment.

Figure 100:
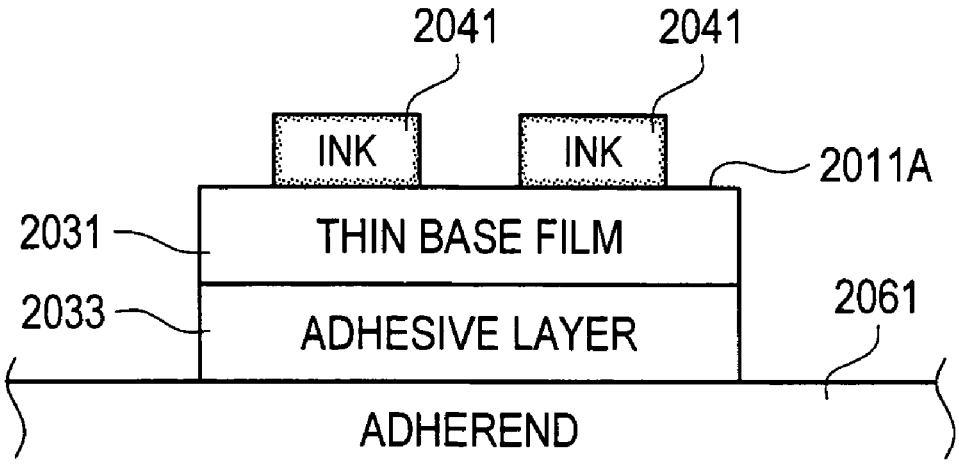

FIG. 100 is a cross-sectional view of the print tape according to the fifth embodiment being stuck to an adherend as a "laminated tape".

Figure 101A:
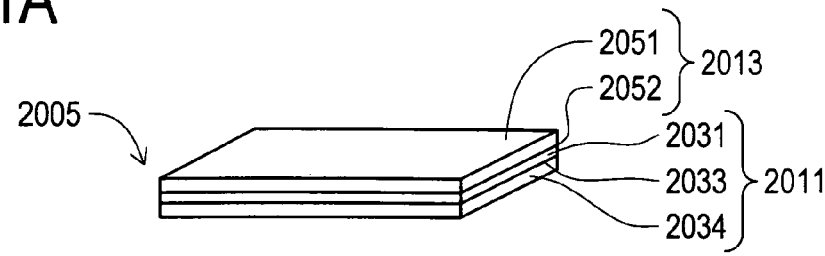

FIG. 101A is an explanatory diagram illustrating the way of using the print tape according to the fifth embodiment.

Figure 101B:
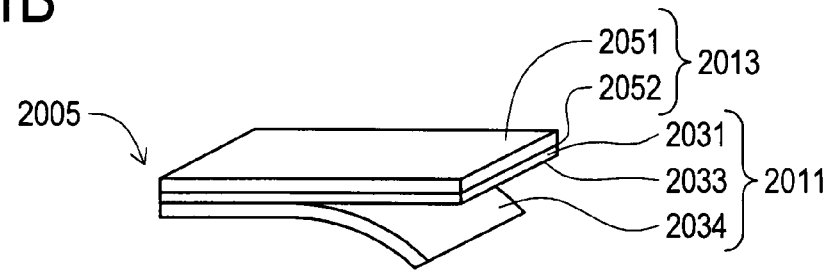

FIG. 101B is an explanatory diagram illustrating the way of using the print tape according to the fifth embodiment.

Figure 101C:
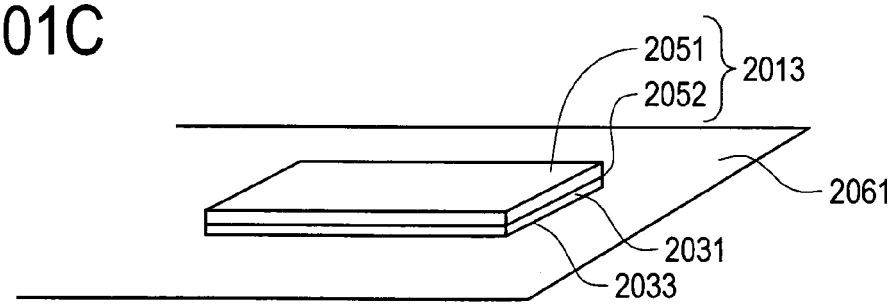

FIG. 101C is an explanatory diagram illustrating the way of using the print tape according to the fifth embodiment.

Figure 101D:
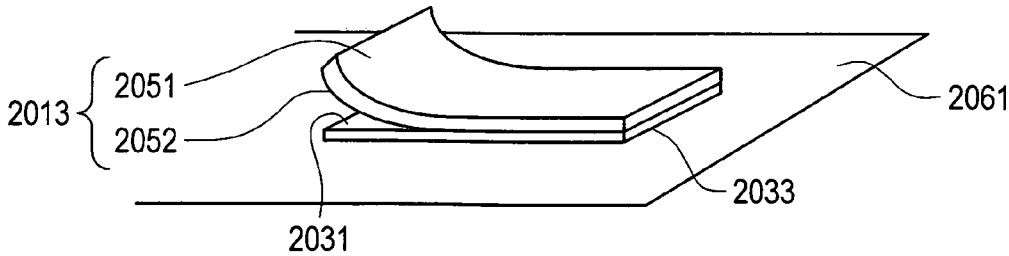

FIG. 101D is an explanatory diagram illustrating the way of using the print tape according to the fifth embodiment.

Figure 101E:
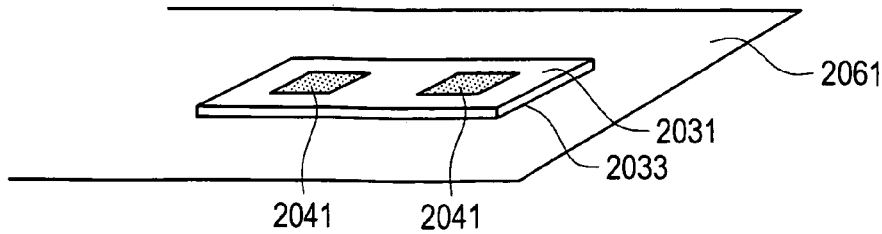

FIG. 101E is an explanatory diagram illustrating the way of using the print tape according to the fifth embodiment.

Figure 102:
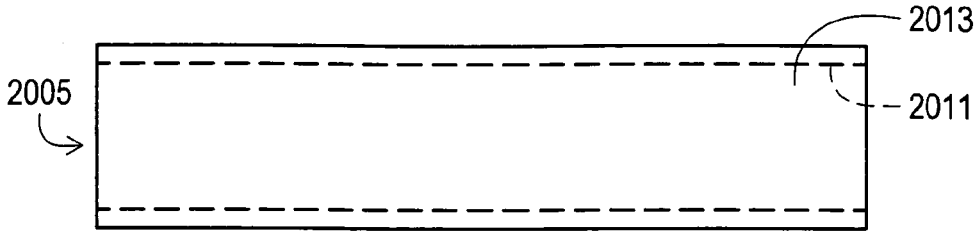

FIG. 102 is a plan view illustrating another print tape according to the fifth embodiment.

Figure 103:
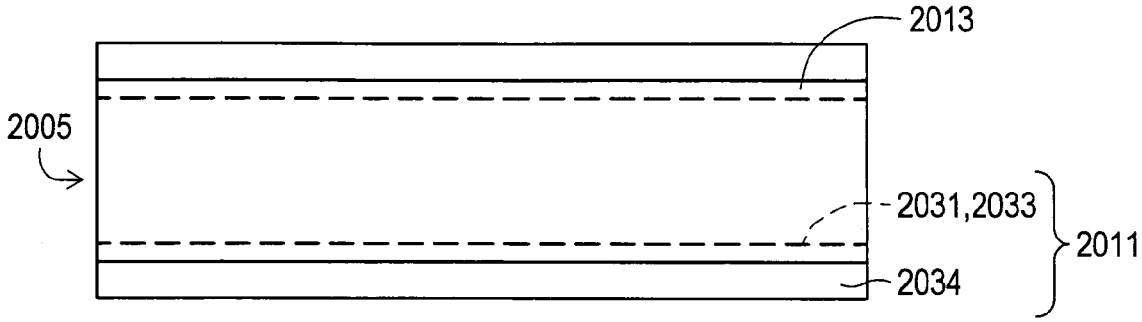

FIG. 103 is a plan view illustrating another print tape according to the fifth embodiment.

Figure 104:
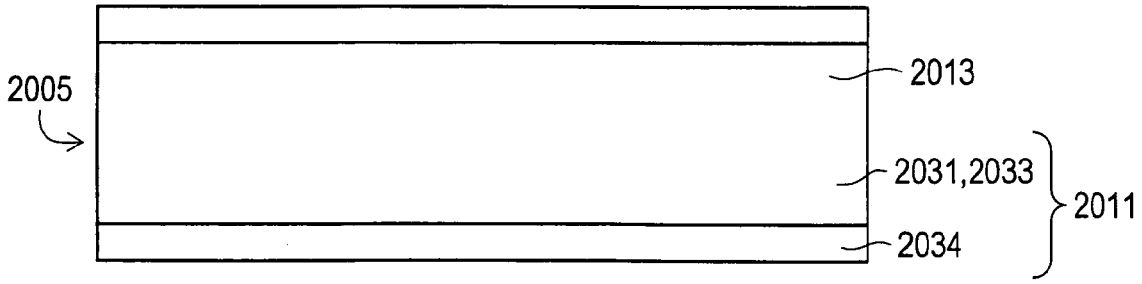

FIG. 104 is a plan view illustrating another print tape according to the fifth embodiment.

Figure 105:
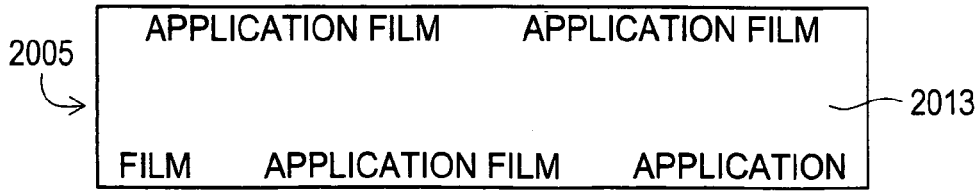

FIG. 105 is a plan view illustrating another print tape according to the fifth embodiment.

Figure 106:
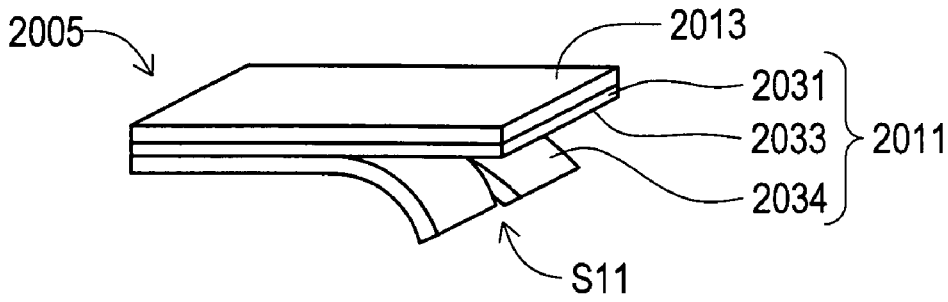

FIG. 106 is a perspective view illustrating another print tape according to the fifth embodiment.

Figure 107:
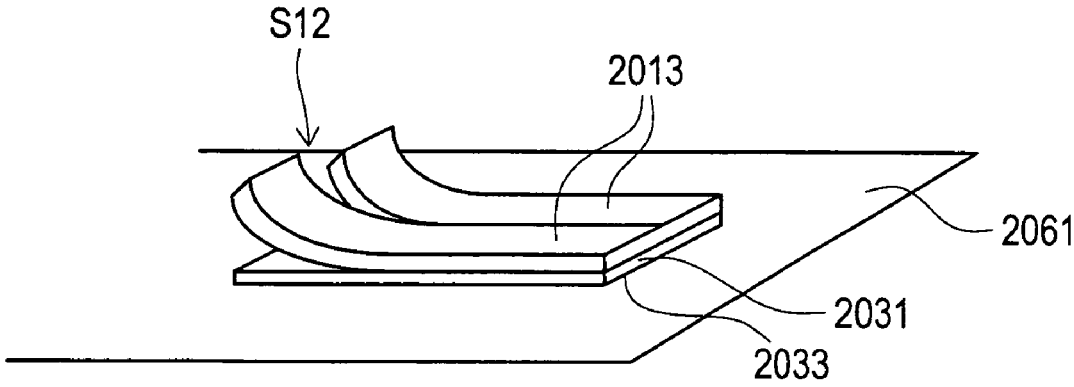

FIG. 107 is a cross-sectional view of another print tape according to the fifth embodiment being stuck to an adherend as a "non-laminated tape".

EXPLANATION OF REFERENCES

1 print cassette
5 print tape
6 ink ribbon
11 first tape
11A printing surface
13 second tape
31 first base material
32 first adhesive layer
33 to-be-printed medium
51 second adhesive layer
52 second base material
61 adherend
71 half cut

81 half cut
H1 thermal head
101 print cassette
105 print tape
106 ink ribbon
111 first tape
111A printing surface
113 third tape
131 first base material
132 first adhesive layer
133 to-be-printed medium.
151 third adhesive layer
152 third base material
153 fourth adhesive layer
154 fourth base material
161 adherend
171 half cut
181 half cut
H2 thermal head
201 print cassette
205 print tape
206 ink ribbon
211 first tape
211A printing surface
213 second tape
231 first base material
232 first adhesive layer
233 to-be-printed medium
251 second adhesive layer
252 second base material
261 adherend
271 half cut
281 half cut
H3 thermal head
1001 print cassette
1005 print tape
1006 ink ribbon
1011 multilayer laminated tape
1011A printing surface
1013 both sides adhesive tape
1031 first adhesive layer
1032 base film
1033 second adhesive layer
1034 release sheet
1035 third adhesive layer
1051 handling auxiliary film
1052 weak adhesive layer
1053 thin laminated film
1061 adherend
monolayer adhesive tape
S1 half cut
S2 half cut
2001 print cassette
2005 print tape
2006 ink ribbon
2011 thin film tape
2011A printing surface (adhesion object surface)
2013 application tape
2031 thin base film
2033 adhesive layer
2034 release sheet
2051 handling auxiliary film
2052 weak adhesive layer
2061 adherend
S11 half cut
S12 half cut

BEST MODE FOR CARRYING OUT THE INVENTION

Figure 2:
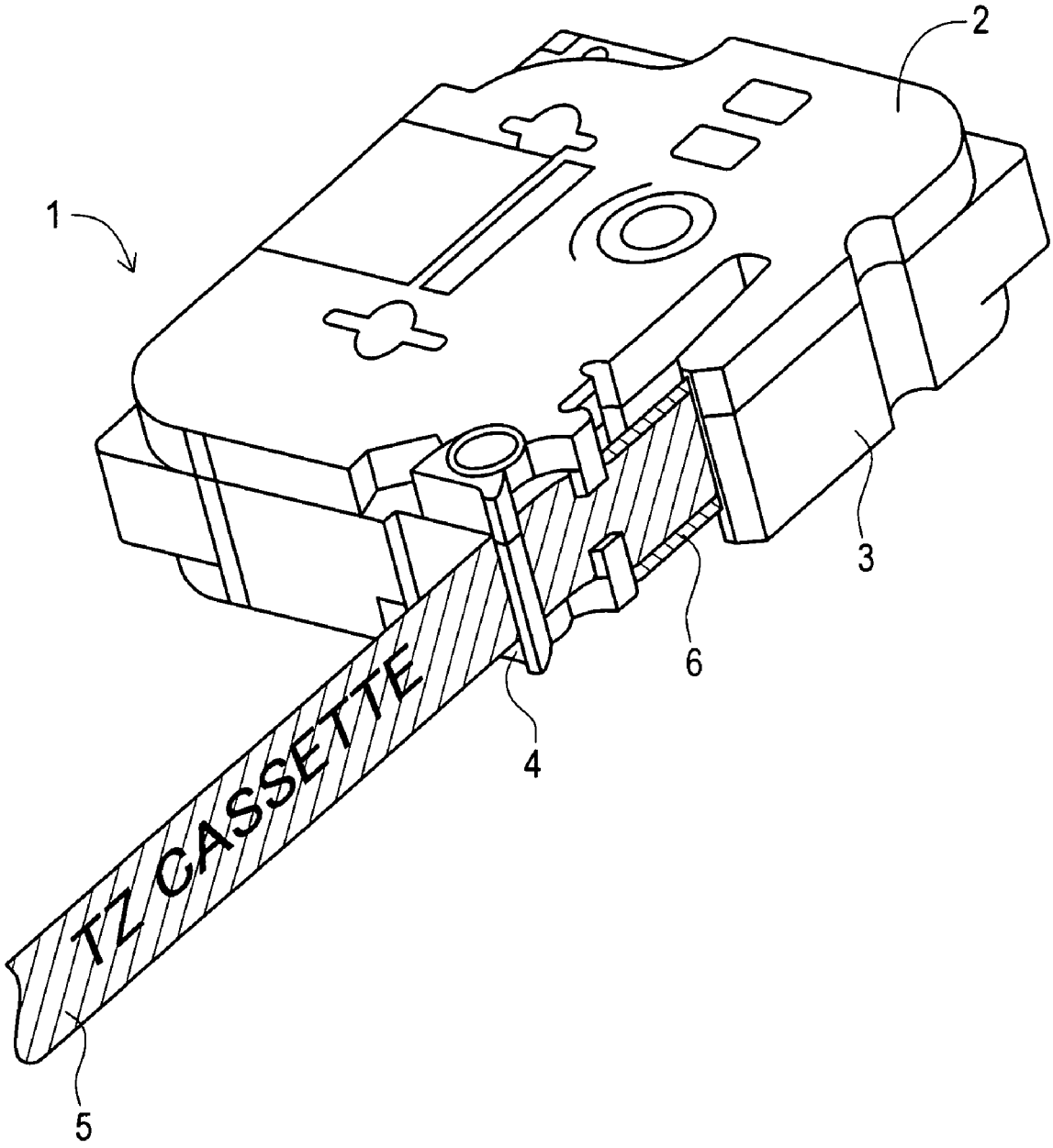
FIG. 2 is a perspective view of a print cassette of thermal transfer type according to the first embodiment.

Hereinafter, the print cassette of the present disclosure will be described in detail based on the first embodiment of the present disclosure with reference to the drawings. FIG. 2 is a perspective view of the print cassette. As shown in FIG. 2, a print cassette 1 of the first embodiment comprises an upper cassette case 2 and a lower cassette case 3. A print tape 5 is discharged from a tape discharging port 4. It is noted that a reference numeral 6 indicates an ink ribbon. The width of the ink ribbon 6 is wider than that of the print tape 5.

Figure 3A:
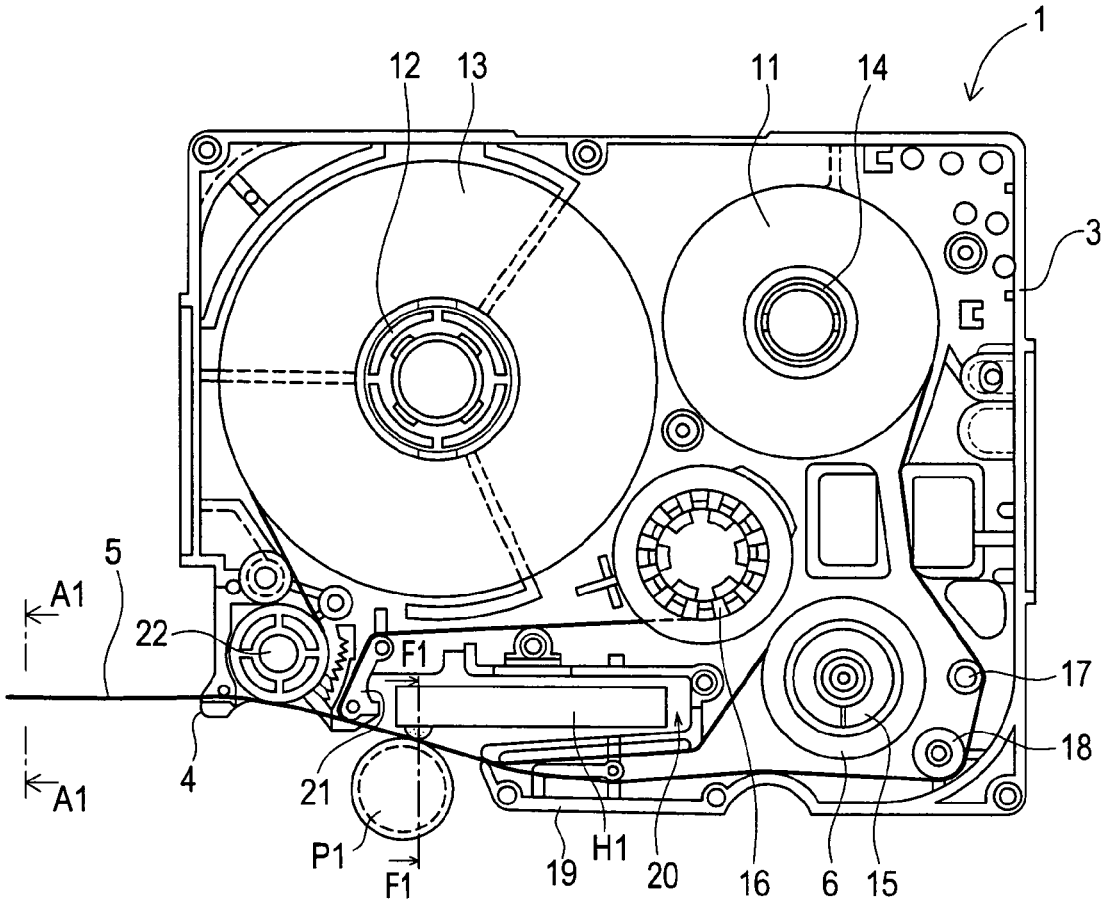
FIG. 3A is a plan view of the print cassette of thermal transfer type according to the first embodiment from which an upper cassette case is removed.

FIG. 3A is a plan view of the print cassette 1 from which the upper cassette case 2 (see FIG. 2) is removed. As shown in FIG. 3A, a tape spool 12 on which a second tape 13 is wound, a film spool 14 on which a first tape 11 is wound, a ribbon supply spool 15 on which the ink ribbon 6 is wound, and a ribbon take-up spool 16 are provided on the lower cassette case 3 of the print cassette 1, being rotatable with cooperation of respective spool support members (not shown) formed on the upper cassette case 2 (see FIG. 2).

In the first tape 11, a first base material (a handling auxiliary film) composed of a polyethylene terephthalate (hereinafter, referred to as "PET sheet") having a sheet thickness of approximately 70 μm and a to-be-printed medium (a thin laminated film) composed of an urethane sheet having a sheet thickness of approximately 10 μm are stacked and further, a first adhesive layer (a weak adhesive layer) is formed between the first base material and the to-be-printed medium by being coated with a first adhesive agent (a weak adhesive agent) in a thickness of approximately 25 μm. Then, the first tape 11 is wound on the film spool 14 with the to-be-printed medium side inside. In the first tape 11 wound in this way, an inside surface (the first face side of the to-be-printed medium) wound on the film spool 14 will be a printing surface. Therefore, the first tape 11 wound on the film spool 14 is guided to an arm part 19 formed on the lower cassette case 3; via a guide pin 17 provided on the lower cassette case 3 in an upright position and a rotatable guide roller 18. The first tape 11 is further guided out of the arm part 19, being exposed outside a thermal head attachment space 20. After that, the first tape 11 is discharged from the tape cassette 1 through the tape discharging port 4, via a guide member 21 and a feed roller 22.

The ink ribbon 6 is wound on the ribbon supply spool 15 with an ink-coated surface side inside. The ink ribbon 6 wound on the ribbon supply spool 15 in this way is exposed out of the arm part 19 outside the thermal head attachment space 20. The ink ribbon 6 is further guided while the ink-coated surface and the first face (side) of the to-be-printed medium are overlapped with each other. After that, the ink ribbon 6 is guided along an exterior of the guide member 21, thereby getting separated from the printing surface of the first tape 11. Finally, the ink ribbon 6 is taken up by the ribbon take-up spool 16.

Incidentally, when the print cassette 1 of the first embodiment is set in a cassette mount of a tape printer, a thermal head H1 of the tape printer exists on the thermal head arrangement portion 20. Then, the first tape 11 and the ink ribbon 6 are nipped by the thermal head H1 and a platen roller P1 of the tape printer opposing the head H1.

On the other hand, the second tape 13 has a second adhesive layer which is formed by being coated a second base material (a release sheet) having a sheet thickness of approximately 53 μm with a second adhesive agent of approximately 16 μm thick. Then, the second tape 13 is wound on the tape spool 12 with the second base material side outside. The second tape 13 wound in this way is guided by the feed roller 22 while the adhesive-coated surface of the second adhesive layer and the printing surface of the first tape 11 are overlapped with each other. As a result, the second tape 13 adheres to the first tape 11, and discharged outside the print cassette 1 through the tape discharging port 4.

Figure 4:
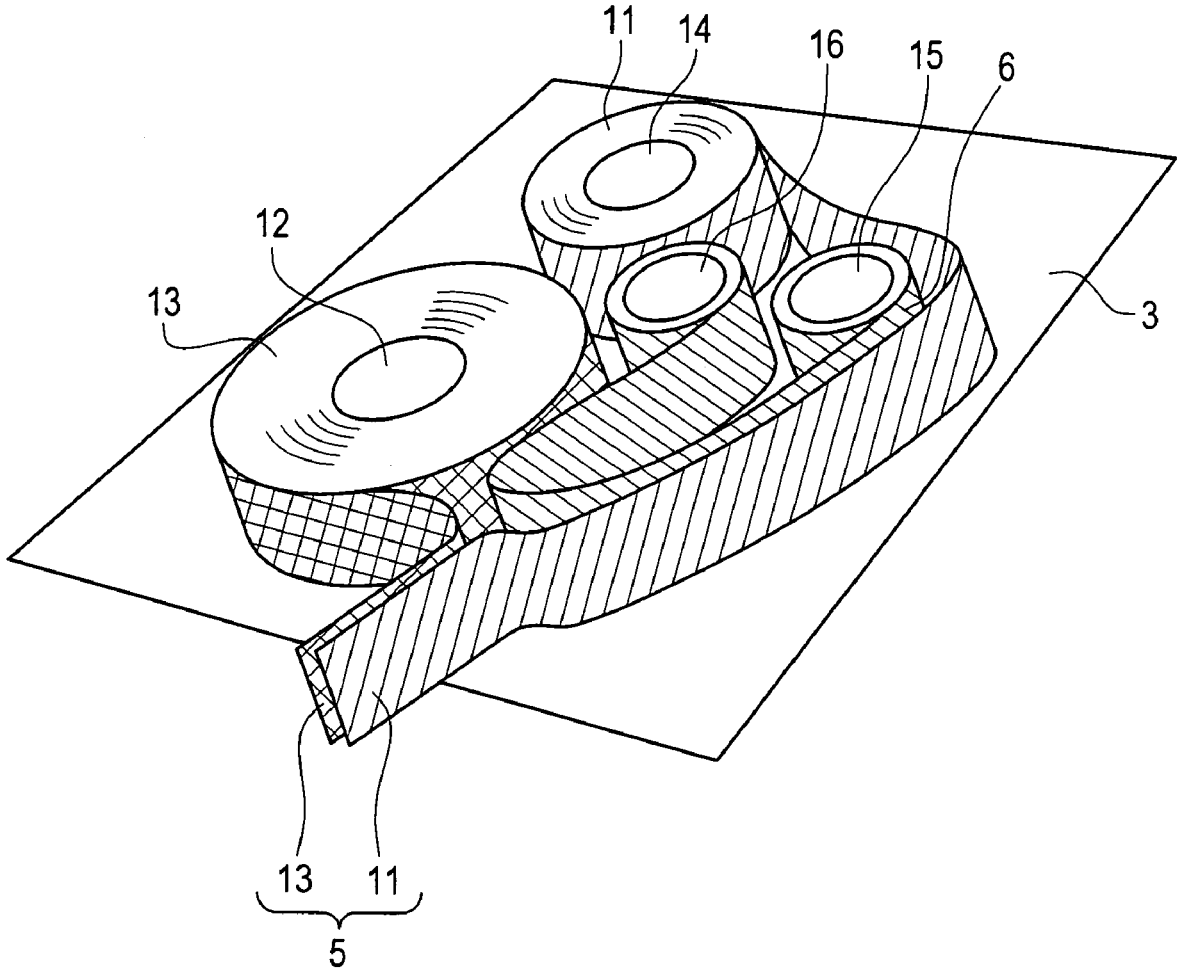
FIG. 4 is a schematic view illustrating a process of a first tape of thermal transfer type, a second tape and an ink ribbon being guided on a lower cassette case according to the first embodiment.

Accordingly, the print tape 5, which is composed of the first tape 11 and the second tape 13, is discharged from the tape discharging port 4 of the print cassette 1. FIG. 4 is a schematic view showing a process of the first tape 11, the second tape 13 and the ink ribbon 6 being guided on the lower cassette case 3 as described above.

Figure 1:
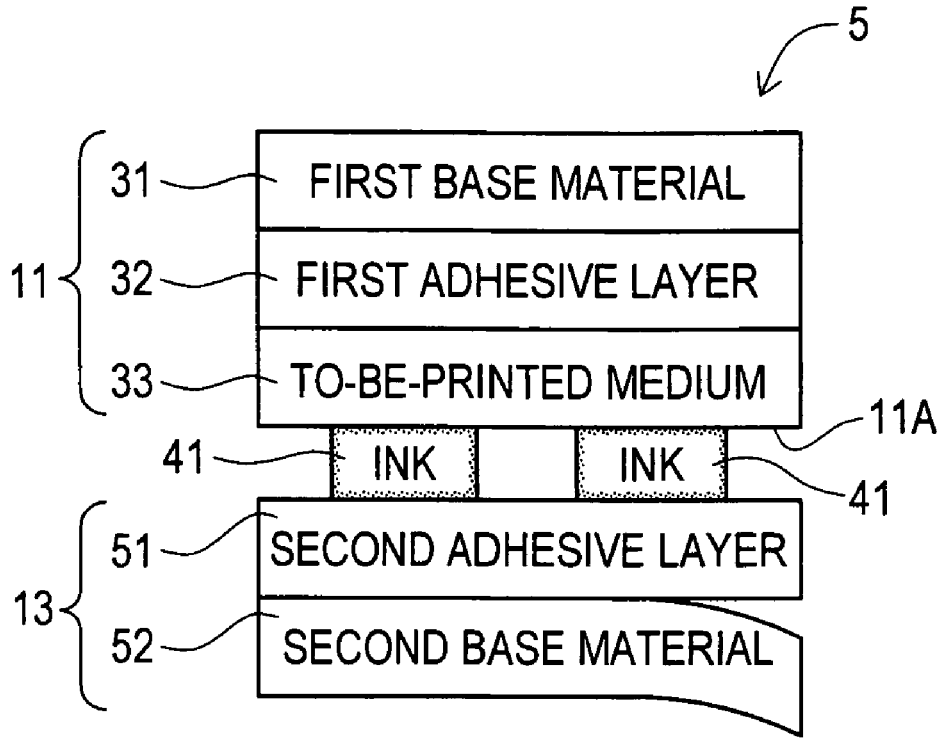
FIG. 1 is a cross-sectional view of a print tape of thermal transfer type according to a first embodiment taken along a line A1-A1 illustrated in FIG. 3A.

FIG. 1 is a cross-sectional view of the print tape 5 taken along the line A1-A1 shown in FIG. 3A. As shown in FIG. 1, the print tape 5 is composed of the first tape 11 and the second tape 13. In the first tape 11, as described above, a first base material 31 composed of a "PET sheet" having a sheet thickness of approximately 70 μm and a to-be-printed medium 33 composed of an urethane sheet having a sheet thickness of approximately 10 μm are stacked and further, a first adhesive layer 32 is formed between the first base material 31 and the second face (side) of the to-be-printed medium 33 by being coated with a first adhesive agent in a thickness of approximately 25 μm. As described above, the second tape 13 has a second adhesive layer 51 which is formed by being coated a second base material (a release sheet) 52 having a sheet thickness of approximately 53 μm with a second adhesive agent of approximately 16 μm thick. A printing surface 11A of the first tape 11 on which ink 41 is put and the second adhesive layer 51 are overlapped with each other, so that the second tape 13 adheres to the first tape 11 to compose the print tape 5.

Further, the print tape 5, from which the second base material 52 is removed so that the adhesive-coated surface of the second adhesive layer 51 is exposed, can be stuck to an adherend. After that, the first base material 31 is slowly removed, and then, as shown in FIG. 5, the to-be-printed medium 33 can be stuck to an adherend 61 with the second adhesive layer 51 of the second tape 13, along with the ink 41 which is thermally transferred to the printing surface 11A thereof.

Figure 5:
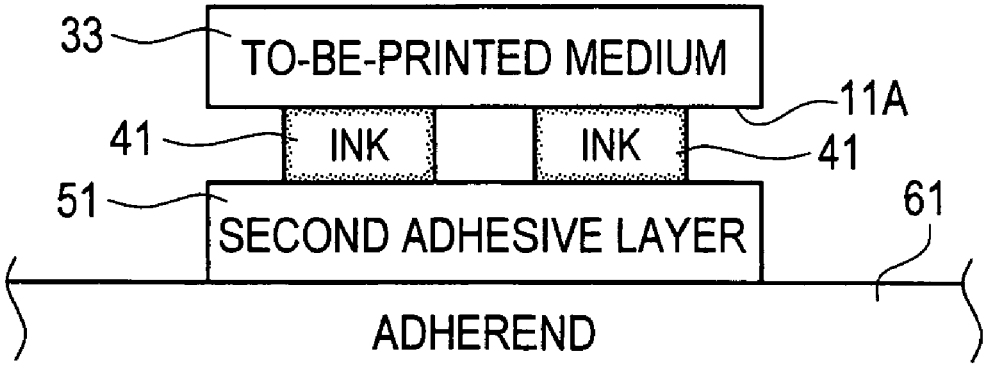
FIG. 5 is a cross-sectional view of the print tape of thermal transfer type according to the first embodiment being stuck to an adherend as a "laminated tape".

Although in FIGS. 1 and 5, the to-be-printed medium 33 and the second adhesive layer 51 appear to be in a floating state by the thickness of the ink 41, actually, the both adhered directly to each other because the thickness of the ink 41 is thin.

In order that the to-be-printed medium 33 on which the ink 41 is thermally transferred to the printing surface 11A adheres to the first base material 31 as described above, the first adhesive agent making up the first adhesive layer 32 includes a copolymer as a main material, made by the copolymerization of monomers of any series such as an acrylic series, a rubber series and a silicone series. The first adhesive agent can be made with or without various kinds of additives (such as a crosslinking agent, a tackifier, a softener, a fixture and a pigment). The first adhesive agent having a low adhesive property is adopted since this is used for temporary adhesion and a part which will be removed eventually.

On the other hand, the adhesive agent making up the second adhesive layer 51 include a copolymer as a main material, made by the copolymerization of monomers of any series such as an acrylic series, a rubber series and a silicone series. The adhesive agent can be made with or without various kinds of additives (such as a crosslinking agent, a tackifier, a softener, a fixture and a pigment). The adhesive agent having an adhesive property appropriate to the adherend 61 is adopted.

Incidentally, the print cassette 1 is set in a cassette mount of a tape printer to produce the print tape 5. In the cassette mount of the tape printer, there is provided a cutter device (not shown) having a cutter to cut the print tape 5 discharged from the tape discharging port 4 of the print cassette 1. The structure of the print cassette 1 as explained with reference to FIG. 2 and other figures and the tape printer in which the print cassette 1 is installed to produce the print tape 5 have been publicly known, so the detailed explanation of the process for producing the print tape 5 with the print cassette 1 and the tape printer is omitted.

Next, the way of using the print tape 5 will be explained with reference to FIGS. 6A to 6E.

Figure 6A:
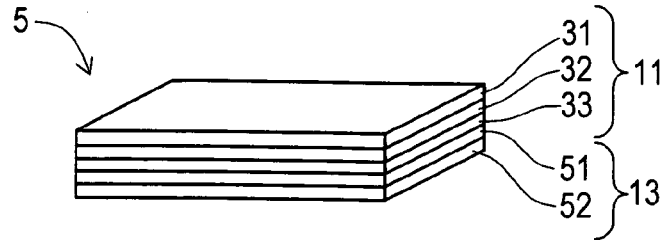
FIG. 6A is an explanatory diagram illustrating the way of using the print tape according to the first embodiment.
Figure 6B:
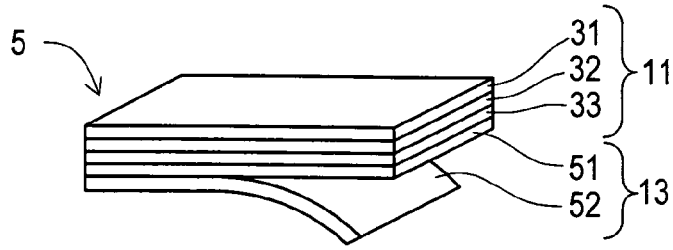
FIG. 6B is an explanatory diagram illustrating the way of using the print tape according to the first embodiment.
Figure 6C:
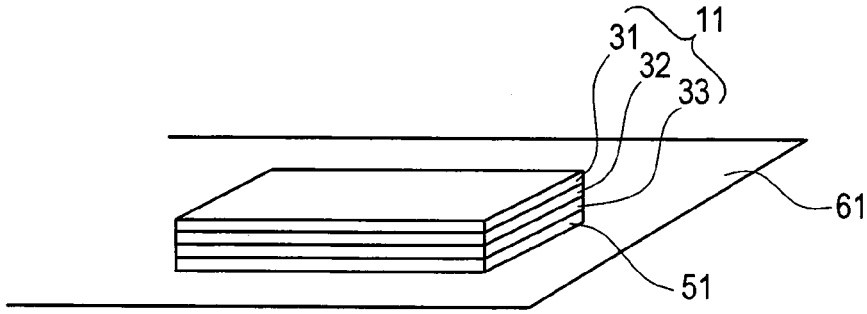
FIG. 6C is an explanatory diagram illustrating the way of using the print tape according to the first embodiment.

The print tape 5 is discharged from the tape discharging port 4 of the print cassette 1 of the first embodiment, the print cassette 1 being set in a cassette mount of a tape printer. The print tape 5 is cut with the cutter device of the tape printer to be a strip-formed tape composed of the first tape 1 (the first base material 31, the first adhesive layer 32 and the to-be-printed medium 33) and the second tape 13 (the second adhesive layer 51 and the second base material 52) as shown in FIG. 6A. As shown in FIG. 6B, the second base material 52 of the second tape 13 is removed, so that the second adhesive layer 51 of the second tape 13 is exposed. Further, the second adhesive layer 51 of the second tape 13 is stuck to the adherend 61 as shown in FIG. 6C.

Figure 6D:
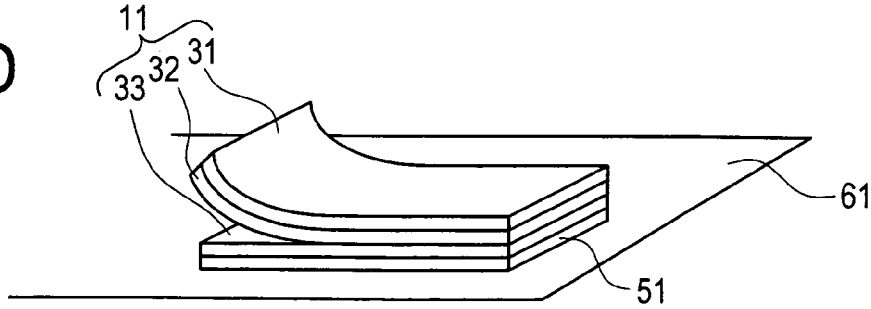
FIG. 6D is an explanatory diagram illustrating the way of using the print tape according to the first embodiment.
Figure 6E:
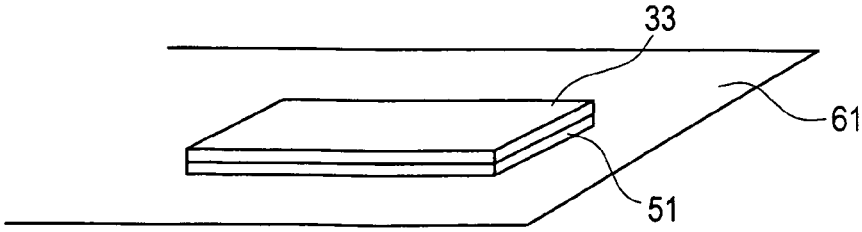
FIG. 6E is an explanatory diagram illustrating the way of using the print tape according to the first embodiment.

As shown in FIG. 6D, the first base material 31 is slowly removed from the adherend 61. At this time, the first adhesive layer 32 is also removed with the first base material 31, thus only the to-be-printed medium 33 can be left there. Finally, as shown in FIG. 6E, the to-be-printed medium 33 on which the ink 41 is thermally transferred is in a state of adhering to the adherend 61 with the second adhesive layer 51 of the second tape 13. The ink 41 has been thermally transferred from the ink ribbon 6 (see FIG. 3A and other figures) to the printing surface 11A (of the to-be-printed medium 33) of the first tape 11 (see FIG. 2 and other figures) with the tape printer.

As described in detail above, the print cassette 1 of the first embodiment is set in a cassette mount of a tape printer to produce the print tape 5 which is discharged from the tape printer.

The print tape 5 discharged from the tape printer is cut by the cutter device of the tape printer, and then the second base material 52 is removed from the second tape 13 adhered to the first tape 11 (see FIG. 6B). The exposed second adhesive layer 51 of the second tape 13 is stuck to the adherend 61 (see FIG. 6C). Further, the first base material 31 is slowly removed from the adherend 61 (see FIG. 6D), so that the first adhesive layer 32 is removed with the first base material 31 and the to-be-printed medium 33 is left on the adherend 61 with the ink 41. As shown in FIG. 5, the to-be-printed medium 33 having the printing surface 11A on the back side thereof is stuck to the adherend 61 with the second adhesive layer 51 of the second tape 13. As a result, a "laminated tape" can be stuck to the adherend 61 (see FIG. 6E).

The to-be-printed medium 33 adhered to the first base material 31 with the first adhesive layer 32 to take the form of the first tape 11 (see FIG. 1) which is wound on the film spool 14 within the print cassette 1 of the first embodiment as shown in FIG. 3A. From this state, the to-be-printed medium 33 of the first tape 11 adheres to the second tape 13 with the second adhesive layer 51 thereof to be the print tape 5, which is discharged through the tape discharging port 4. Thus, the to-be-printed medium 33 can assure the feeding performance within the print cassette 1 of the first embodiment even though the to-be-printed medium 33 is thin.

Particularly, in the first embodiment, because the first base material 31 is thicker than the to-be-printed medium 33, the feeding performance of the first tape 11 within the print cassette 1 of the first embodiment can be secured even however thin the to-be-printed medium 33 is.

As shown in FIGS. 6A and 6B, the second tape 13 is in a state of adhering to the first tape 11 when stuck to the adherend 61. The second tape 13 can thus keep the rigidity at least by the thickness of the first tape 11. Accordingly, however thin the to-be-printed medium 33 composing the "laminated tape" is, the "laminated tape" can easily be stuck to the adherend 61 as shown in FIG. 6.

Particularly, in the first embodiment, the first base material 31 is thicker than the to-be-printed medium 33. Accordingly, however thin the to-be-printed medium 33 is, the first base material 31 can easily be removed.

The first adhesive layer 32 which adheres the first base material 31 to the to-be-printed medium 33 is formed by being coated with the first adhesive agent between the first base material 31 and the to-be-printed medium 33 in a thickness of approximately 25 μm. At this point, although the first adhesive agent may be filled to an entire range between the first base material 31 and the to-be-printed medium 33, the first adhesive agent may be coated in a predetermined pattern so that the first adhesive agent is dispersed uniformly.

Figure 18A:
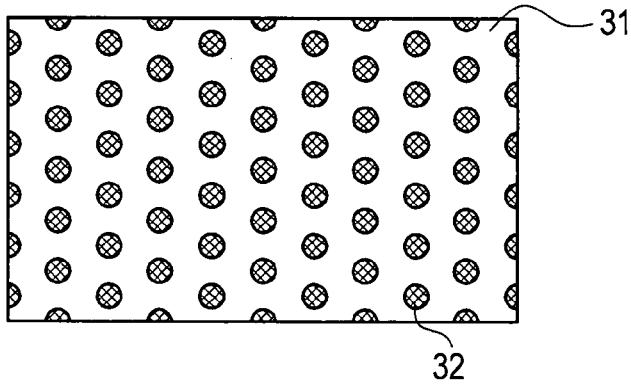
FIG. 18A is an exemplary diagram illustrating a coating pattern of a first adhesive agent forming a first adhesive layer according to the first embodiment.
Figure 18B:
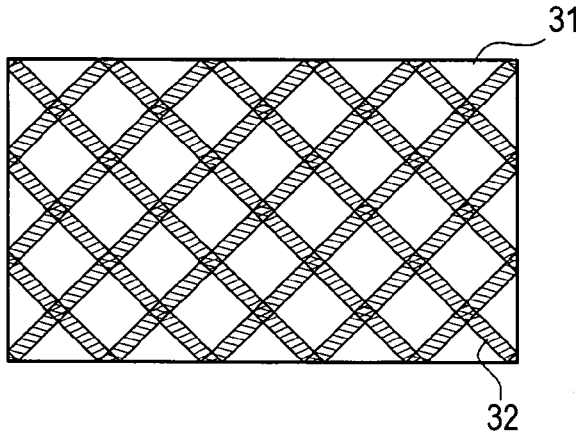
FIG. 18B is an exemplary diagram illustrating a coating pattern of the first adhesive agent forming the first adhesive layer according to the first embodiment.
Figure 18C:
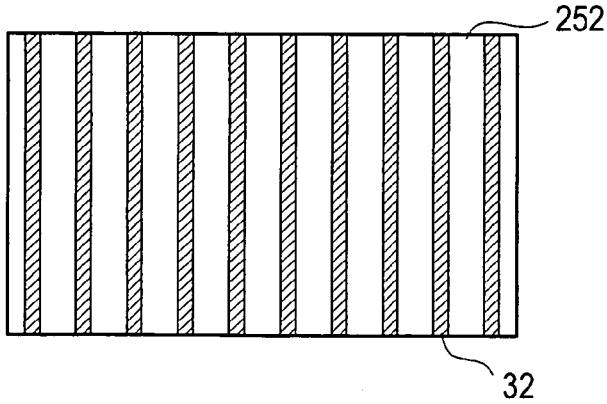
FIG. 18C is an exemplary diagram illustrating a coating pattern of the first adhesive agent forming the first adhesive layer according to the first embodiment.
Figure 18D:
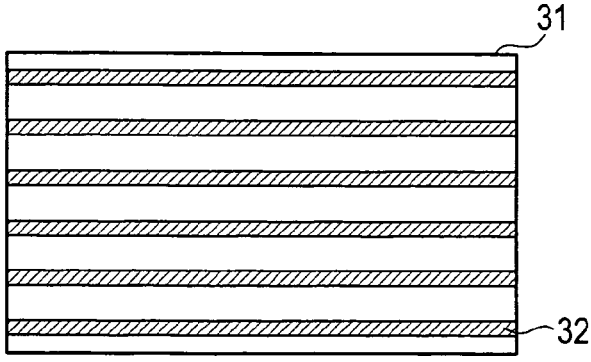
FIG. 18D is an exemplary diagram illustrating a coating pattern of the first adhesive agent forming the first adhesive layer according to the first embodiment.

FIGS. 18A to 18D are views showing examples of coating patterns of the first adhesive agent to be coated for forming the first adhesive layer 32. FIG. 18A shows an example that the first adhesive layer 32 is formed in polka-dot pattern by being coated with the dot-like first adhesive agent to the first base material 31 intermittently (cyclically). FIG. 18B shows an example that the linear first adhesive agent is coated to the first base material 31 intermittently (cyclically) at an inclined angle so as to form the first adhesive layer 32 into a grid pattern. FIG. 18C shows an example that the linear first adhesive agent is coated to the first base material 31 intermittently (cyclically) in the width direction so as to form the first adhesive layer 32 in a striped pattern. FIG. 18D shows an example that the linear first adhesive agent is coated to the first base material 31 intermittently (cyclically) in the longitudinal direction so as to form the first adhesive layer 32 into a striped pattern.

In other words, with regard to the print tape 5 which is produced in a tape printer by using the print cassette 1 of the first embodiment, as described above, the to-be-printed medium 33 adhered to the first base material 31 with the first adhesive layer 32. The print tape 5 can thus keep the rigidity at least by the thickness of the first base material 31. Accordingly, the feeding performance within the print cassette 1 of the first embodiment can be secured. At this point, if the first adhesive agent which forms the first adhesive layer 32 is dispersed uniformly in a predetermined pattern as shown in FIGS. 18A, 18B, 18C and 18D, as compared with a case where the first adhesive agent is coated to the entire surface, the first adhesive agent which is to form the first adhesive layer 32 is not pushed out from between the to-be-printed medium 33 and the first base material 31 easily. Thus, the feeding performance of the to-be-printed medium 33 within the print cassette 1 of the first embodiment is stabilized further.

As described above, when the print tape 5 (that is, the to-be-printed medium 33) is stuck to the adherend 61, the first base material 31 adhered to the to-be-printed medium 33 with the first adhesive layer 32 so that the to-be-printed medium 33 can thus keep the rigidity at least by the thickness of the first base material 31. Accordingly, however thin the to-be-printed medium 33 is, the to-be-printed medium 33 can easily be stuck to the adherend 61 (see FIGS. 6A, 6B and 6C). At this point, if the first adhesive agent which forms the first adhesive layer 32 is dispersed uniformly in a predetermined pattern as shown in FIGS. 18A, 18B, 18C and 18D, it is easy to create a clue for releasing the first base material 31 from the to-be-printed medium 33 even if the to-be-printed medium 33 is kept stuck to the adherend 61 together with the first base material 31. After that, the first base material 31 can be removed from the to-be-printed medium 33 easily (see FIG. 6D).

Further, when the to-be-printed medium 33 is stuck to the adherend 61 with the second adhesive layer 51 of the second tape 13, the total thickness of the to-be-printed medium 33 and the second tape 13 is as thin as approximately 30 μm. Therefore, the outline of the to-be-printed medium 33 is hardly visible if the to-be-printed medium 33 is transparent and colorless, so that the ink 41 (printed contents) on the to-be-printed medium 33 can be prominent. Additionally, the total weight of the to-be-printed medium 33 and the second tape 13 is so light as to reduce adverse effect on rotational balance of the adherend 61 as a body of rotation such as a CD and a DVD.

Further, when stuck to the curved surface of the adherend 61, the to-be-printed medium 33 is as thin as 10 μm, thus the to-be-printed medium 33 can be prevented from being gradually unstuck. This effect can be achieved even if the thickness of the to-be-printed medium 33 is as large as 30 μm.

As shown in FIG. 5, the printing surface 11A on which the ink 41 is thermally transferred exists on the back side of the to-be-printed medium 33, that is, the printing surface 11A is laminated by the to-be-printed medium 33, thereby presenting abrasion resistance which is a feature of the "laminated tape".

The disclosure may be embodied in other specific forms without departing from the essential characteristics thereof.

Figure 7:
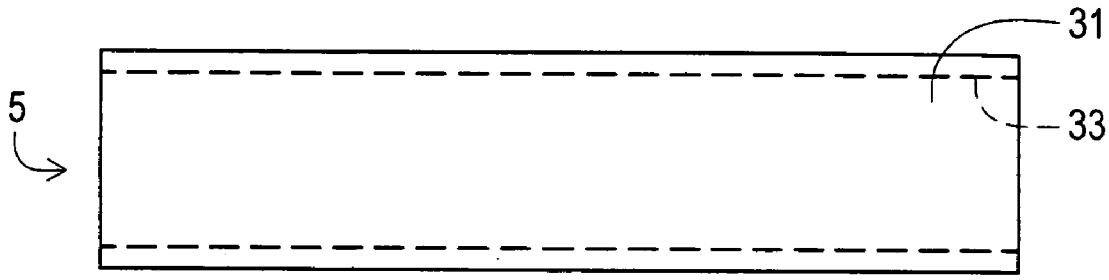
FIG. 7 is a plan view illustrating another print tape according to the first embodiment.
Figure 8:
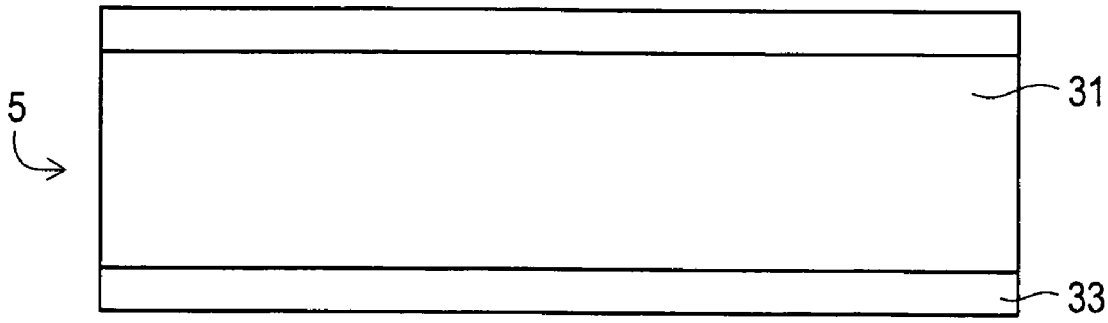
FIG. 8 is a plan view illustrating another print tape according to the first embodiment.

For instance, with regard to the print tape 5 which is produced in a tape printer by using the print cassette 1 of the first embodiment, for instance, the first base material 31 may have a width wider than that of the to-be-printed medium 33 as shown in a plan view of FIG. 7. Conversely, the first base material 31 may have a width narrower than that of the to-be-printed medium 33, as shown in a plan view of FIG. 8. In both cases, the first base material 31 and the to-be-printed medium 33 are different in width, which makes it easy to distinguish the first base material 31 and to unstuck the first base material 31.

This is the same if the width of the second base material 52 of the second tape 13 is wider (not shown).

Figure 9:
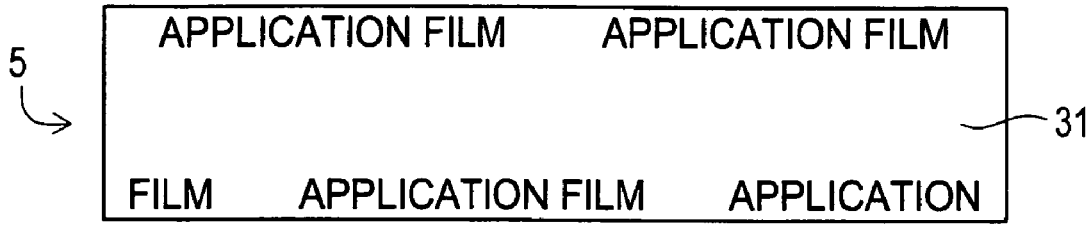
FIG. 9 is a plan view illustrating another print tape according to the first embodiment.

Even in the print tape 15 having the first base material 31 as wide as the first base material 31, as shown in a plan view of FIG. 9, the presence of the first base material 31 can be emphasized with prints such as characters and patterns (in FIG. 9, for example, characters of "APPLICATION FILM") representing the first base material 31 preliminarily printed on the first base material 31 itself, thereby facilitating the work to unstick the first base material 31. In addition, if the top and bottom of the print tape 5 can be distinguished by the characters and patterns preliminarily printed on the first base material 31, the print tape 5 is allowed to be stuck readily to the adherend 61 (see FIG. 6 and other figures).

Figure 12:
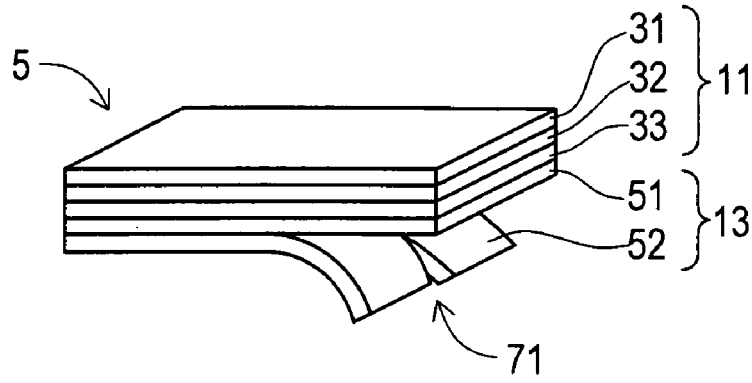
FIG. 12 is a perspective view illustrating another print tape according to the first embodiment.

Further, as shown in a perspective view of FIG. 12, the second base material 52 of the second tape 13 comprising the print tape 5 may preliminarily be provided with a half cut 71. This configuration can facilitate the work to remove the second base material 52 of the second tape 13. Similarly, as shown in a perspective view of FIG. 13, the first base material 31 may preliminarily be provided with a half cut 81 in advance, which allows the first base material 31 to be unstuck easily.

Figure 14A:
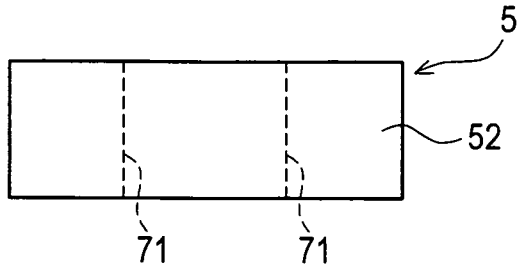
FIG. 14A is a plan view illustrating another print tape according to the first embodiment.
Figure 14B:
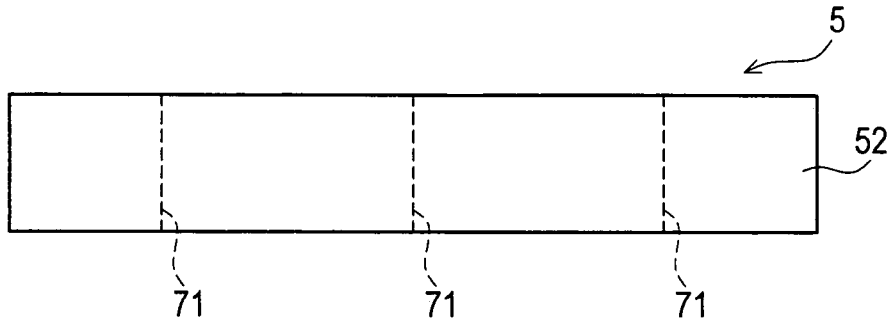
FIG. 14B is a plan view illustrating another print tape according to the first embodiment.
Figure 14C:
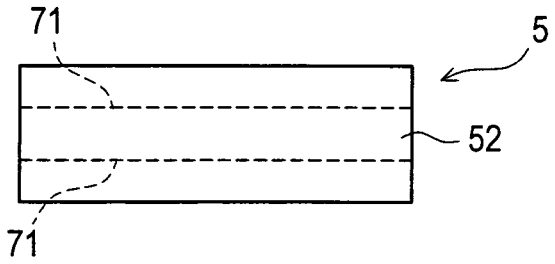
FIG. 14C is a plan view illustrating another print tape according to the first embodiment.
Figure 14D:
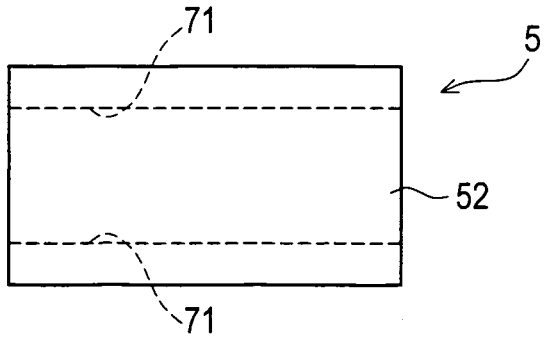
FIG. 14D is a plan view illustrating another print tape according to the first embodiment.
Figure 15A:
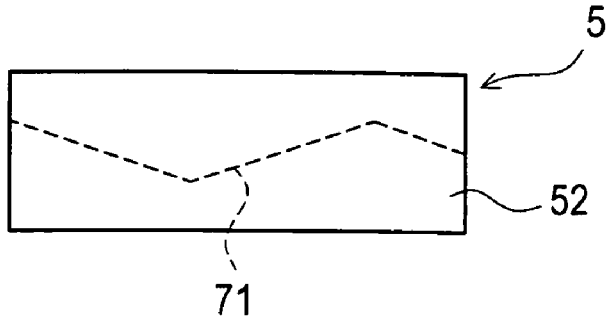
FIG. 15A is a plan view illustrating another print tape according to the first embodiment.
Figure 15B:
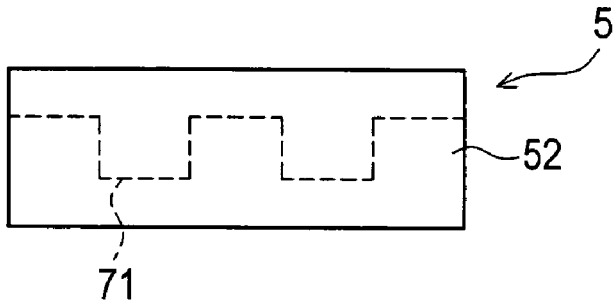
FIG. 15B is a plan view illustrating another print tape according to the first embodiment.
Figure 15C:
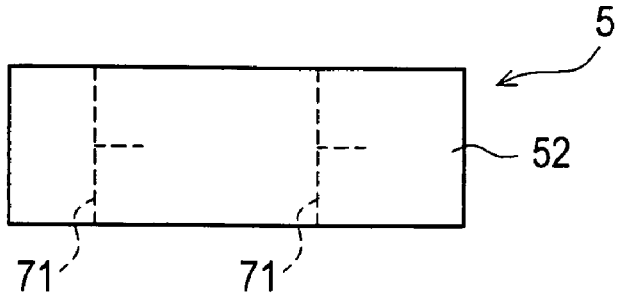
FIG. 15C is a plan view illustrating another print tape according to the first embodiment.
Figure 16A:
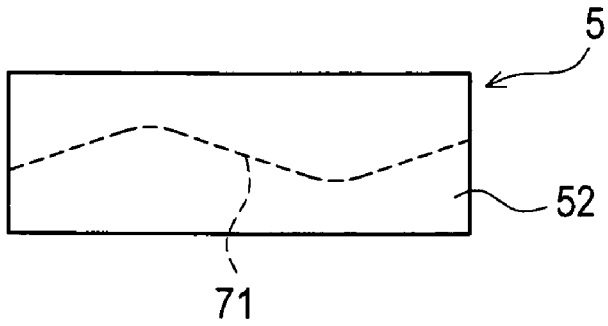
FIG. 16A is a plan view illustrating another print tape according to the first embodiment.
Figure 16B:
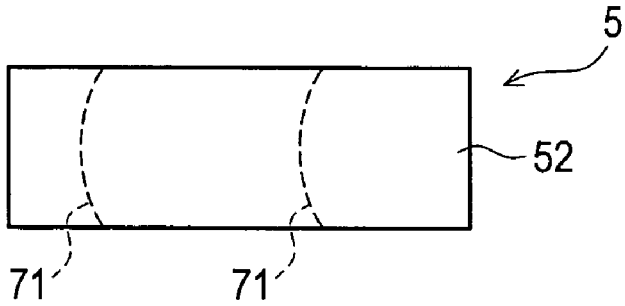
FIG. 16B is a plan view illustrating another print tape according to the first embodiment.
Figure 16C:
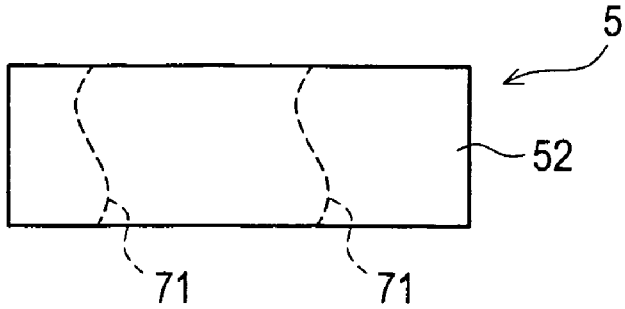
FIG. 16C is a plan view illustrating another print tape according to the first embodiment.
Figure 17A:
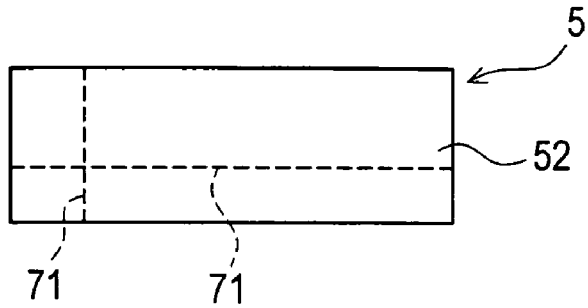
FIG. 17A is a plan view illustrating another print tape according to the first embodiment.
Figure 17B:
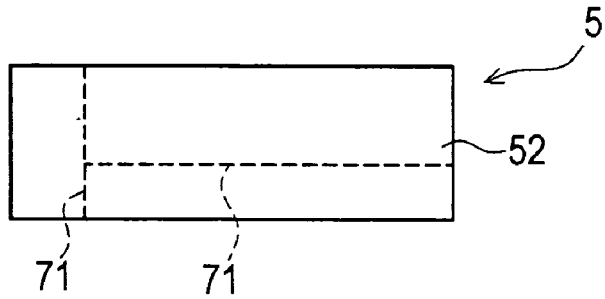
FIG. 17B is a plan view illustrating another print tape according to the first embodiment.
Figure 17C:
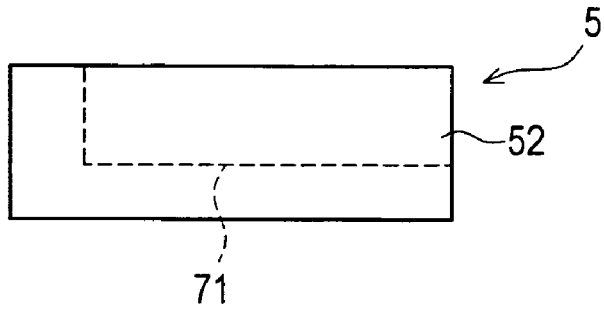
FIG. 17C is a plan view illustrating another print tape according to the first embodiment.

FIGS. 14A to 17C show various configurations of half cuts 71 implemented in the second base material 52 preliminarily. FIGS. 14A and 14B show an example that a plurality of half cuts 71 are implemented in the width direction of the second base material 52, and FIGS. 14C and 14D show an example that a plurality of half cuts 71 are implemented in the longitudinal direction of the second base material 52. FIGS. 15A, 15B, and 15C show an example that a linear half cut 71 is implemented in the second base material 52. FIGS. 16A, 16B, and 16C show an example that a curved half cut 71 is implemented in the second base material 52. FIGS. 17A, 17B, and 17C show an example that the half cuts 71 in the width direction and in the longitudinal direction are implemented by combination in the second base material 52.

In other words, in the print tape 5, which is produced in a tape printer by using the print cassette 1 of the first embodiment, as described above, the second base material 52 adhered to the to-be-printed medium 33 with the second adhesive layer 51 (see FIG. 6A). Then, when part of the second base material 52 is removed from the to-be-printed medium 33 along the half cut 71 in order to stick the to-be-printed medium 33 to the adherend 61 (see FIGS. 6B and 12), part of the second adhesive layer 51 is exposed, so that part of the to-be-printed medium 33 can be stuck to the adherend 61 with the part of the second adhesive layer 51 (see FIGS. 6C and 12).

At this time, the left portion of the second base material 52 still adhered to the to-be-printed medium 33, so that the to-be-printed medium 33 can thus keep the rigidity by the stiffness of the left portion of the second base material 52. Consequently, however thin the to-be-printed medium 33 is, the work of sticking part of the to-be-printed medium 33 to the adherend 61 securely without generation of wrinkles can be carried out. After that, because the left portion of the second adhesive layer 51 is exposed when the left portion of the second base material 52 is removed from the to-be-printed medium 33, the left portion of the to-be-printed medium 33 can be stuck to the adherend 61 with the left portion of the second adhesive layer 51. At this time, the to-be-printed medium 33 can thus keep the tension by part of the to-be-printed medium 33 stuck to the adherend 61. Consequently, however thin the to-be-printed medium 33 is, the work of sticking the left portion of the to-be-printed medium 33 to the adherend 61 securely without generation of wrinkles can be carried out.

In other words, by repeatedly releasing part of the second base material 52 from the to-be-printed medium 33 along the half cut 71, the to-be-printed medium 33 can be stuck to the adherend 61 step by step. This facilitates the work of securely sticking the to-be-printed medium 33 to the adherend 61 without generation of wrinkles.

Further, the first base material 31 adhered to the to-be-printed medium 33 (see FIGS. 6B and 12), so that the to-be-printed medium 33 can thus keep the rigidity by the stiffness of the first base material 31. Consequently, however thin the to-be-printed medium 33 is, the work of sticking the to-be-printed medium 33 to the adherend 61 securely without generation of wrinkles can be carried out.

Figure 13:
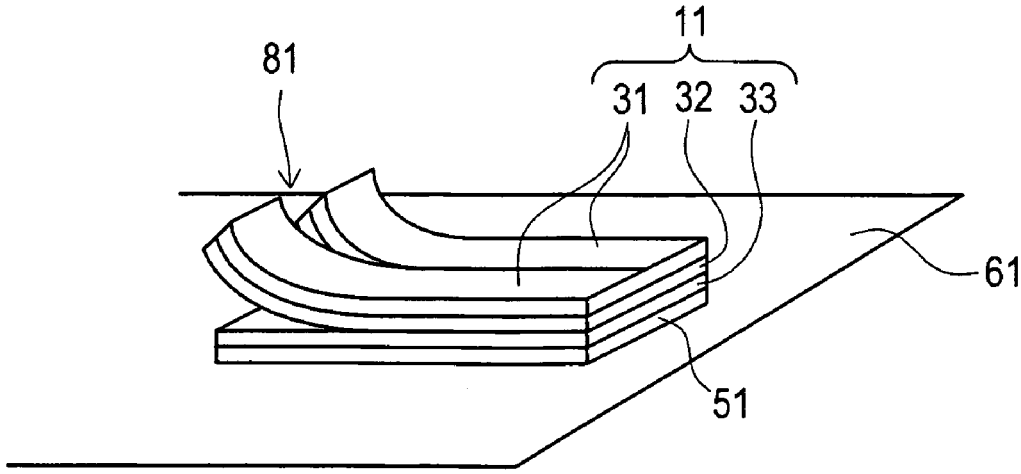
FIG. 13 is a perspective view illustrating another print tape according to the first embodiment.

After that, the first base material 31 can be removed easily from the to-be-printed medium 33 by the half cut 81 (see FIG. 13).

The various configurations of the half cuts 71 implemented in the second base material 52 preliminarily shown in FIGS. 14 to 17 may be adopted as configurations of the half cuts 81 to be implemented in the first base material 31 preliminarily.

In the print tape 5, which is produced in a tape printer by using the print cassette 1 of the first embodiment, the first base material 31 may be a transparent and colorless tape or a colored and transparent tape. In the case of the transparent and colorless first base material 31, this allows the ink 41 thermally transferred to the printing surface 11A (see FIG. 1 and other figures) of the first tape 11 to be visually identified therethrough, so that the top and bottom of the print tape 5 can be distinguished easily, thereby facilitating the work to stick the print tape 5 to the adherend 61. On the other hand, the colored and transparent first base material 31 allows not only the ink 41 thermally transferred to the printing surface 11A (see FIG. 1 and other figures) of the first tape 11 but also the presence of the first base material 31 itself to be identified visually. This can facilitate the work to stick the print tape 5 to the adherend 61 and the work to unstick the first base material 31.

On the other hand, if the first base material 31 is opaque, the ink 41 thermally transferred to the printing surface 11A (of the to-be-printed medium 33) of the first tape 11 (see FIG. 1 and other figures) cannot be recognized visually.

In other words, in the print tape 5, which is produced in a tape printer by using the print cassette 1 of the first embodiment, as described above, the first base material 31 adhered to the to-be-printed medium 33 with the first adhesive layer 32. Thus, if the first base material 31 is opaque, as described above, the ink 41 thermally transferred to the printing surface 11A (of the to-be-printed medium 33) of the first tape 11 (see FIG. 1 and other figures) cannot be recognized visually, the first base material 31 has the hiding performance. Accordingly, the to-be-printed medium 33 cannot be recognized visually via the first base material 31, so that the ink 41 (the printing content) of the to-be-printed medium 33 can be hidden. Consequently, the security effect to the printing content of the to-be-printed medium 33 is exerted.

Figure 10:
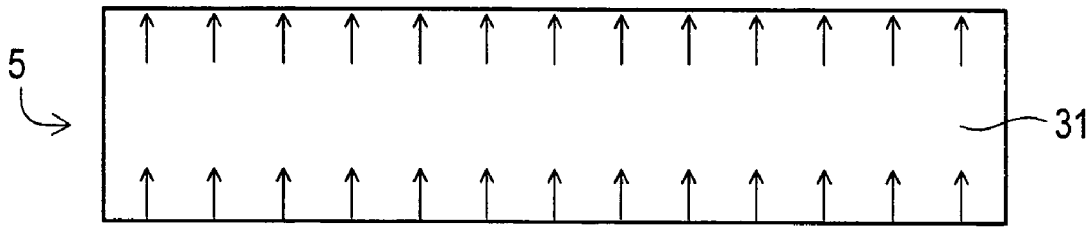
FIG. 10 is a plan view illustrating another print tape according to the first embodiment.
Figure 11:
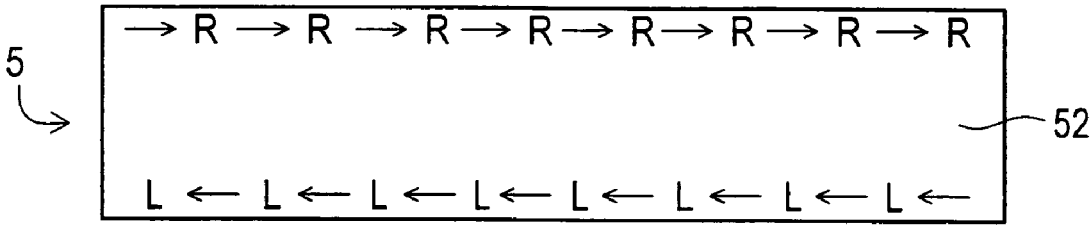
FIG. 11 is a plan view illustrating another print tape according to the first embodiment.

Unless the printing content of the to-be-printed medium 33 can be recognized visually, it is inconvenient when sticking the print tape 5 to the adherend 61. Thus, if a mark indicating the up-down direction or right-left direction of the printing surface 11A (of the to-be-printed medium 33) of the first tape 11 (see FIG. 1 and other figures) is provided on the first base material 31 or the second base material 52 preliminarily, it is convenient. FIG. 10 is a drawing showing an example that the mark (arrows) indicating the up-down direction of the printing surface 11A (of the to-be-printed medium 33) of the first tape 11 (see FIG. 1 and other figures) is provided on the first base material 31 preliminarily. Although the direction of this arrow indicates upward, it may indicate downward. Further, this arrow may be provided on the second base material 52. FIG. 11 is a drawing showing an example that the mark ("→R", "L←") indicating the right-left direction of the printing surface 11A (of the to-be-printed medium 33) of the first tape 11 (see FIG. 1 and other figures) is provided on the second base material 52 preliminarily. The direction of the mark "→R" indicates rightward. The direction of the mark "L←" indicates leftward. Further, these marks may be provided on the first base material 31 preliminarily.

The mark indicating the up-down direction or the right-left direction of the printing surface 11A (of the to-be-printed medium 33) of the first tape 11 (see FIG. 1 and other figures) is provided on the first base material 31 or the second base material 52 preliminarily. Thus, even if the to-be-printed medium 33 (the printing content) cannot be recognized visually, the up-down direction or the right-left direction of the to-be-printed medium 33 is never mistaken as long as this mark is used as a clue, so that the print tape 5 (to-be-printed medium 33) can be stuck to the adherend 61.

Figure 3B:
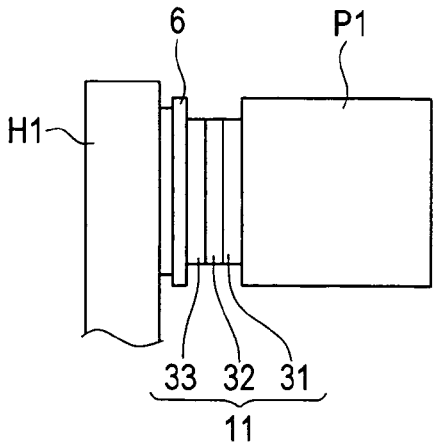
FIG. 3B is a cross-sectional view of the print cassette of thermal transfer type according to the first embodiment, from which the upper cassette case is removed, taken along a line F1-F1.

When the print cassette 1 of the first embodiment is set in a cassette mounting portion of a tape printer, the printing surface 11A (of the to-be-printed medium 33) of the first tape 11 (see FIG. 1 and other figures) is printed by the thermal head H1 of the tape printer designed to exist in the thermal head arrangement portion 20 and the platen P1 opposing the thermal head H1 as shown in FIG. 3A. At this time, the printing surface 11A (of the to-be-printed medium 33) of the first tape 11 (see FIG. 1 and other figures) opposes the thermal head H1 of the tape printer via the ink face of the ink ribbon 6 (see FIGS. 2 and 3A). FIG. 3B shows a view taken along the line F1-F1 of FIG. 3A in this state. As shown in FIG. 3B, the to-be-printed medium 33 of the first tape 11 is covered with the ink ribbon 6, so that the to-be-printed medium 33 is hidden from the thermal head H1 of the tape printer.

Further, the width of the ink ribbon 6 is wider than the width of the first tape 11. With this configuration, even if the ink ribbon 6 is shifted in its width direction at the time of printing, a state in which the to-be-printed medium 33 of the first tape 11 is hidden by the ink ribbon 6 from the thermal head H1 of the tape printer is maintained. Consequently, heat generated by the thermal head H1 of the tape printer at the time of printing is transmitted to the to-be-printed medium 33 of the first tape 11 via the ink ribbon 6, so that the heat is not transmitted directly to the to-be-printed medium 33 of the first tape 11. Thus, because print is made on the to-be-printed medium 33 of the first tape 11 in a state of being unsusceptible to bad influence of heat, print quality is excellent and print appearance is also excellent.

The print tape 5 produced by a tape printer using the print cassette 1 of the first embodiment is of thermal transfer type which is printed by the thermal head H1 of the tape printer and the ink ribbon 6. However, even a thermosensitive type which does not require the ink ribbon 6 can obtain the above-described various effects (except an effect of blocking a bad influence by heat at the time of print by the ink ribbon 6 easily). Hereinafter, a case in which a thermosensitive type print tape 5 is produced by a tape printer will be described by applying this to the print cassette 1 of the first embodiment in order to mainly indicate a difference from the thermal transfer type print tape 5.

Figure 20:
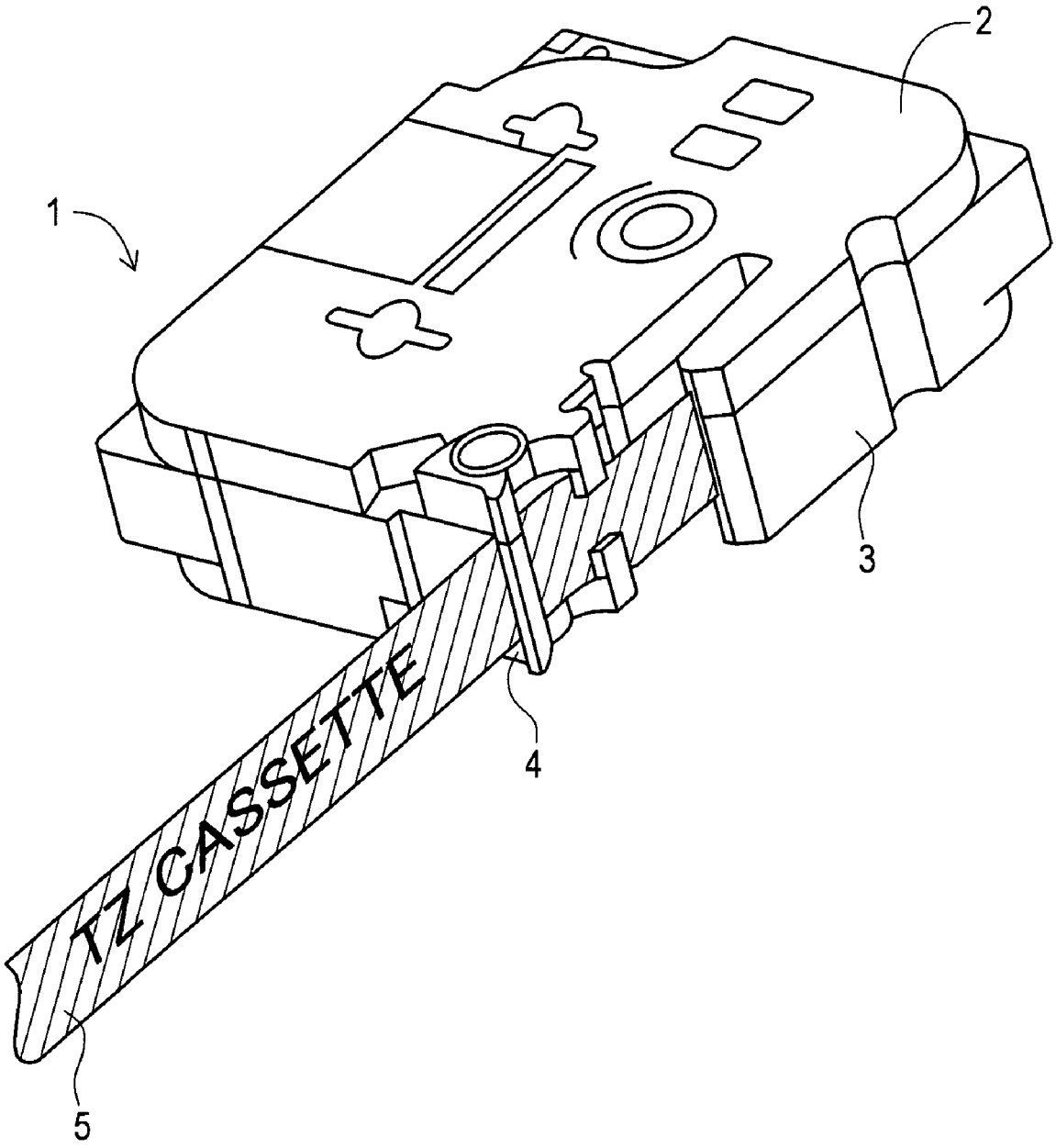
FIG. 20 is a perspective view of a print cassette of thermosensitive type-according to the first embodiment.

FIG. 20 is a perspective view of the print cassette. As shown in FIG. 20, the print cassette 1 of the first embodiment comprises an upper cassette case 2 and a lower cassette case 3. The print tape 5 is discharged from the tape discharge port 4. In the meantime, the ink ribbon 6 shown in FIG. 1 does not exist here.

Figure 21:
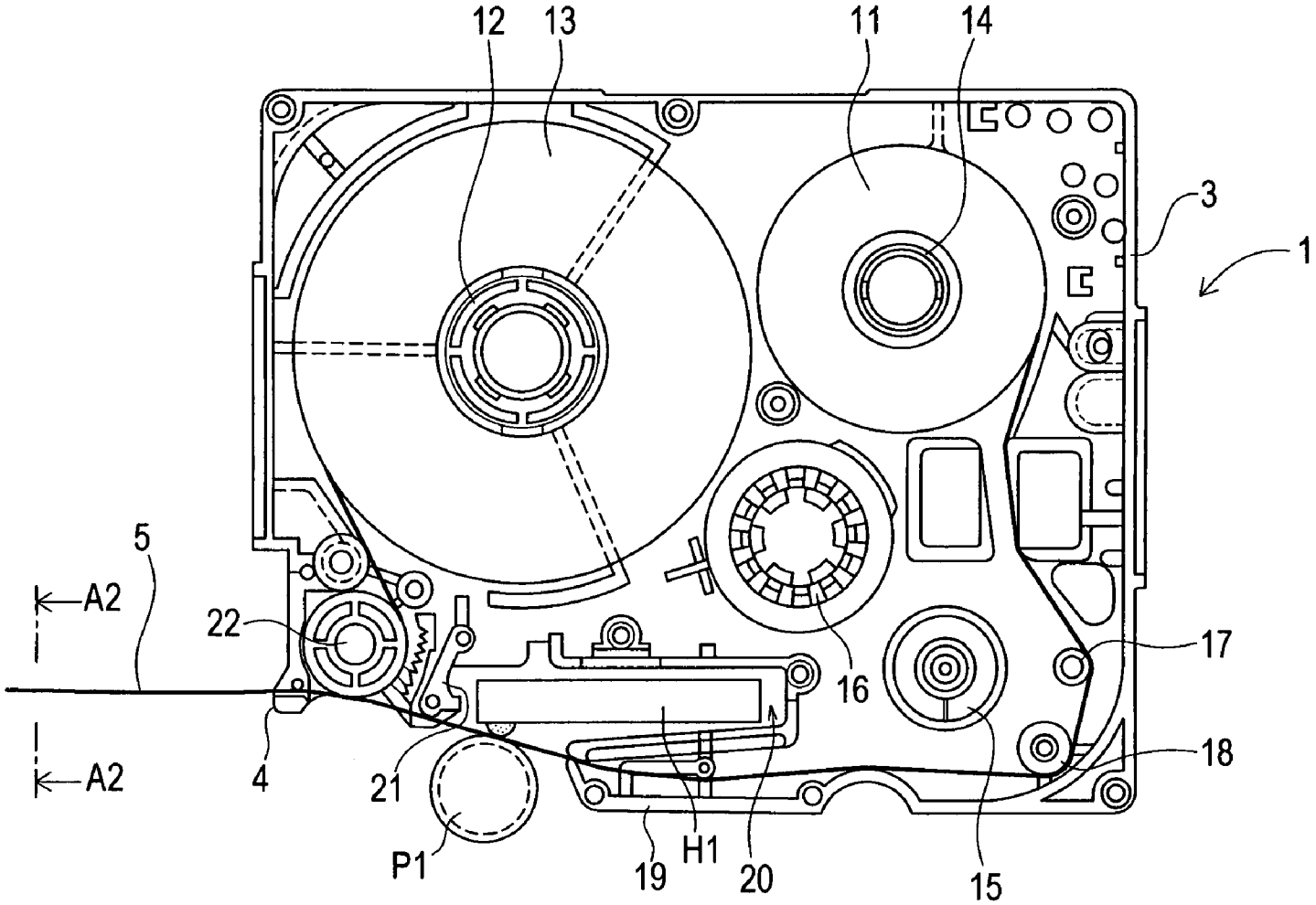
FIG. 21 is a plan view of the print cassette of thermosensitive type according to the first embodiment from which an upper cassette case is removed.

FIG. 21 is a plan view of the print cassette 1 from which the upper cassette case 2 (see FIG. 20) is removed. As shown in FIG. 21, a tape spool 12 on which a second tape 13 is wound, a film spool 14 on which a first tape 11 is wound, a ribbon supply spool 15 and a ribbon take-up spool 16 are provided on the lower cassette case 3 of the print cassette 1, being rotatable with cooperation of respective spool support members (not shown) formed on the upper cassette case 2 (see FIG. 47). No ink ribbon 6 exists on the ribbon supply spool 15 and the ribbon winding spool 16.

In the first tape 11, a first base material (a handling auxiliary film) composed of a "PET sheet" having a sheet thickness of approximately 70 μm and a to-be-printed medium (a thin laminated film) composed of an urethane sheet having a sheet thickness of approximately 10 μm are stacked and further, a first adhesive layer (a weak adhesive layer) is formed between the first base material and the to-be-printed medium by being coated with a first adhesive agent (a weak adhesive agent) in a thickness of approximately 25 μm. Then, the first tape 11 is wound on the film spool 14 with its to-be-printed medium side inside. In the first tape 11 wound in this way, an inside surface (the first face side of the to-be-printed medium) wound on the film spool 14 will be a printing surface. Therefore, the first tape 11 wound on the film spool 14 is guided to an arm part 19 formed on the lower cassette case 3, via a guide pin 17 provided on the lower cassette case 3 in an upright position and a rotatable guide roller 18. The first tape 11 is further guided out of the arm part 19, being exposed outside a thermal head attachment space 20. After that, the first tape 11 is discharged from the tape cassette 1 through the tape discharging port 4, via a guide member 21 and a feed roller 22.

Incidentally, when the print cassette 1 of the first embodiment is set in a cassette mount of a tape printer, a thermal head H1 of the tape printer exists on the thermal head arrangement portion 20. Then, the first tape 11 is nipped by the thermal head H1 and a platen roller P1 of the tape printer opposing the head H1.

On the other hand, the second tape 13 has a second adhesive layer which is formed by being coated a second base material (a release sheet) having a sheet thickness of approximately 53 μm with a second adhesive agent of approximately 16 μm thick. Then, the second tape 13 is wound on the tape spool 12 with the second base material side outside. The second tape 13 wound in this way is guided by the feed roller 22 while the adhesive-coated surface of the second adhesive layer and the printing surface of the first tape 11 are overlapped with each other. As a result, the second tape 13 adheres to the first tape 11, and discharged outside the print cassette 1 through the tape discharging port 4.

Figure 22:
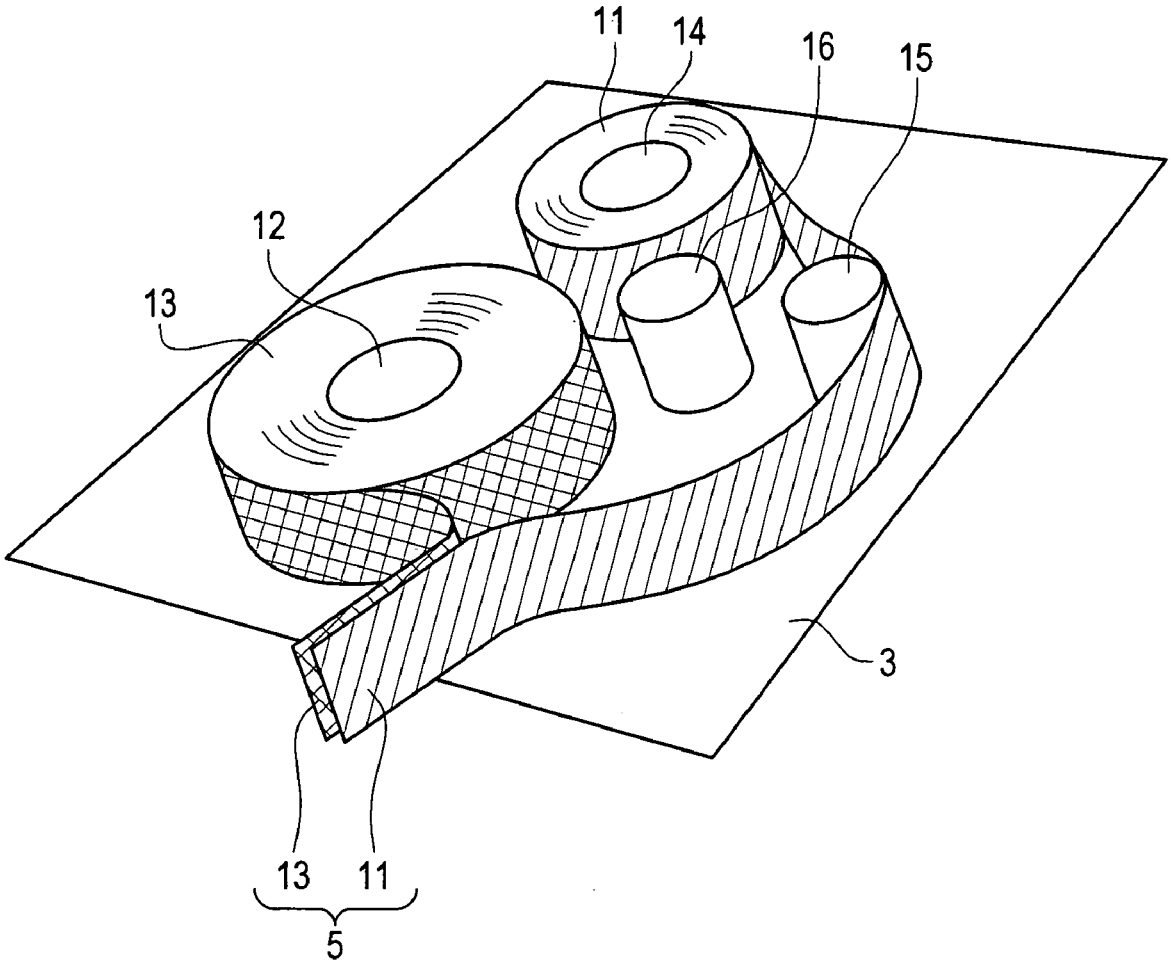
FIG. 22 is a schematic view illustrating a process of a first tape of thermosensitive type and a second tape being guided on a lower cassette case according to the first embodiment.

Accordingly, the print tape 5, which is composed of the first tape 11 and the second tape 13, is discharged from the tape discharging port 4 of the print cassette 1 FIG. 22 is a schematic view showing a process of the first tape 11 and the second tape 13 being guided on the lower cassette case 3 as described above.

Figure 19:
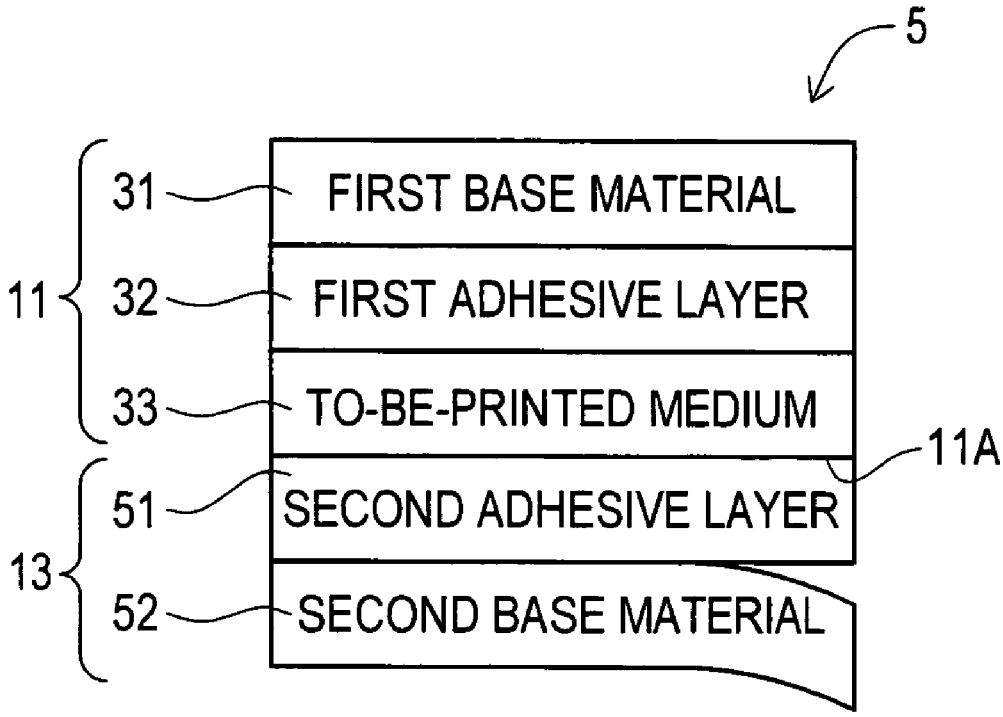
FIG. 19 is a cross-sectional view of a print tape of thermosensitive type according to the first embodiment, taken along a line A2-A2 illustrated in FIG. 21.

FIG. 19 is a cross-sectional view of the print tape 5 taken along the line A2-A2 shown in FIG. 21. As shown in FIG. 19, the print tape 5 is composed of the first tape 11 and the second tape 13. In the first tape 11, as described above, a first base material 31 composed of a "PET sheet" having a sheet thickness of approximately 70 μm and a to-be-printed medium 33 composed of an urethane sheet having a sheet thickness of approximately 10 μm are stacked and further, a first adhesive layer 32 is formed between the first base material 31 and the second face (side) of the to-be-printed medium 33 by being coated with a first adhesive agent in a thickness of approximately 25 μm.

The first face (side) of the to-be-printed medium 33 is coated with a thermosensitive coloring agent. The printing surface 11A of the first tape 11 is formed thereof.

When the print cassette 1 of the first embodiment is set on a cassette mounting portion of a tape printer, the thermosensitive coloring agent coated to the printing surface 11A (of the to-be-printed medium 33) of the first tape 11 (see FIG. 19 and other figures) is discolored by the thermal head H1 of the tape printer designed to exist in the thermal head arrangement portion 20 so as to print.

As described above, the second tape 13 has a second adhesive layer 51 which is formed by being coated a second base material (a release sheet) 52 having a sheet thickness of approximately 53 μm with a second adhesive agent of approximately 16 μm thick. A printing surface 11A of the first tape 11 and the second adhesive layer 51 are overlapped with each other, so that the second tape 13 adheres to the first tape 11 to compose the print tape 5.

Figure 23:
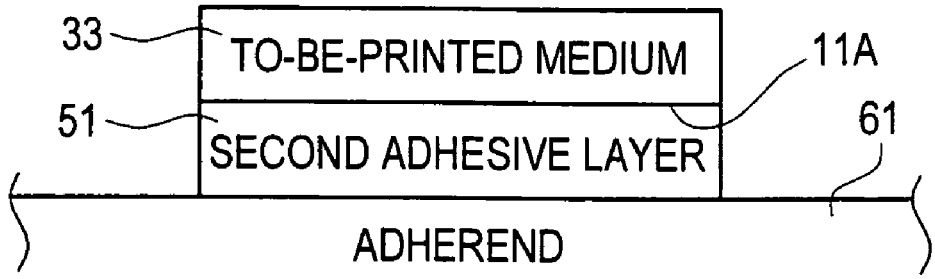
FIG. 23 is a cross-sectional view of the print tape of thermosensitive type according to the first embodiment being struck to an adherend as a "laminated tape".

Further, the print tape 5, from which the second base material 52 is removed so that the adhesive-coated surface of the second adhesive layer 51 is exposed, can be stuck to an adherend. After that, the first base material 31 is slowly removed, and then, as shown in FIG. 23, the to-be-printed medium 33 can be stuck to an adherend 61 with the second adhesive layer 51 of the second tape 13.

Figure 24:
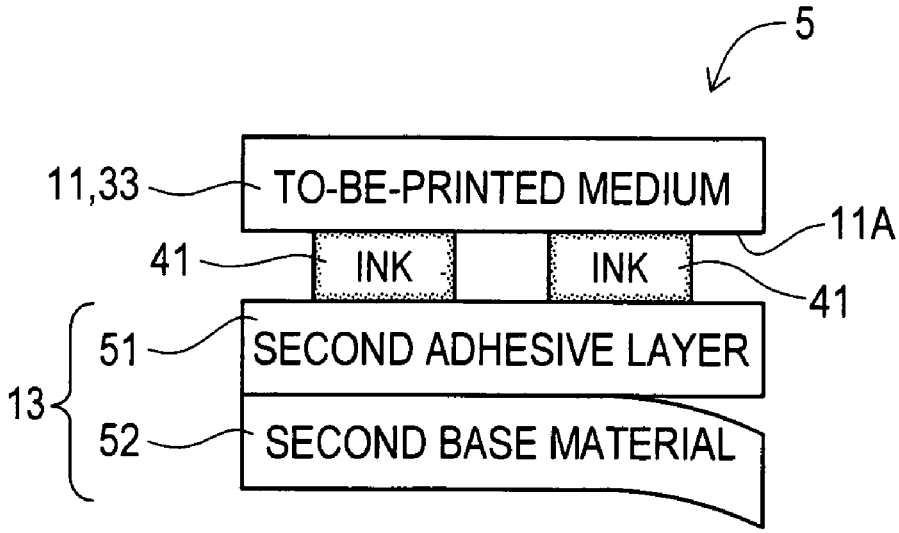
FIG. 24 is a cross-sectional view of a print tape not having a first base material according to the first embodiment, taken along the line A1-A1 illustrated in FIG. 3A.

Although in the print cassette 1 of the first embodiment, the first tape 11 is constituted by adhering the first base material 31 and the to-be-printed medium 33 with the first adhesive layer 32, the first tape 11 may be constituted of only the to-be-printed medium 33. FIG. 24 is a view showing a section of the print tape 5 produced using the first tape 11 constituted of only the to-be-printed medium 33.

In other words, the print tape 5 is constituted of the first tape 11 and the second tape 13 as shown in FIG. 24. As described above, the first tape 11 is constituted only of the to-be-printed medium 33 composed of an urethane sheet having a sheet thickness of approximately 10 μm. As described above, the second tape 13 has the second adhesive layer 51 which is formed by being coated the second base material 52 having a sheet thickness of approximately 53 μm with a second adhesive agent of approximately 16 μm thick. The printing surface 11A of the first tape 11 on which ink 41 is put and the second adhesive layer 51 are overlapped with each other, so that the second tape 13 adheres to the first tape 11 to compose the print tape 5.

Although in FIG. 24, the to-be-printed medium 33 and the second adhesive layer 51 appear to be in a floating state by the thickness of the ink 41, actually, the both adhered directly to each other because the thickness of the ink 41 is thin.

Figure 25A:
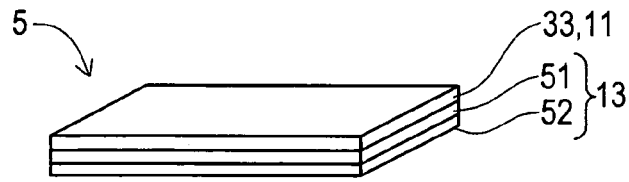
FIG. 25A is an explanatory diagram illustrating the way of using the print tape not having the first base material according to the first embodiment.
Figure 25B:
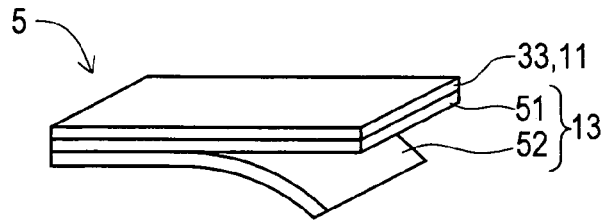
FIG. 25B is an explanatory diagram illustrating the way of using the print tape not having the first base material according to the first embodiment.
Figure 25C:
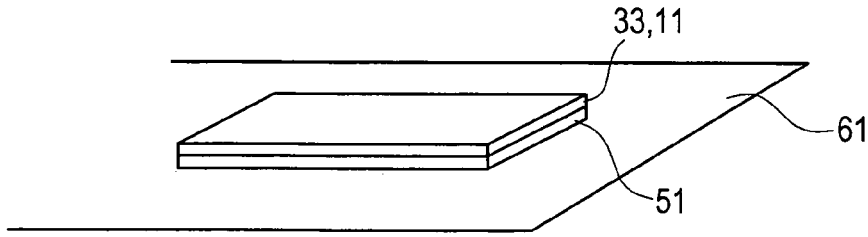
FIG. 25C is an explanatory diagram illustrating the way of using the print tape not having the first base material according to the first embodiment.

Next, the way of using the print tape 5 will be explained with reference to FIGS. 25A to 25C.

The print tape 5 is discharged from the tape discharging port 4 of the print cassette 1 of the first embodiment, the print cassette 1 being set in a cassette mount of a tape printer. The print tape 5 is cut with the cutter device of the tape printer to be a strip-formed tape composed of the first tape 11 (the to-be-printed medium 33) and the second tape 13 (the second adhesive layer 51 and the second base material 52) as shown in FIG. 25A. As shown in FIG. 25B, the second base material 52 of the second tape 13 is removed, so that the second adhesive layer 51 of the second tape 13 is exposed. Further, the second adhesive layer 51 of the second tape 13 is stuck to the adherend 61 as shown in FIG. 25C.

Figure 26:
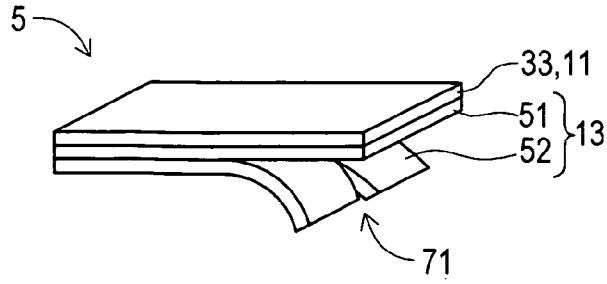
FIG. 26 is a perspective view illustrating the print tape not having the first base material according to the first embodiment.

Further, as shown in a perspective view of FIG. 26, the second base material 52 of the second tape 13 comprising the print tape 5 may preliminarily be provided with a half cut 71. This configuration can facilitate the work to remove the second base material 52 of the second tape 13. Then, the half cut 71 to be implemented preliminarily in the second base material 52 may be of various configurations showing in FIGS. 14 to 17 as described above and even in this case, the above-described effect which the half cut 71 exerts can be obtained.

Figure 27:
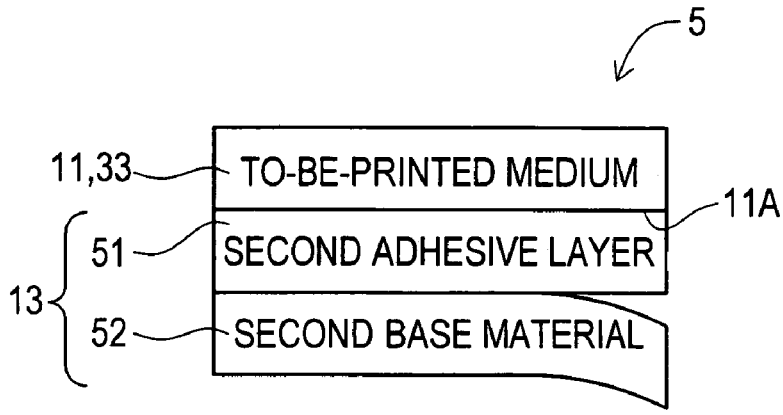
FIG. 27 is a cross-sectional view of the print tape not having the first base material according to the first embodiment being stuck to an adherend as a "laminated tape".

The print tape 5 produced using the first tape 11 constituted only of the to-be-printed medium 33 is not limited to the thermal transfer type but may be of the thermosensitive type. FIG. 27 is a view showing the section of such a thermosensitive type print tape 5.

In other words, as shown in FIG. 27, the thermosensitive type print tape 5 is constituted of a first tape 11 and a second tape 13. As described above, the first tape 11 is constituted only of a to-be-printed medium 33 composed of an urethane sheet having a sheet thickness of approximately 10 μm. At this point, the first face (side) of the to-be-printed medium 33 is coated with a thermosensitive coloring agent. A printing surface 11A of the first tape 11 is constituted thereof. As described above, the second tape 13 has a second adhesive layer 51 which is formed by being coated a second base material (a release sheet) 52 having a sheet thickness of approximately 53 μm with a second adhesive agent of approximately 16 μm thick. The printing surface 11A of the first tape 11 and the second adhesive layer 51 are overlapped with each other, so that the second tape 13 adheres to the first tape 11 to compose the thermosensitive type print tape 5.

Although in the first embodiment, the print tape 5 produced by a tape printer using the print cassette 1, even a sheet-like print tape (including a wide tape-like one) which cannot be produced using the tape printer in which the print cassette 1 is set can obtain the above-described various effects (excluding effects exerted within the print cassette 1). Further, although in this embodiment, the width of the ink ribbon 6 is wider than the width of the print tape 5, the width of the ink ribbon 6 may be equal to the width of the print tape 5.

Preferably, the thickness of the to-be-printed medium 33 is 2.5 μm to 30 μm.

Figure 29:
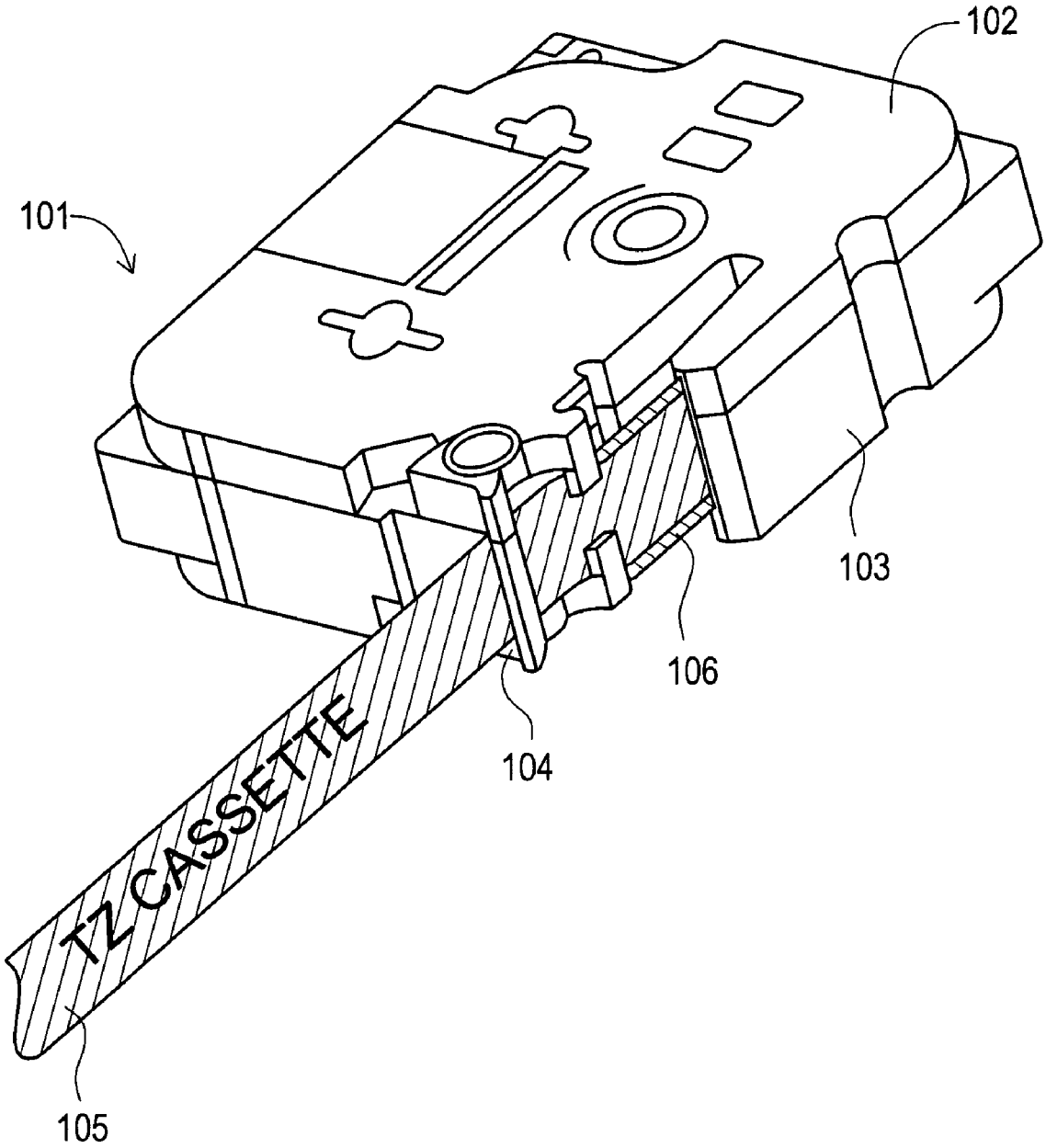
FIG. 29 is a perspective view of a print cassette of thermal transfer type according to the second embodiment.

Hereinafter, the print cassette of the present disclosure will be described in detail based on the second embodiment of the present disclosure with reference to the drawings. FIG. 29 is a perspective view of the print cassette. As shown in FIG. 29, a print cassette 101 of the second embodiment comprises an upper cassette case 102 and a lower cassette case 103. A print tape 105 is discharged from a tape discharging port 104. It is noted that a reference numeral 106 indicates an ink ribbon. The width of the ink ribbon 106 is wider than that of the print tape 105.

Figure 30A:
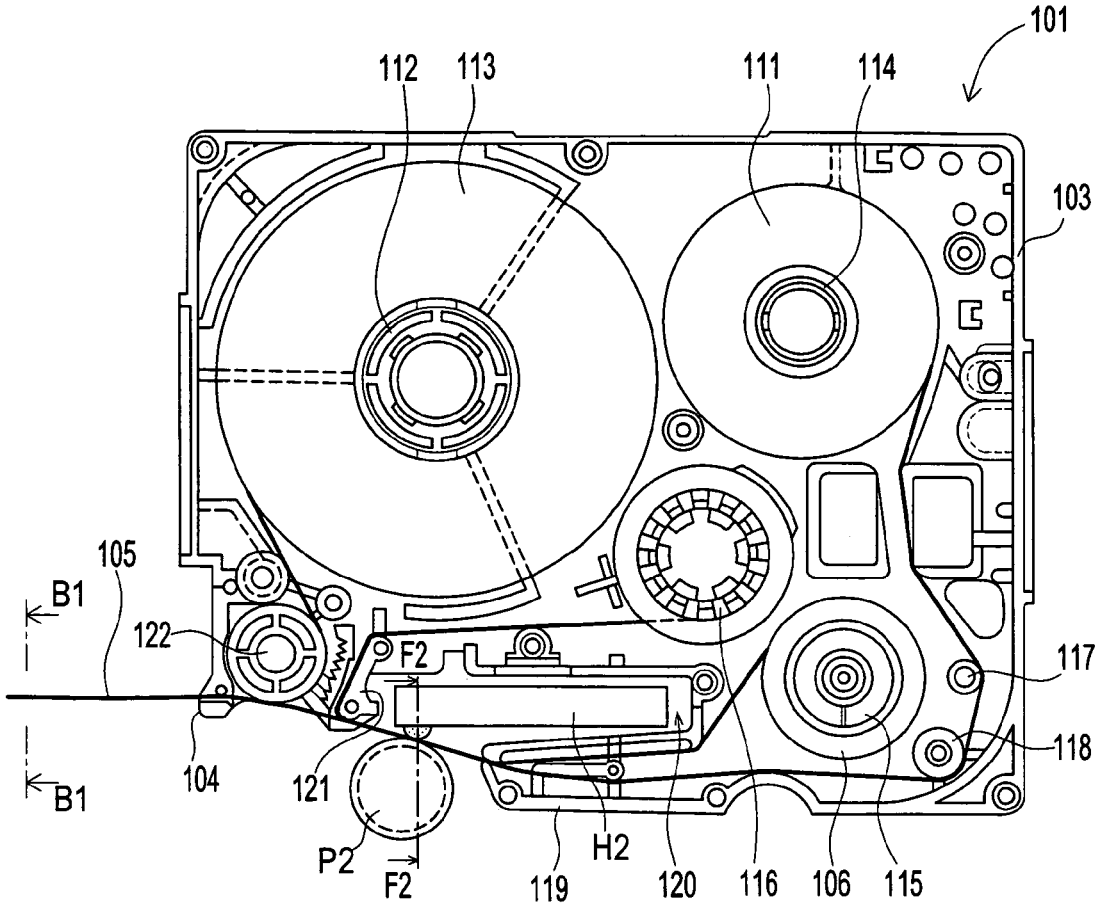
FIG. 30A is a plan view of the print cassette of thermal transfer type according to the second embodiment from which an upper cassette case is removed.

FIG. 30A is a plan view of the print cassette 101 from which the upper cassette case 102 (see FIG. 29) is removed. As shown in FIG. 30A, a tape spool 112 on which a third tape 113 is wound, a film spool 114 on which a first tape 111 is wound, a ribbon supply spool 115 on which the ink ribbon 106 is wound, and a ribbon take-up spool 116 are provided on the lower cassette case 103 of the print cassette 101, being rotatable with cooperation of respective spool support members (not shown) formed on the upper cassette case 102 (see FIG. 29).

In the first tape 111, a first base material (a handling auxiliary film) composed of a "PET sheet" having a sheet thickness of approximately 70 μm and a to-be-printed medium (a thin laminated film) composed of an urethane sheet having a sheet thickness of approximately 10 μm are stacked and further, a first adhesive layer (a weak adhesive layer) is formed between the first base material and the to-be-printed medium by being coated with a first adhesive agent (a weak adhesive agent) in a thickness of approximately 25 μm. Then, the first tape 111 is wound on the film spool 114 with its to-be-printed medium side inside. In the first tape 111 wound in this way, an inside surface (the first face side of the to-be-printed medium) wound on the film spool 114 will be a printing surface. Therefore, the first tape 111 wound on the film spool 114 is guided to an arm part 119 formed on the lower cassette case 103, via a guide pin 117 provided on the lower cassette case 103 in an upright position and a rotatable guide roller 118. The first tape 111 is further guided out of the arm part 119, being exposed outside a thermal head attachment space 120. After that, the first tape 111 is discharged from the tape cassette 101 through the tape discharging port 104, via a guide member 121 and a feed roller 122.

The ink ribbon 106 is wound on the ribbon supply spool 115 with an ink-coated surface side inside. The ink ribbon 106 wound on the ribbon supply spool 115 in this way is exposed out of the arm part 119 outside the thermal head attachment space 120. The ink ribbon 106 is further guided while the ink-coated surface and the first face (side) of the to-be-printed medium are overlapped with each other. After that, the ink ribbon 106 is guided along an exterior of the guide member 121, thereby getting separated from the printing surface of the first tape 111. Finally, the ink ribbon 106 is taken up by the ribbon take-up spool 116.

Incidentally, when the print cassette 101 of the second embodiment is set in a cassette mount of a tape printer, a thermal head H2 of the tape printer exists on the thermal head arrangement portion 120. Then, the first tape 111 and the ink ribbon 106 are nipped by the thermal head H2 and a platen roller P2 of the tape printer opposing the head H2.

On the other hand, the third tape 113 has a third adhesive layer which is formed by being coated the first face side of a third base material (a base film) composed of a "PET sheet" having a sheet thickness of approximately 12 μm with a third adhesive agent of approximately 20 μm thick. The second face side of the third base material is coated with a fourth adhesive agent so as to form a fourth adhesive layer having a thickness of approximately 16 μm. Further, a fourth base material (a release sheet) having a thickness of approximately 53 μm adhered to the fourth adhesive layer. The third tape 113 is wound on the tape spool 112 with the fourth base material side outside. The third tape 113 wound in this way is guided by the feed roller 122 while the adhesive-coated surface of the third adhesive layer and the printing surface of the first tape 111 are overlapped with each other. As a result, the third tape 113 adheres to the first tape 111, and discharged outside the print cassette 101 through the tape discharging port 104.

Figure 31:
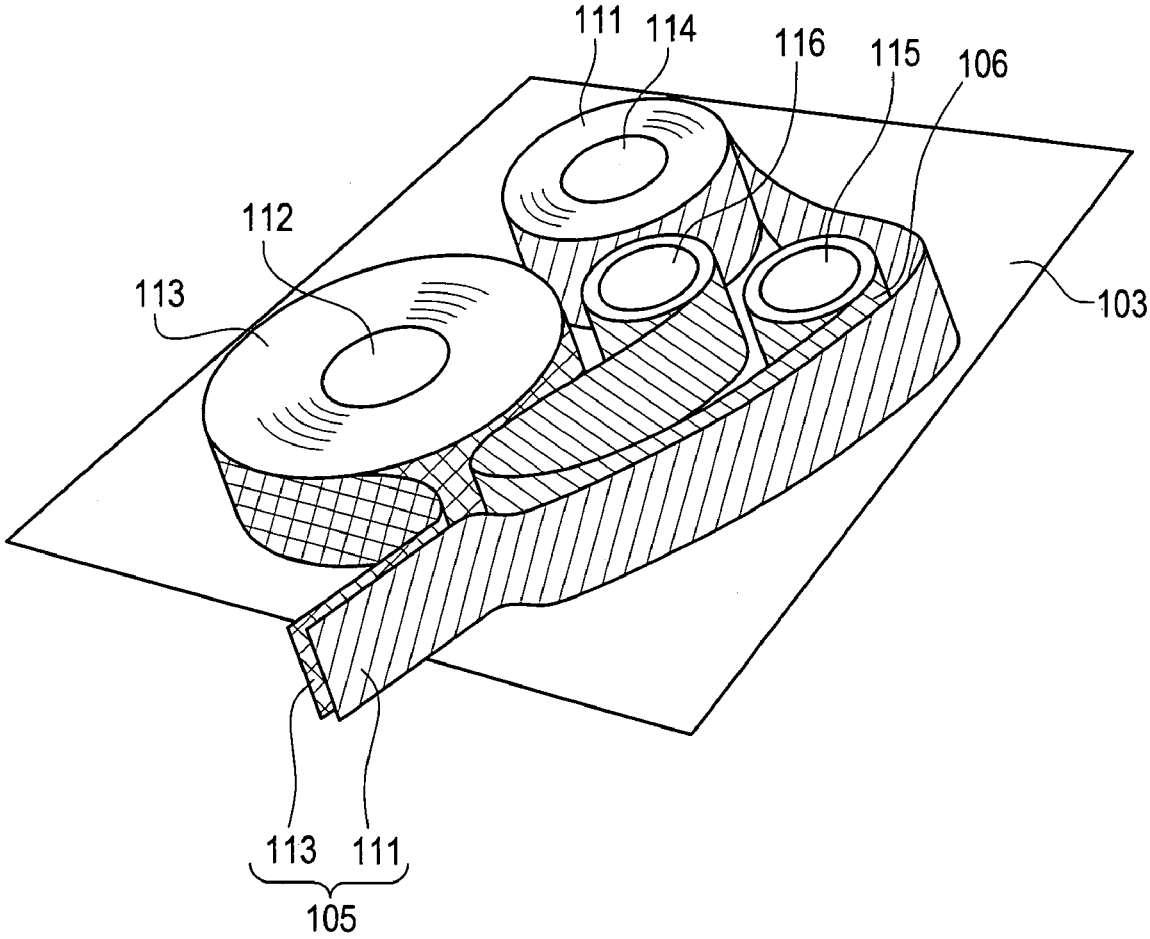
FIG. 31 is a schematic view illustrating a process of a first tape of thermal transfer type, a third tape and an ink ribbon being guided on a lower cassette case according to the second embodiment.

Accordingly, the print tape 105, which is composed of the first tape 111 and the third tape 113, is discharged from the tape discharging port 104 of the print cassette 101. FIG. 31 is a schematic view showing a process of the first tape 111, the third tape 113 and the ink ribbon 106 being guided on the lower cassette case 103 as described above.

Figure 28:
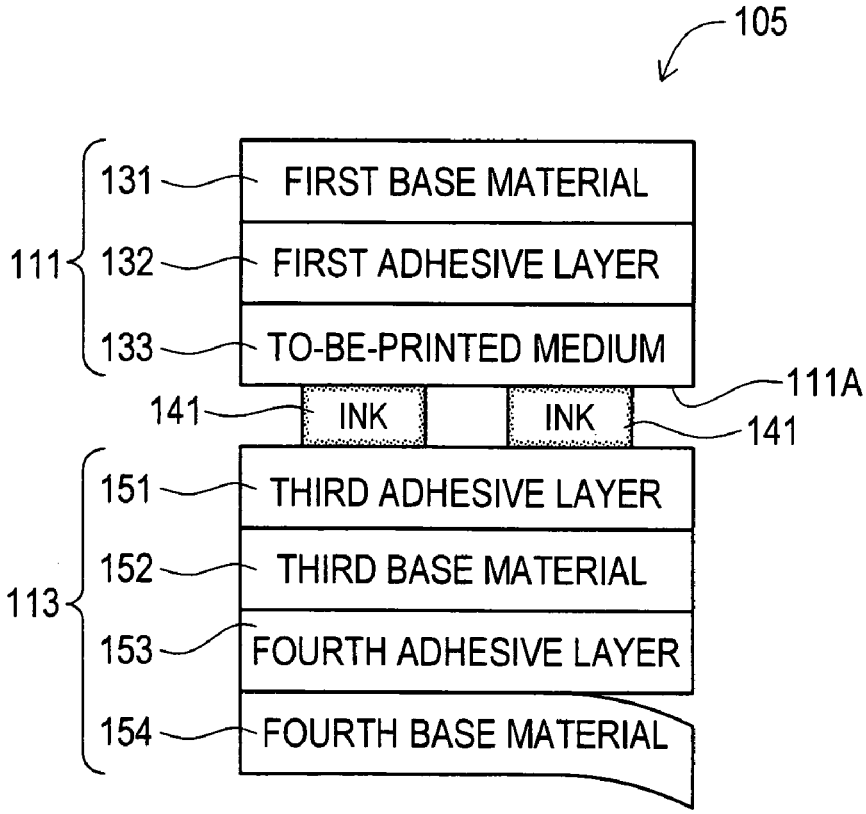
FIG. 28 is a cross-sectional view of a print tape of thermal transfer type according to a second embodiment, taken along a line B1-B1 illustrated in FIG. 30A.

FIG. 28 is a cross-sectional view of the print tape 105 taken along the B1-B1 shown in FIG. 30A. As shown in FIG. 28, the print tape 105 is composed of the first tape 111 and the third tape 113. In the first tape 111, as described above, a first base material 131 composed of a "PET sheet" having a sheet thickness of approximately 70 μm and a to-be-printed medium 133 composed of an urethane sheet having a sheet thickness of approximately 10 μm are stacked and further, a first adhesive layer 132 is formed between the first base material 131 and the second face (side) of the to-be-printed medium 133 by being coated with a first adhesive agent in a thickness of approximately 25 μm. As described above, the third tape 113 is configured such that the first face side of the third base material 152 composed of a "PET sheet" having a sheet thickness of approximately 12 μm is coated with a third adhesive agent to form a third adhesive layer 151 in a thickness of approximately 20 μm and the second face side of the third base material 152 is coated with a fourth adhesive agent to form a fourth adhesive layer 153 in a thickness of approximately 16 μm. Further, a fourth base material 154 having a thickness of approximately 53 μm adhered to the fourth adhesive layer 153. A printing surface 111A of the first tape 111 on which ink 141 is put and the third adhesive layer 151 are overlapped with each other, so that the third tape 113 adheres to the first tape 111 to compose the print tape 105.

Further, the print tape 105, from which the fourth base material 154 is removed so that the adhesive-coated surface of the fourth adhesive layer 153 is exposed, can be stuck to an adherend. After that, the first base material 131 is slowly removed, and then, as shown in FIG. 32, the to-be-printed medium 133 can be stuck to an adherend 161 with the third adhesive layer 151, the third base material 152 and the fourth adhesive layer 153 of the third tape 113, along with the ink 141 which is thermally transferred to the printing surface 111A thereof.

Figure 32:
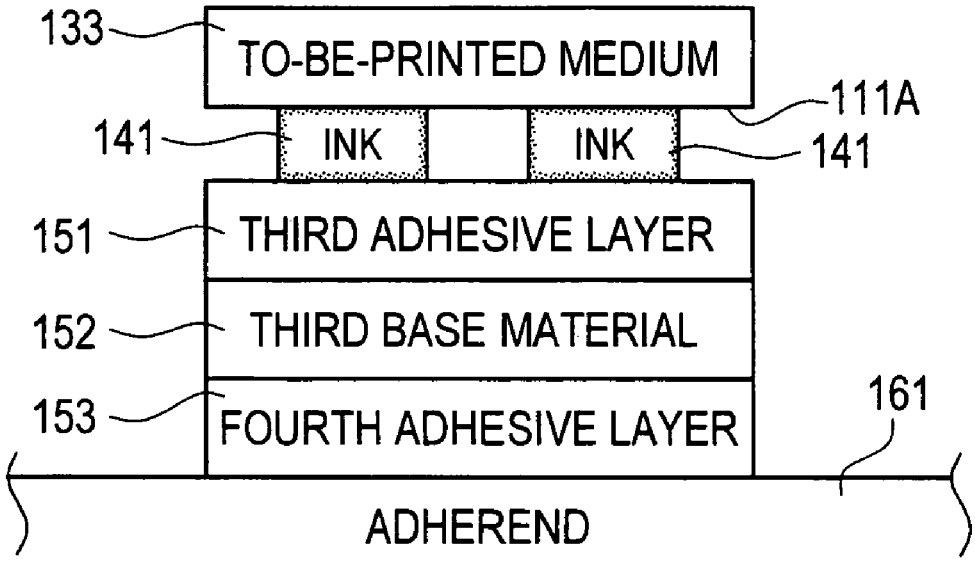
FIG. 32 is a cross-sectional view of the print tape of thermal transfer type according to the second embodiment being stuck to an adherend as a "laminated tape".

Although in FIGS. 28 and 32, the to-be-printed medium 133 and the third adhesive layer 151 appear to be in a floating state by the thickness of the ink 141, actually, the both adhered directly to each other because the thickness of the ink 141 is thin.

In order that the to-be-printed medium 133 on which the ink 141 is thermally transferred to the printing surface 111A adheres to the first base material 131 as described above, the first adhesive agent making up the first adhesive layer 132 includes a copolymer as a main material, made by the copolymerization of monomers of any series such as an acrylic series, a rubber series and a silicone series. The first adhesive agent can be made with or without various kinds of additives (such as a crosslinking agent, a tackifier, a softener, a fixture and a pigment). The first adhesive agent having a low adhesive property is adopted since this is used for temporary adhesion and a part which will be removed eventually.

On the other hand, the adhesive agent making up the third adhesive layer 151 and the fourth adhesive layer 153 include a copolymer as a main material, made by the copolymerization of monomers of any series such as an acrylic series, a rubber series and a silicone series. The adhesive agent can be made with or without various kinds of additives (such as a crosslinking agent, a tackifier, a softener, a fixture and a pigment). Especially for the adhesive agent making up the fourth adhesive layer 153, the adhesive agent having an adhesive property appropriate to the adherend 161 is adopted.

Incidentally, the print cassette 101 is set in a cassette mount of a tape printer to produce the print tape 105. In the cassette mount of the tape printer, there is provided a cutter device (not shown) having a cutter to cut the print tape 105 discharged from the tape discharging port 104 of the print cassette 101. The structure of the print cassette 101 as explained with reference to FIG. 29 and other figures and the tape printer in which the print cassette 101 is installed to produce the print tape 105 have been publicly known, so the detailed explanation of the process for producing the print tape 105 with the print cassette 101 and the tape printer is omitted.

Next, the way of using the print tape 105 will be explained with reference to FIGS. 33A to 33E.

Figure 33A:
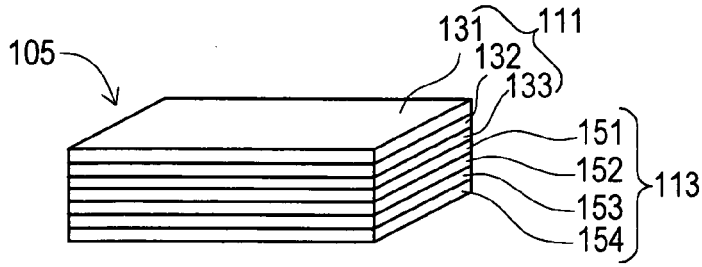
FIG. 33A is an explanatory diagram illustrating the way of using the print tape according to the second embodiment.
Figure 33B:
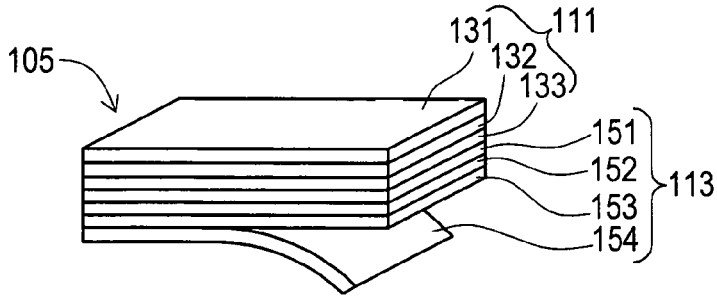
FIG. 33B is an explanatory diagram illustrating the way of using the print tape according to the second embodiment.
Figure 33C:
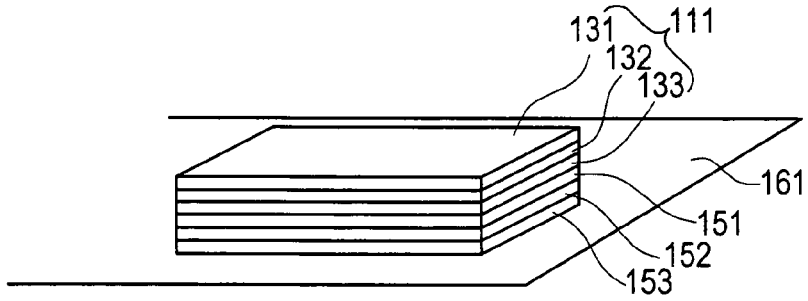
FIG. 33C is an explanatory diagram illustrating the way of using the print tape according to the second embodiment.

The print tape 105 is discharged from the tape discharging port 104 of the print cassette 101 of the second embodiment, the print cassette 101 being set in a cassette mount of a tape printer. The print tape 105 is cut with the cutter device of the tape printer to be a strip-formed tape composed of the first tape 111 (the first base material 131, the first adhesive layer 132 and the to-be-printed medium 133) and the third tape 113 (the third adhesive layer 151, the third base material 152, the fourth adhesive layer 153 and the fourth base material 154) as shown in FIG. 33A. As shown in FIG. 33B, the fourth base material 154 of the third tape 113 is removed, so that the fourth adhesive layer 153 of the third tape 113 is exposed. Further, the fourth adhesive layer 153 of the third tape 113 is stuck to the adherend 161 as shown in FIG. 33C.

Figure 33D:
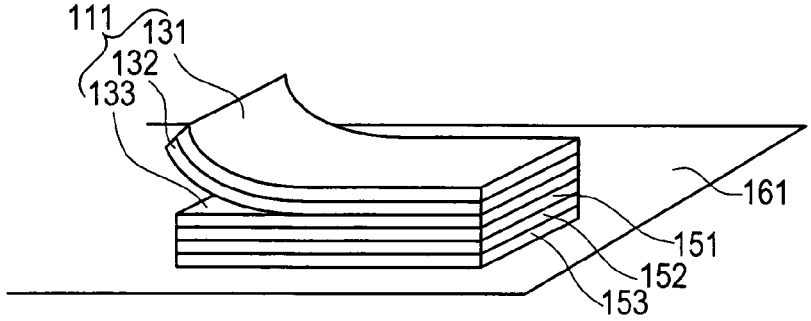
FIG. 33D is an explanatory diagram illustrating the way of using the print tape according to the second embodiment.
Figure 33E:
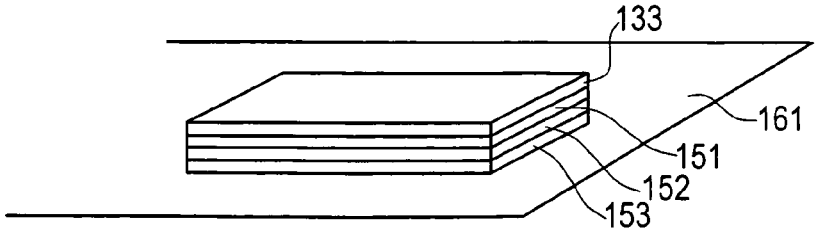
FIG. 33E is an explanatory diagram illustrating the way of using the print tape according to the embodiment.

As shown in FIG. 33D, the first base material 131 is slowly removed from the adherend 161. At this time, the first adhesive layer 132 is also removed with the first base material 131, thus only the to-be-printed medium 133 can be left there. Finally, as shown in FIG. 33E, the to-be-printed medium 133 on which the ink 141 is thermally transferred is in a state of adhering to the adherend 161 with the third adhesive layer 151, third base material 152 and fourth adhesive layer 153 of the third tape 113. The ink 141 has been thermally transferred from the ink ribbon 106 (see FIG. 30A and other figures) to the printing surface 111A (of the to-be-printed medium 133) of the first tape 111 (see FIG. 28 and other figures) with the tape printer.

As described in detail above, the print cassette 101 of the second embodiment is set in a cassette mount of a tape printer to produce the print tape 105 which is discharged from the tape printer.

The print tape 105 discharged from the tape printer is cut by the cutter device of the tape printer, and then the fourth base material 154 is removed from the third tape 113 adhered to the first tape 111 (see FIG. 33B). The exposed fourth adhesive layer 153 of the third tape 113 is stuck to the adherend 161 (see FIG. 33C). Further, the first base material 131 is slowly removed from the adherend 161 (see FIG. 33D), so that the first adhesive layer 132 is removed with the first base material 131 and the to-be-printed medium 133 is left on the adherend 161 with the ink 141. As shown in FIG. 32, the to-be-printed medium 133 having the printing surface 111A on the back side thereof is stuck to the adherend 161 with the third adhesive layer 151, third base material 152 and fourth adhesive layer 153 of the third tape 113. As a result, a "laminated tape" can be stuck to the adherend 161 (see FIG. 33E).

The to-be-printed medium 133 adhered to the first base material 131 with the first adhesive layer 132 to take the form of the first tape 111 (see FIG. 28) which is wound on the film spool 114 within the print cassette 101 of the second embodiment as shown in FIG. 30A. From this state, the to-be-printed medium 133 of the first tape 111 adheres to the third tape 113 with the third adhesive layer 151 thereof to be the print tape 105, which is discharged through the tape discharging port 104. Thus, the to-be-printed medium 133 can assure the feeding performance within the print cassette 101 of the second embodiment even though the to-be-printed medium 133 is thin.

Particularly, in the second embodiment, because the first base material 131 is thicker than the to-be-printed medium 133, the feeding performance of the first tape 111 within the print cassette 101 of the second embodiment can be secured even however thin the to-be-printed medium 133 is.

As shown in FIGS. 33A and 33B, the third tape 113 is in a state of adhering to the first tape 111 when stuck to the adherend 161. The third tape 113 can thus keep the rigidity at least by the thickness of the first tape 111. Accordingly, however thin the to-be-printed medium 133 composing the "laminated tape" is, the "laminated tape" can easily be stuck to the adherend 161 as shown in FIG. 33.

Particularly, in the second embodiment, the first base material 131 is thicker than the to-be-printed medium 133. Accordingly, however thin the to-be-printed medium 133 is, the first base material 131 can easily be removed.

The first adhesive layer 132 which adheres the first base material 131 to the to-be-printed medium 133 is formed by being coated with the first adhesive agent between the first base material 131 and the to-be-printed medium 133 in a thickness of approximately 25 μm. At this point, although the first adhesive agent may be filled to an entire range between the first base material 131 and the to-be-printed medium 133, the first adhesive agent may be coated in a predetermined pattern so that the first adhesive agent is dispersed uniformly.

Figure 45A:
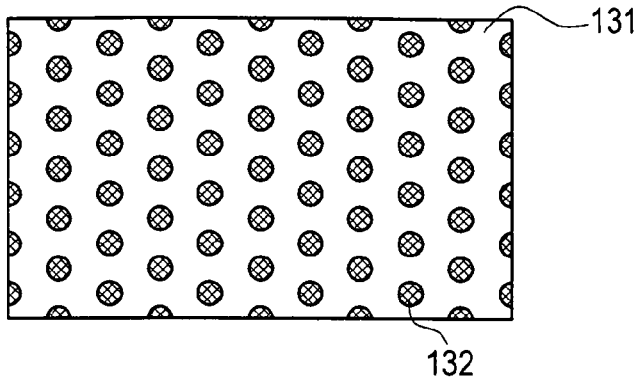
FIG. 45A is an exemplary diagram illustrating a coating pattern of a first adhesive agent forming a first adhesive layer according to the second embodiment.
Figure 45B:
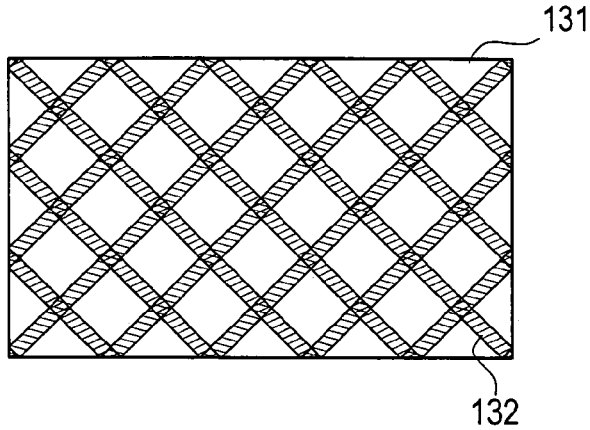
FIG. 45B is an exemplary diagram illustrating a coating pattern of the first adhesive agent forming the first adhesive layer according to the second embodiment.
Figure 45C:
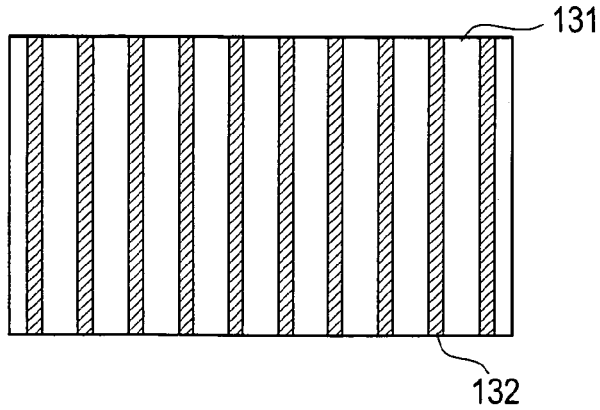
FIG. 45C is an exemplary diagram illustrating a coating pattern of the first adhesive agent forming the first adhesive layer according to the second embodiment.
Figure 45D:
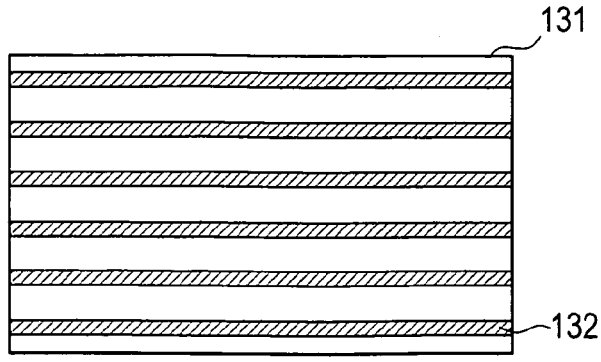
FIG. 45D is an exemplary diagram illustrating a coating pattern of the first adhesive agent forming the first adhesive layer according to the second embodiment.

FIGS. 45A to 45D are views showing examples of coating patterns of the first adhesive agent to be coated for forming the first adhesive layer 132. FIG. 45A shows an example that the first adhesive layer 132 is formed in polka-dot pattern by being coated with the dot-like first adhesive agent to the first base material 131 intermittently (cyclically). FIG. 45B shows an example that the linear first adhesive agent is coated to the first base material 131 intermittently (cyclically) at an inclined angle so as to form the first adhesive layer 132 into a grid pattern. FIG. 45C shows an example that the linear first adhesive agent is coated to the first base material 131 intermittently (cyclically) in the width direction so as to form the first adhesive layer 132 in a striped pattern. FIG. 45D shows an example that the linear first adhesive agent is coated to the first base material 131 intermittently (cyclically) in the longitudinal direction so as to form the first adhesive layer 132 into a striped pattern.

In other words, with regard to the print tape 105 which is produced in a tape printer by using the print cassette 101 of the second embodiment, as described above, the to-be-printed medium 133 adhered to the first base material 131 with the first adhesive layer 132. The print tape 105 can thus keep the rigidity at least by the thickness of the first base material 131. Accordingly, the feeding performance within the print cassette 101 of the second embodiment can be secured. At this point, if the first adhesive agent which forms the first adhesive layer 132 is dispersed uniformly in a predetermined pattern as shown in FIGS. 45A, 45B, 45C and 45D, as compared with a case where the first adhesive agent is coated to the entire surface, the first adhesive agent which is to form the first adhesive layer 132 is not pushed out from between the to-be-printed medium 133 and the first base material 131 easily. Thus, the feeding performance of the to-be-printed medium 133 within the print cassette 101 of the second embodiment is stabilized further.

As described above, when the print tape 105 (that is, the to-be-printed medium 133) is stuck to the adherend 161, the first base material 131 adhered to the to-be-printed medium 133 with the first adhesive layer 132 so that the to-be-printed medium 133 can thus keep the rigidity at least by the thickness of the first base material 131. Accordingly, however thin the to-be-printed medium 133 is, the to-be-printed medium 133 can easily be stuck to the adherend 161 (see FIGS. 33A, 33B and 33C). At this point, if the first adhesive agent which forms the first adhesive layer 132 is dispersed uniformly in a predetermined pattern as shown in FIGS. 45A, 45B, 45C and 45D, it is easy to create a clue for releasing the first base material 131 from the to-be-printed medium 133 even if the to-be-printed medium 133 is kept stuck to the adherend 161 together with the first base material 131. After that, the first base material 131 can be removed from the to-be-printed medium 133 easily (see FIG. 33D).

Further, when the to-be-printed medium 133 is stuck to the adherend 161 with the third adhesive layer 151, the third base material 152 and the fourth adhesive layer 153 of the third tape 113, the total thickness of the to-be-printed medium 133 and the third tape 113 is as thin as approximately 58 μm. Therefore, the outline of the to-be-printed medium 133 is hardly visible if the to-be-printed medium 133 is transparent and colorless, so that the ink 141 (printed contents) on the to-be-printed medium 133 can be prominent. Additionally, the total weight of the to-be-printed medium 133 and the third tape 113 is so light as to reduce adverse effect on rotational balance of the adherend 161 as a body of rotation such as a CD and a DVD.

Further, when stuck to the curved surface of the adherend 161, the to-be-printed medium 133 is as thin as 10 μm, thus the to-be-printed medium 133 can be prevented from being gradually unstuck. This effect can be achieved even if the thickness of the to-be-printed medium 133 is as large as 30 μm.

As shown in FIG. 32, the printing surface 111A on which the ink 141 is thermally transferred exists on the back side of the to-be-printed medium 133, that is, the printing surface 111A is laminated by the to-be-printed medium 133, thereby presenting abrasion resistance which is a feature of the "laminated tape".

The disclosure may be embodied in other specific forms without departing from the essential characteristics thereof.

Figure 34:
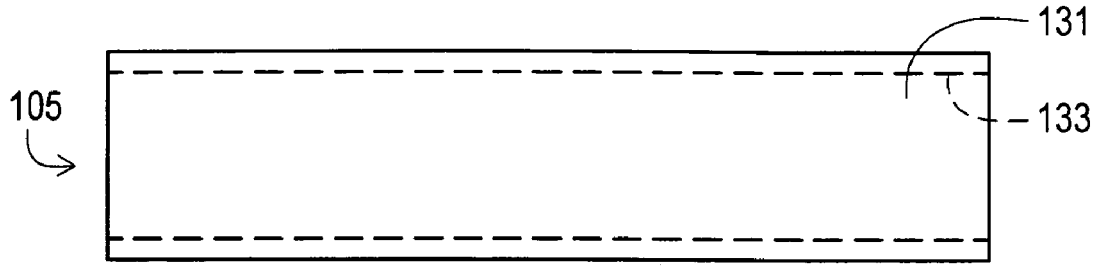
FIG. 34 is a plan view illustrating another print tape according to the second embodiment.
Figure 35:
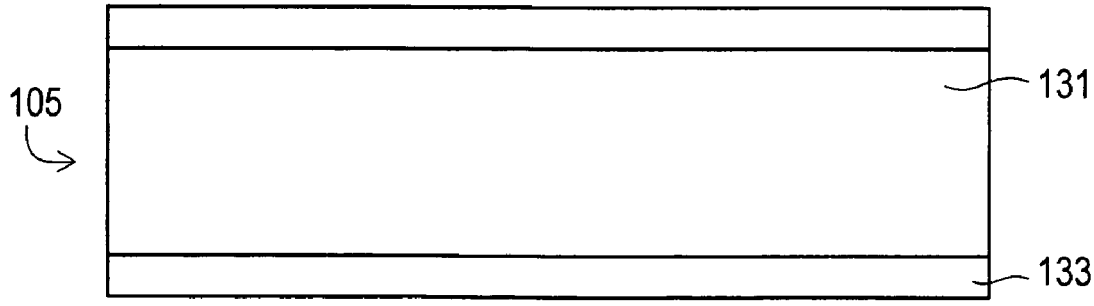
FIG. 35 is a plan view illustrating another print tape according to the second embodiment.

For instance, with regard to the print tape 105 which is produced in a tape printer by using the print cassette 101 of the second embodiment, for instance, the first base material 131 may have a width wider than that of the to-be-printed medium 133 as shown in a plan view of FIG. 34. Conversely, the first base material 131 may have a width narrower than that of the to-be-printed medium 133, as shown in a plan view of FIG. 35. In both cases, the first base material 131 and the to-be-printed medium 133 are different in width, which makes it easy to distinguish the first base material 131 and to unstuck the first base material 131.

This is the same if the width of the forth base material 154 of the third tape 113 is wider (not shown).

Figure 36:
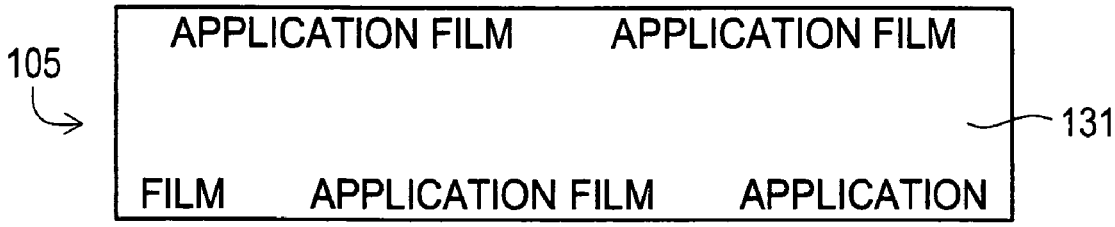
FIG. 36 is a plan view illustrating another print tape according to the second embodiment.

Even in the print tape 105 having the first base material 131 as wide as the first base material 131, as shown in a plan view of FIG. 36, the presence of the first base material 131 can be emphasized with prints such as characters and patterns (in FIG. 36, for example, characters of "APPLICATION FILM") representing the first base material 131 preliminarily printed on the first base material 131 itself, thereby facilitating the work to unstick the first base material 131. In addition, if the top and bottom of the print tape 105 can be distinguished by the characters and patterns preliminarily printed on the first base material 131, the print tape 105 is allowed to be stuck readily to the adherend 161 (see FIG. 33 and other figures).

Figure 39:
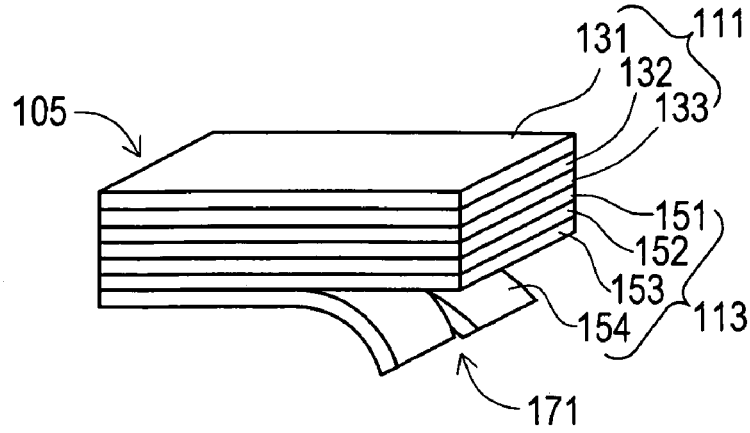
FIG. 39 is a perspective view illustrating another print tape according to the second embodiment.

Further, as shown in a perspective view of FIG. 39, the fourth base material 154 of the third tape 113 comprising the print tape 105 may preliminarily be provided with a half cut 171. This configuration can facilitate the work to remove the fourth base material 154 of the third tape 113. Similarly, as shown in a perspective view of FIG. 40, the first base material 131 may preliminarily be provided with a half cut 181 in advance, which allows the first base material 131 to be unstuck easily.

Figure 41A:
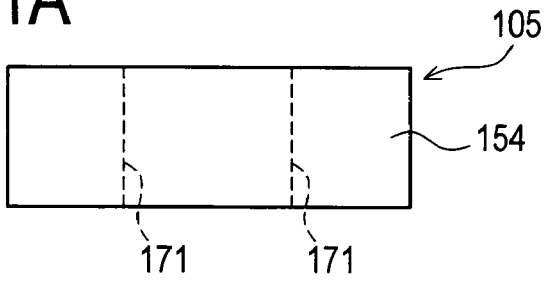
FIG. 41A is a plan view illustrating another print tape according to the second embodiment.
Figure 41B:
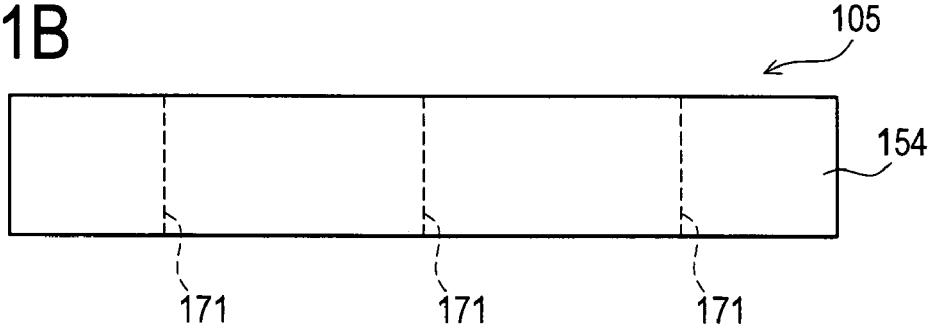
FIG. 41B is a plan view illustrating another print tape according to the second embodiment.
Figure 41C:
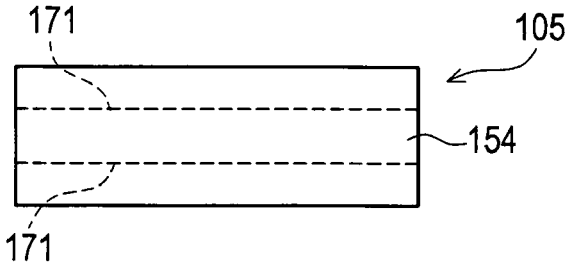
FIG. 41C is a plan view illustrating another print tape according to the second embodiment.
Figure 41D:
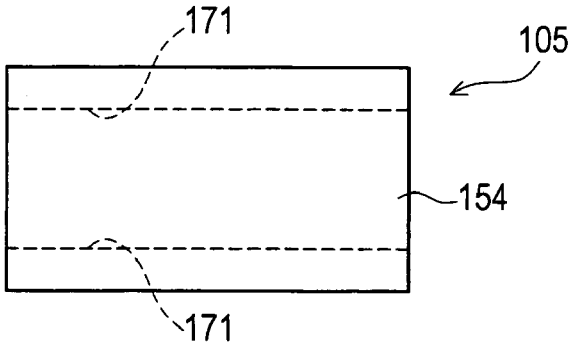
FIG. 41D is a plan view illustrating another print tape according to the second embodiment.
Figure 42A:
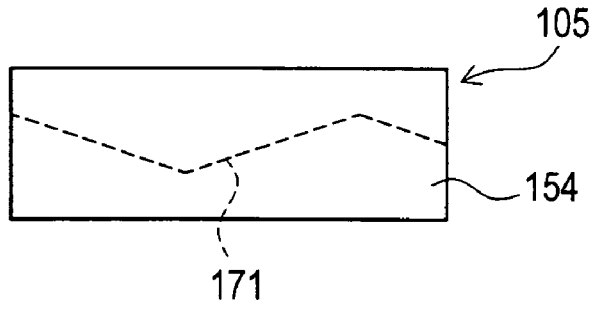
FIG. 42A is a plan view illustrating another print tape according to the second embodiment.
Figure 42B:
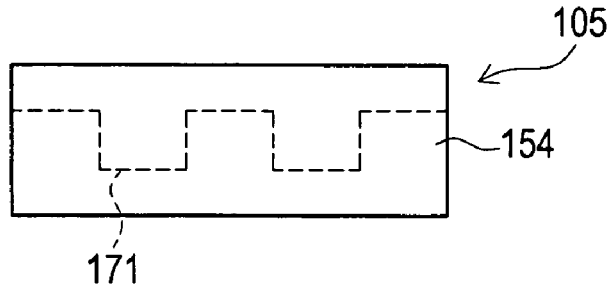
FIG. 42B is a plan view illustrating another print tape according to the second embodiment.
Figure 42C:
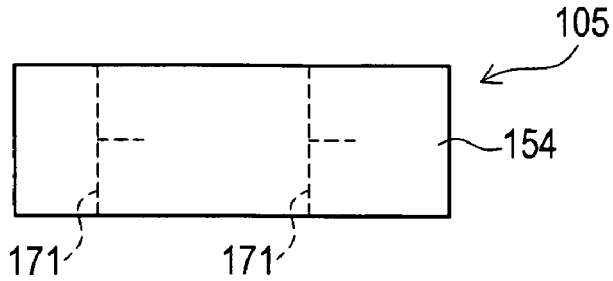
FIG. 42C is a plan view illustrating another print tape according to the second embodiment.
Figure 43A:
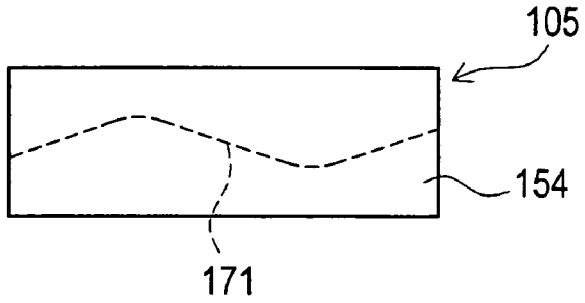
FIG. 43A is a plan view illustrating another print tape according to the second embodiment.
Figure 43B:
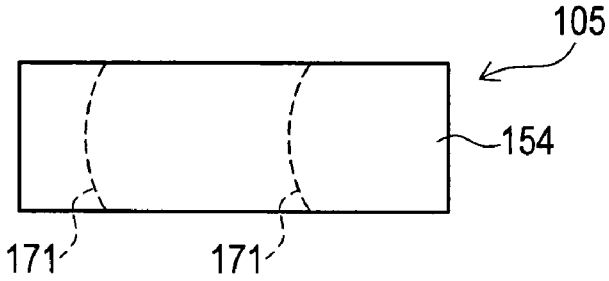
FIG. 43B is a plan view illustrating another print tape according to the second embodiment.
Figure 43C:
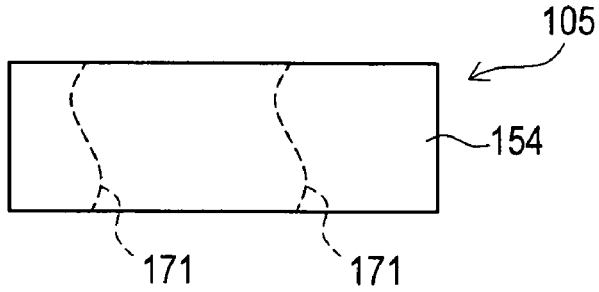
FIG. 43C is a plan view illustrating another print tape according to the second embodiment.
Figure 44A:
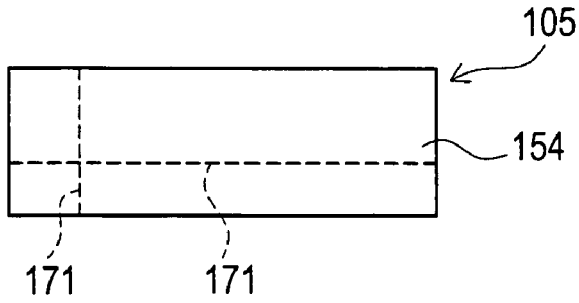
FIG. 44A is a plan view illustrating another print tape according to the second embodiment.
Figure 44B:
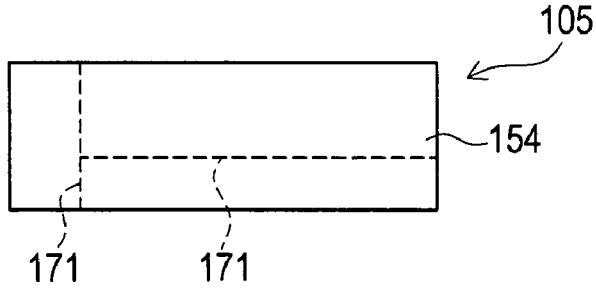
FIG. 44B is a plan view illustrating another print tape according to the second embodiment.
Figure 44C:
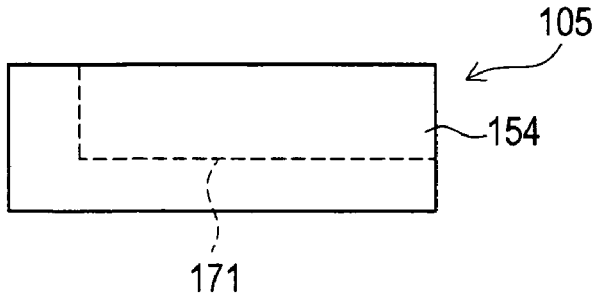
FIG. 44C is a plan view illustrating another print tape according to the second embodiment.

FIGS. 41A to 44C show various configurations of half cuts 171 implemented in the fourth base material 154 preliminarily. FIGS. 41A and 41B show an example that a plurality of half cuts 171 are implemented in the width direction of the fourth base material 154, and FIGS. 41C and 41D show an example that a plurality of half cuts 171 are implemented in the longitudinal direction of the fourth base material 154. FIGS. 42A, 42B, and 42C show an example that a linear half cut 171 is implemented in the fourth base material 154. FIGS. 43A, 43B, and 43C show an example that a curved half cut 171 is implemented in the fourth base material 154. FIGS. 44A, 44B, and 44C show an example that the half cuts 171 in the width direction and in the longitudinal direction are implemented by combination in the fourth base material 154.

In other words, in the print tape 105, which is produced in a tape printer by using the print cassette 101 of the second embodiment, as described above, the third base material 152 adhered to the to-be-printed medium 133 with the third adhesive layer 151, so that the to-be-printed medium 133 and the third base material 152 are integrally formed (see FIG. 33A). Then, when part of the fourth base material 154 adhered to the third base material 152 with the fourth adhesive layer 153 is removed from the third base material 152 along the half cut 171 in order to stick the to-be-printed medium 133 to the adherend 161 (see FIGS. 33B and 39), part of the fourth adhesive layer 153 is exposed, so that part of the to-be-printed medium 133 integrated with the third base material 152 can be stuck to the adherend 161 with the part of the fourth adhesive layer 153 (see FIGS. 33C and 39).

At this time, the left portion of the fourth base material 154 still adhered to the to-be-printed medium 133 via the third base material 152, so that the to-be-printed medium 133 can thus keep the rigidity by the stiffness of the left portion of the fourth base material 154. Consequently, however thin the to-be-printed medium 133 is, the work of sticking part of the to-be-printed medium 133 to the adherend 161 securely without generation of wrinkles can be carried out. After that, because the left portion of the fourth adhesive layer 153 is exposed when the left portion of the fourth base material 154 is removed from the third base material 152 integrated with the to-be-printed medium 133, the left portion of the to-be-printed medium 133 integrated with the third base material 152 can be stuck to the adherend 161 with the left portion of the fourth adhesive layer 154. At this time, the to-be-printed medium 133 can thus keep the tension by part of the to-be-printed medium 133 stuck to the adherend 161. Consequently, however thin the to-be-printed medium 133 is, the work of sticking the left portion of the to-be-printed medium 133 to the adherend 161 securely without generation of wrinkles can be carried out.

In other words, by repeatedly releasing part of the fourth base material 154 from the third base material 152 integrated with the to-be-printed medium 133 along the half cut 171, the to-be-printed medium 133 can be stuck to the adherend 161 step by step. This facilitates the work of securely sticking the to-be-printed medium 133 to the adherend 161 without generation of wrinkles.

Further, the first base material 131 adhered to the to-be-printed medium 133 (see FIGS. 33B and 39), so that the to-be-printed medium 133 can thus keep the rigidity by the stiffness of the first base material 131. Consequently, however thin the to-be-printed medium 133 is, the work of sticking the to-be-printed medium 133 to the adherend 161 securely without generation of wrinkles can be carried out.

Figure 40:
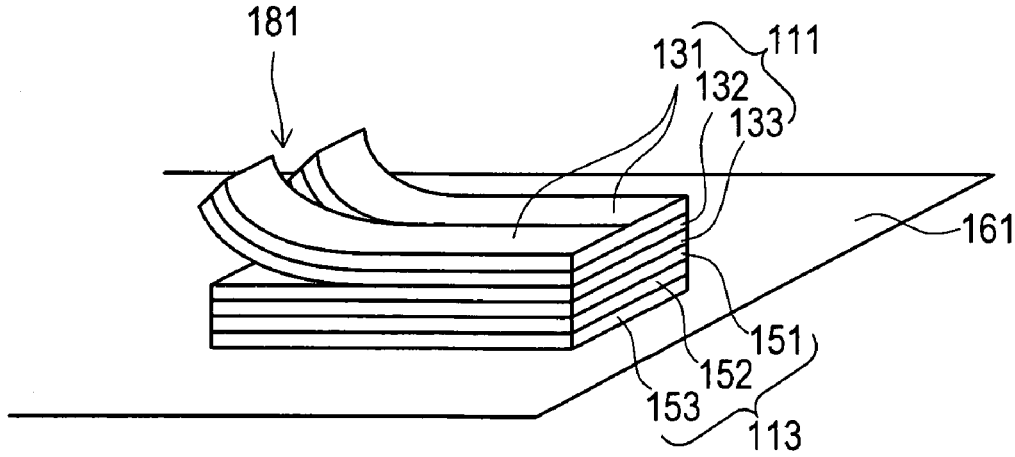
FIG. 40 is a perspective view illustrating another print tape according to the second embodiment.

After that, the first base material 131 can be removed easily from the to-be-printed medium 133 by the half cut 181 (see FIG. 40).

The various configurations of the half cuts 171 implemented in the fourth base material 154 preliminarily shown in FIGS. 41 to 44 may be adopted as configurations of the half cuts 181 to be implemented in the first base material 131 preliminarily.

In the print tape 105, which is produced in a tape printer by using the print cassette 101 of the second embodiment, the first base material 131 may be a transparent and colorless tape or a colored and transparent tape. In the case of the transparent and colorless first base material 131, this allows the ink 141 thermally transferred to the printing surface 111A (see FIG. 28 and other figures) of the first tape 111 to be visually identified therethrough, so that the top and bottom of the print tape 105 can be distinguished easily, thereby facilitating the work to stick the print tape 105 to the adherend 161. On the other hand, the colored and transparent first base material 131 allows not only the ink 141 thermally transferred to the printing surface 111A (see FIG. 28 and other figures) of the first tape 111 but also the presence of the first base material 131 itself to be identified visually. This can facilitate the work to stick the print tape 105 to the adherend 161 and the work to unstick the first base material 131.

On the other hand, if the first base material 131 is opaque, the ink 141 thermally transferred to the printing surface 111A (of the to-be-printed medium 133) of the first tape 111 (see FIG. 28 and other figures) cannot be recognized visually.

In other words, in the print tape 105, which is produced in a tape printer by using the print cassette 101 of the second embodiment, as described above, the first base material 131 adhered to the to-be-printed medium 133 with the first adhesive layer 132. Thus, if the first base material 131 is opaque, as described above, the ink 141 thermally transferred to the printing surface 111A (of the to-be-printed medium 133) of the first tape 111 (see FIG. 28 and other figures) cannot be recognized visually, the first base material 131 has the hiding performance. Accordingly, the to-be-printed medium 133 cannot be recognized visually via the first base material 131, so that the ink 141 (the printing content) of the to-be-printed medium 133 can be hidden. Consequently, the security effect to the printing content of the to-be-printed medium 133 is exerted.

Figure 37:
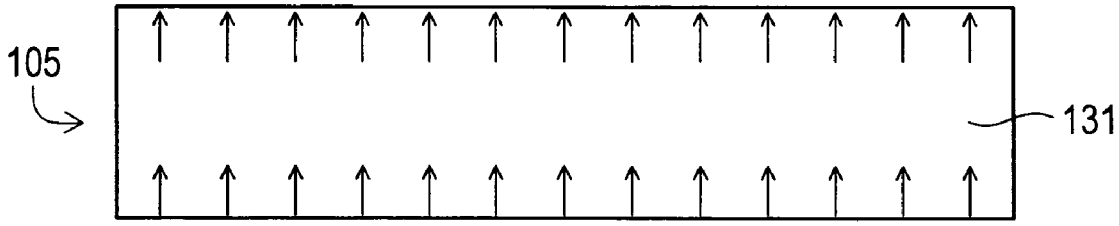
FIG. 37 is a plan view illustrating another print tape according to the second embodiment.
Figure 38:
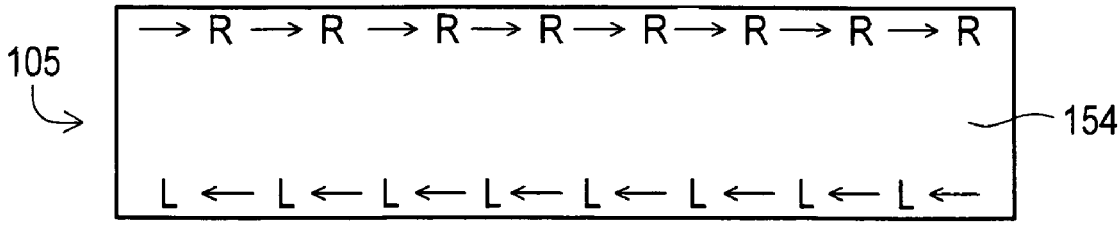
FIG. 38 is a plan view illustrating another print tape according to the second embodiment.

Unless the printing content of the to-be-printed medium 133 can be recognized visually, it is inconvenient when sticking the print tape 105 to the adherend 161. Thus, if a mark indicating the up-down direction or right-left direction of the printing surface 111A (of the to-be-printed medium 133) of the first tape 111 (see FIG. 28 and other figures) is provided on the first base material 131 or the fourth base material 154 preliminarily, it is convenient. FIG. 37 is a drawing showing an example that the mark (arrows) indicating the up-down direction of the printing surface 111A (of the to-be-printed medium 133) of the first tape 111 (see FIG. 28 and other figures) is provided on the first base material 131 preliminarily. Although the direction of this arrow indicates upward, it may indicate downward. Further, this arrow may be provided on the fourth base material 154. FIG. 38 is a drawing showing an example that the mark ("→R", "L←") indicating the right-left direction of the printing surface 111A (of the to-be-printed medium 133) of the first tape 111 (see FIG. 28 and other figures) is provided on the fourth base material 154 preliminarily. The direction of the mark "→R" indicates rightward. The direction of the mark "L←" indicates leftward. Further, these marks may be provided on the first base material 131 preliminarily.

The mark indicating the up-down direction or the right-left direction of the printing surface 111A (of the to-be-printed medium 133) of the first tape 111 (see FIG. 28 and other figures) is provided on the first base material 131 or the fourth base material 154 preliminarily. Thus, even if the to-be-printed medium 133 (the printing content) cannot be recognized visually, the up-down direction or the right-left direction of the to-be-printed medium 133 is never mistaken as long as this mark is used as a clue, so that the print tape 105 (to-be-printed medium 133) can be stuck to the adherend 161.

Figure 30B:
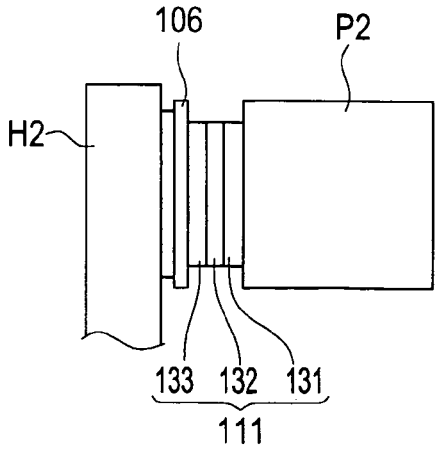
FIG. 30B is a cross-sectional view of the print cassette of thermal transfer type according to the second embodiment, from which the upper cassette case is removed, taken along a line F2-F2.

When the print cassette 101 of the second embodiment is set in a cassette mounting portion of a tape printer, the printing surface 111A (of the to-be-printed medium 133) of the first tape 111 (see FIG. 28 and other figures) is printed by the thermal head H2 of the tape printer designed to exist in the thermal head arrangement portion 120 and the platen P2 opposing the thermal head H2 as shown in FIG. 30A. At this time, the printing surface 111A (of the to-be-printed medium 133) of the first tape 111 (see FIG. 28 and other figures) opposes the thermal head H2 of the tape printer via the ink face of the ink ribbon 106 (see FIGS. 29 and 30A). FIG. 30B shows a view taken along the line F2-F2 of FIG. 30A in this state. As shown in FIG. 30B, the to-be-printed medium 133 of the first tape 111 is covered with the ink ribbon 106, so that the to-be-printed medium 133 is hidden from the thermal head H2 of the tape printer.

Further, the width of the ink ribbon 106 is wider than the width of the first tape 111. With this configuration, even if the ink ribbon 106 is shifted in its width direction at the time of printing, a state in which the to-be-printed medium 133 of the first tape 111 is hidden by the ink ribbon 106 from the thermal head H2 of the tape printer is maintained. Consequently, heat generated by the thermal head H2 of the tape printer at the time of printing is transmitted the to-be-printed medium 133 of the first tape 111 via the ink ribbon 106, so that the heat is not transmitted directly to the to-be-printed medium 133 of the first tape 111. Thus, because print is made on the to-be-printed medium 133 of the first tape 111 in a state of being unsusceptible to bad influence of heat, print quality is excellent and print appearance is also excellent.

The print tape 105 produced by a tape printer using the print cassette 101 of the second embodiment is of thermal transfer type which is printed by the thermal head H2 of the tape printer and the ink ribbon 106. However, even a thermosensitive type which does not require the ink ribbon 106 can obtain the above-described various effects (except an effect of blocking a bad influence by heat at the time of print by the ink ribbon 106 easily). Hereinafter, a case in which a thermosensitive type print tape 105 is produced by the tape printer will be described by applying this to the print cassette 101 of the second embodiment in order to mainly indicate a difference from the thermal transfer type print tape 105.

Figure 47:
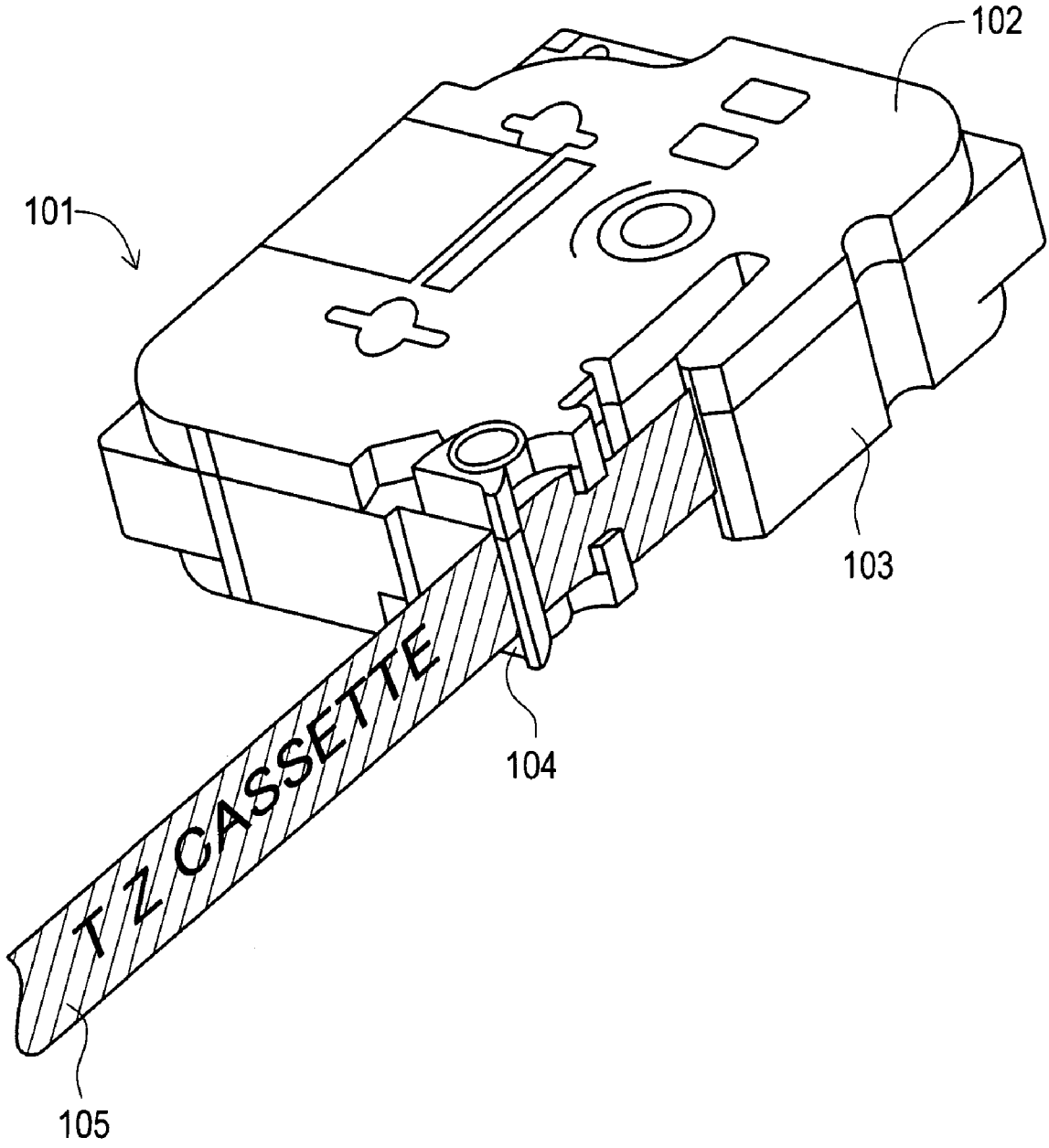
FIG. 47 is a perspective view of a print cassette of thermosensitive type according to the second embodiment.

FIG. 47 is a perspective view of the print cassette. As shown in FIG. 47, the print cassette 101 of the second embodiment comprises an upper cassette case 102 and a lower cassette case 103. The print tape 105 is discharged from the tape discharge port 104. In the meantime, the ink ribbon 106 shown in FIG. 29 does not exist here.

Figure 48:
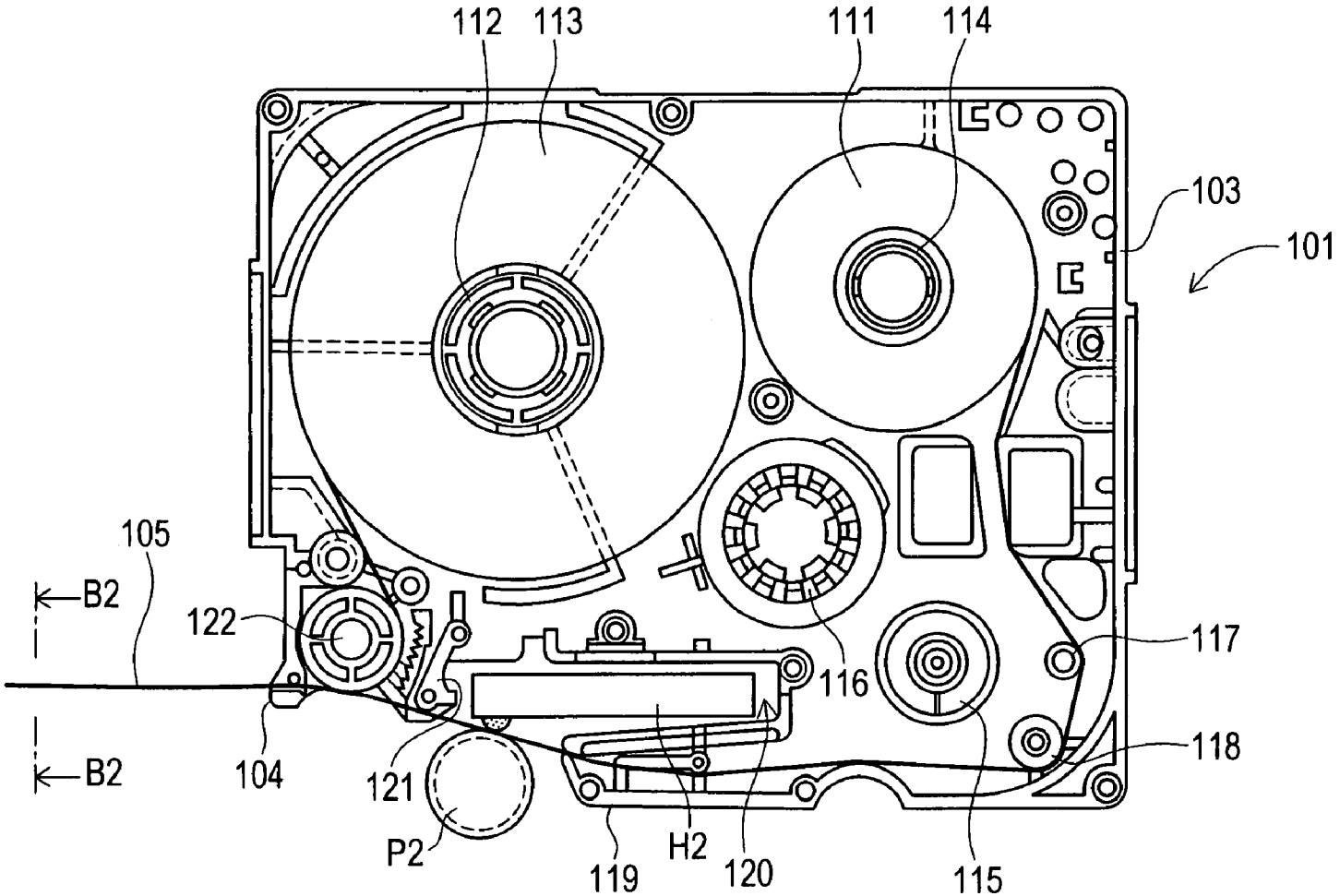
FIG. 48 is a plan view of the print cassette of thermosensitive type according to the second embodiment from which an upper cassette case is removed.

FIG. 48 is a plan view of the print cassette 101 from which the upper cassette case 102 (see FIG. 47) is removed. As shown in FIG. 48, a tape spool 112 on which a third tape 113 is wound, a film spool 114 on which a first tape 111 is wound, a ribbon supply spool 115 and a ribbon take-up spool 116 are provided on the lower cassette case 103 of the print cassette 101, being rotatable with cooperation of respective spool support members (not shown) formed on the upper cassette case 102 (see FIG. 47). No ink ribbon 106 exists on the ribbon supply spool 115 and the ribbon winding spool 116.

In the first tape 111, a first base material (a handling auxiliary film) composed of a "PET sheet" having a sheet thickness of approximately 70 μm and a to-be-printed medium (a thin laminated film) composed of an urethane sheet having a sheet thickness of approximately 10 μm are stacked and further, a first adhesive layer (a weak adhesive layer) is formed between the first base material and the to-be-printed medium by being coated with a first adhesive agent (a weak adhesive agent) in a thickness of approximately 25 μm. Then, the first tape 111 is wound on the film spool 114 with its to-be-printed medium side inside. In the first tape 111 wound in this way, an inside surface (the first face side of the to-be-printed medium) wound on the film spool 114 will be a printing surface. Therefore, the first tape 111 wound on the film spool 114 is guided to an arm part 119 formed on the lower cassette case 103, via a guide pin 117 provided on the lower cassette case 103 in an upright position and a rotatable guide roller 118. The first tape 111 is further guided out of the arm part 119, being exposed outside a thermal head attachment space 120. After that, the first tape 111 is discharged from the tape cassette 101 through the tape discharging port 104, via a guide member 121 and a feed roller 122.

Incidentally, when the print cassette 101 of the second embodiment is set in a cassette mount of a tape printer, a thermal head H2 of the tape printer exists on the thermal head arrangement portion 120. Then, the first tape 111 is nipped by the thermal head H2 and a platen roller P2 of the tape printer opposing the head H2.

On the other hand, the third tape 113 has a third adhesive layer which is formed by being coated the first face side of a third base material (a base film) composed of a "PET sheet" having a sheet thickness of approximately 12 μm with a third adhesive agent of approximately 20 μm thick. The second face side of the third base material is coated with a fourth adhesive agent so as to form a fourth adhesive layer having a thickness of approximately 16 μm. Further, a fourth base material (a release sheet) having a thickness of approximately 53 μm adhered to the fourth adhesive layer. The third tape 113 is wound on the tape spool 112 with the fourth base material side outside. The third tape 113 wound in this way is guided by the feed roller 122 while the adhesive-coated surface of the third adhesive layer and the printing surface of the first tape 111 are overlapped with each other. As a result, the third tape 113 adheres to the first tape 111, and discharged outside the print cassette 101 through the tape discharging port 104.

Figure 49:
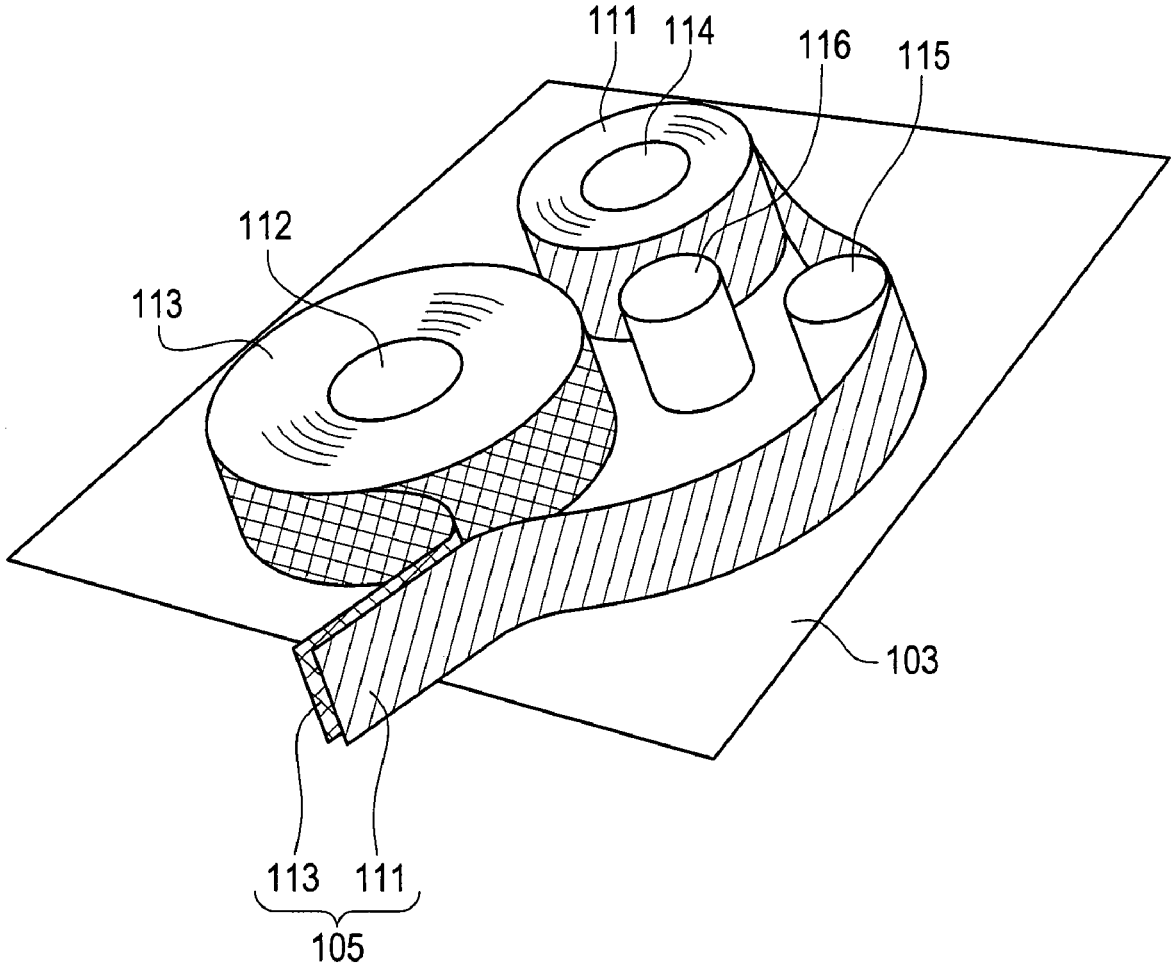
FIG. 49 is a schematic view illustrating a process of a first tape of thermosensitive type and a third tape being guided on a lower cassette case according to the second embodiment.

Accordingly, the print tape 105, which is composed of the first tape 111 and the third tape 113, is discharged from the tape discharging port 104 of the print cassette 101 FIG. 49 is a schematic view showing a process of the first tape 111 and the third tape 113 being guided on the lower cassette case 103 as described above.

Figure 46:
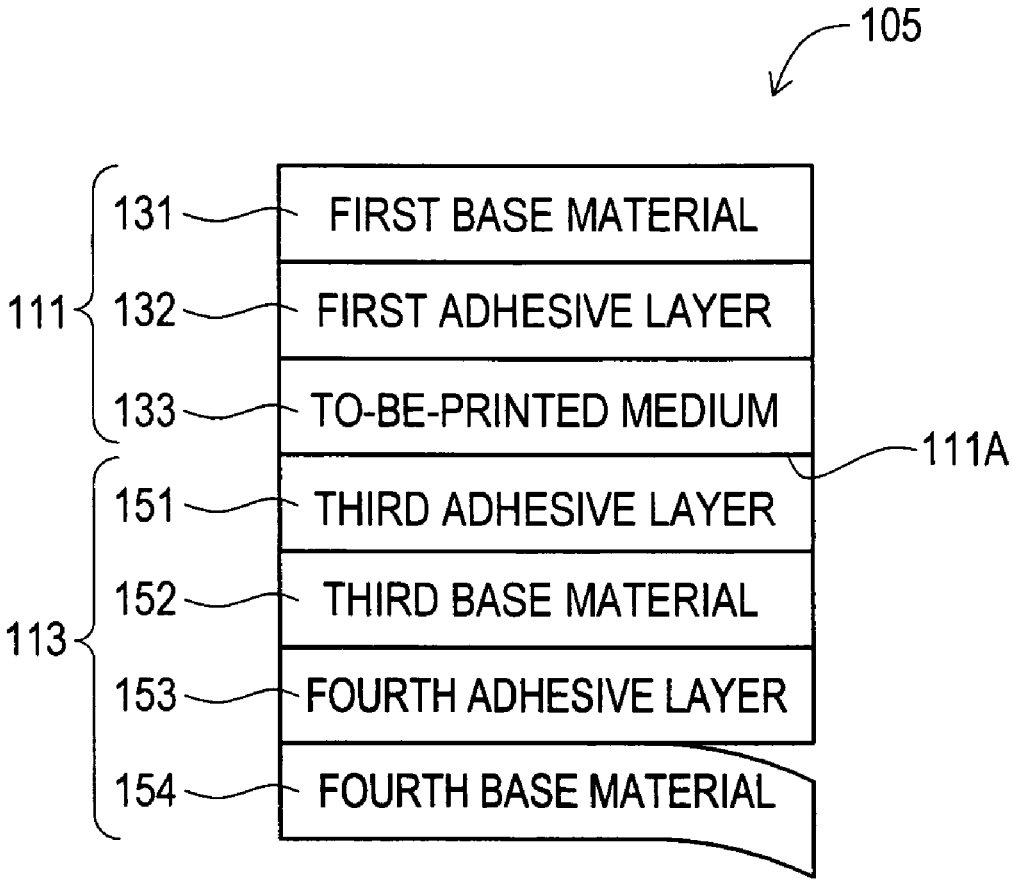
FIG. 46 is a cross-sectional view of a print tape of thermosensitive type according to the second embodiment, taken along a line B2-B2 illustrated in FIG. 48.

FIG. 46 is a cross-sectional view of the print tape 105 taken along the line B2-B2 shown in FIG. 48. As shown in FIG. 46, the print tape 105 is composed of the first tape 111 and the third tape 113. In the first tape 111, as described above, a first base material 131 composed of a "PET sheet" having a sheet thickness of approximately 70 μm and a to-be-printed medium 133 composed of an urethane sheet having a sheet thickness of approximately 10 μm are stacked and further, a first adhesive layer 132 is formed between the first base material 131 and the second face (side) of the to-be-printed medium 133 by being coated with a first adhesive agent in a thickness of approximately 25 μm.

The first face (side) of the to-be-printed medium 133 is coated with a thermosensitive coloring agent. A printing surface 111A of the first tape 111 is formed thereof.

When the print cassette 101 of the second embodiment is set on a cassette mounting portion of a tape printer, the thermosensitive coloring agent coated to the printing surface 111A (of the to-be-printed medium 133) of the first tape 111 (see FIG. 28 and other figures) is discolored by the thermal head H2 of the tape printer designed to exist in the thermal head arrangement portion 120 so as to print.

As described above, the third tape 113 is configured such that the first face side of the third base material 152 composed of a "PET sheet" having a sheet thickness of approximately 12 μm is coated with a third adhesive agent to form a third adhesive layer 151 in a thickness of approximately 20 μm and the second face side of the third base material 152 is coated with a fourth adhesive agent to form a fourth adhesive layer 153 in a thickness of approximately 16 μm. Further, a fourth base material 154 having a thickness of approximately 53 μm adhered to the fourth adhesive layer 153. The printing surface 111A of the first tape 111 and the third adhesive layer 151 are overlapped with each other, so that the third tape 113 adheres to the first tape 111 to compose the print tape 105.

Figure 50:
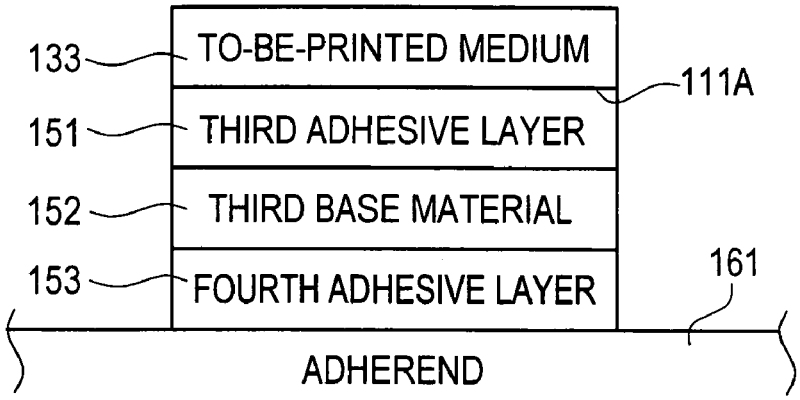
FIG. 50 is a cross-sectional view of the print tape of thermosensitive type according to the second embodiment being stuck to an adherend as a "laminated tape".

Further, the print tape 105, from which the fourth base material 154 is removed so that the adhesive-coated surface of the fourth adhesive layer 153 is exposed, can be stuck to an adherend. After that, the first base material 131 is slowly removed, and then, as shown in FIG. 50, the to-be-printed medium 133 can be stuck to an adherend 161 with the third adhesive layer 151, the third base material 152 and the fourth adhesive layer 153 of the third tape 113.

Figure 51:
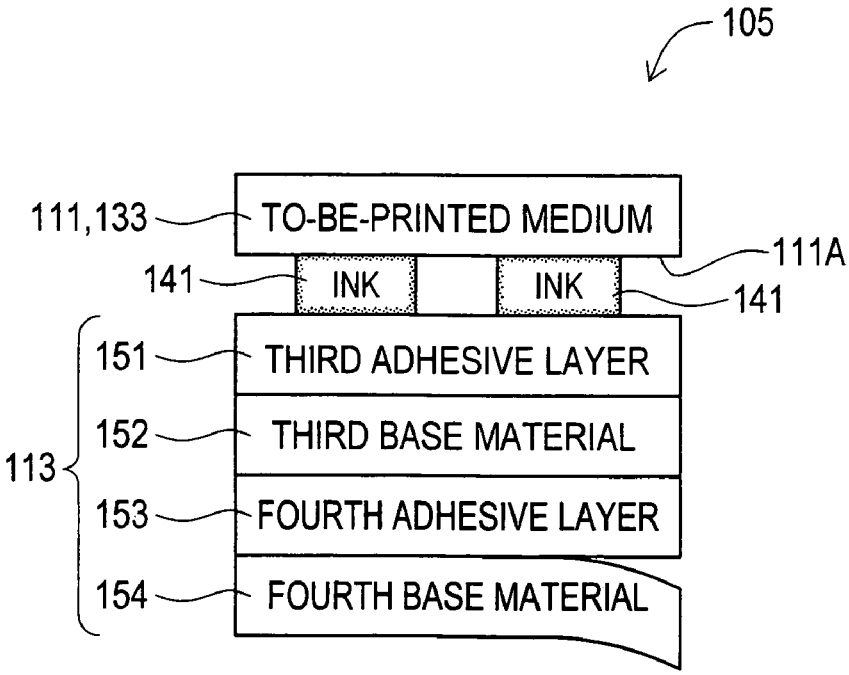
FIG. 51 is a cross-sectional view of a print tape not having a first base material according to the second embodiment, taken along the line B1-B1 illustrated in FIG. 30A.

Although in the print cassette 101 of the second embodiment, the first tape 111 is constituted by sticking the first base material 131 and the to-be-printed medium 133 with the first adhesive layer 132, the first tape 111 may be constituted of only the to-be-printed medium 133. FIG. 51 is a view showing a section of the print tape 105 produced using the first tape 111 constituted of only the to-be-printed medium 133.

In other words, the print tape 105 is constituted of the first tape 111 and the third tape 113 as shown in FIG. 51. As described above, the first tape 111 is constituted only of the to-be-printed medium 133 composed of an urethane sheet having a sheet thickness of approximately 10 μm. As described above, the third tape 113 is configured such that the first face side of the third base material 152 composed of a "PET sheet" having a sheet thickness of approximately 12 μm is coated with a third adhesive agent to form the third adhesive layer 151 in a thickness of approximately 20 μm and the second face side of the third base material 152 is coated with a fourth adhesive agent to form the fourth adhesive layer 153 in a thickness of approximately 16 μm. Further, the fourth base material 154 having a thickness of approximately 53 μm adhered to the fourth adhesive layer 153. The printing surface 111A of the first tape 111 on which ink 141 is put and the third adhesive layer 151 are overlapped with each other, so that the third tape 113 adheres to the first tape 111 to compose the print tape 105.

Although in FIG. 51, the to-be-printed medium 133 and the third adhesive layer 151 appear to be in a floating state by the thickness of the ink 141, actually, the both adhered directly to each other because the thickness of the ink 141 is thin.

Figure 52A:
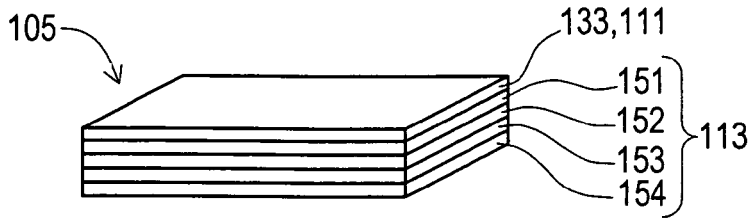
FIG. 52A is an explanatory diagram illustrating the way of using the print tape not having the first base material according to the second embodiment.
Figure 52B:
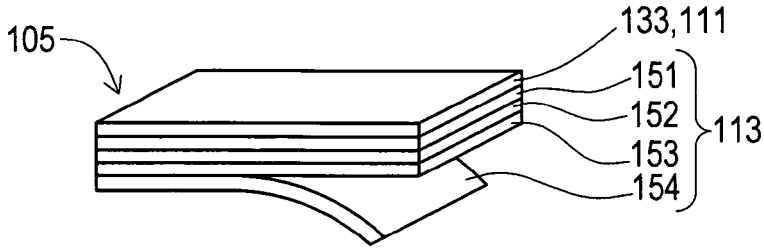
FIG. 52B is an explanatory diagram illustrating the way of using the print tape not having the first base material according to the second embodiment.
Figure 52C:
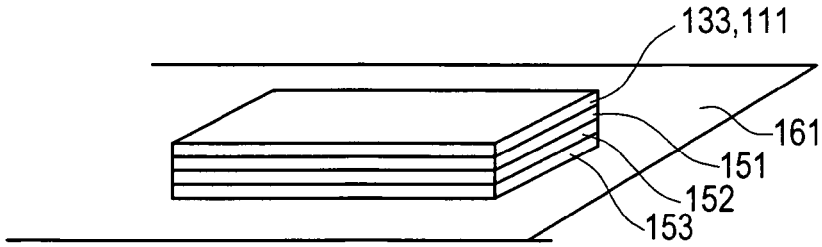
FIG. 52C is an explanatory diagram illustrating the way of using the print tape not having the first base material according to the second embodiment.

Next, the way of using the print tape 105 will be explained with reference to FIGS. 52A to 52C.

The print tape 105 is discharged from the tape discharging port 104 of the print cassette 101 of the second embodiment, the print cassette 101 being set in a cassette mount of a tape printer. The print tape 105 is cut with the cutter device of the tape printer to be a strip-formed tape composed of the first tape 111 (the to-be-printed medium 133) and the third tape 113 (the third adhesive layer 151, the third base material 152, the fourth adhesive layer 153 and the fourth base material 154) as shown in FIG. 52A. As shown in FIG. 52B, the fourth base material 154 of the third tape 113 is removed, so that the fourth adhesive layer 153 of the third tape 113 is exposed. Further, the fourth adhesive layer 153 of the third tape 113 is stuck to the adherend 161 as shown in FIG. 52C.

Figure 53:
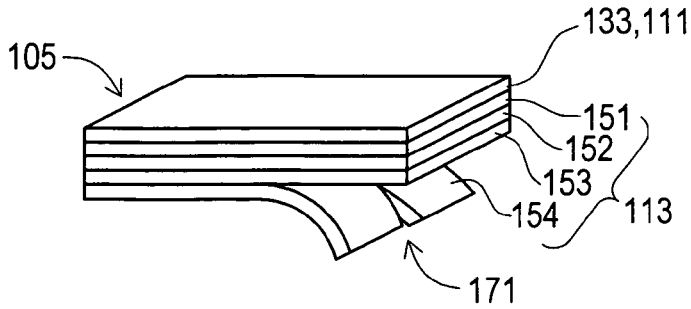
FIG. 53 is a perspective view illustrating the print tape not having the first base material according to the second embodiment.

Further, as shown in a perspective view of FIG. 53, the fourth base material 154 of the third tape 113 comprising the print tape 105 may preliminarily be provided with a half cut 171. This configuration can facilitate the work to remove the fourth base material 154 of the third tape 113. Then, the half cut 171 to be implemented preliminarily in the fourth base material 154 may be of various configurations showing in FIGS. 41 to 44 as described above and even in this case, the above-described effect which the half cut 171 exerts can be obtained.

Figure 54:
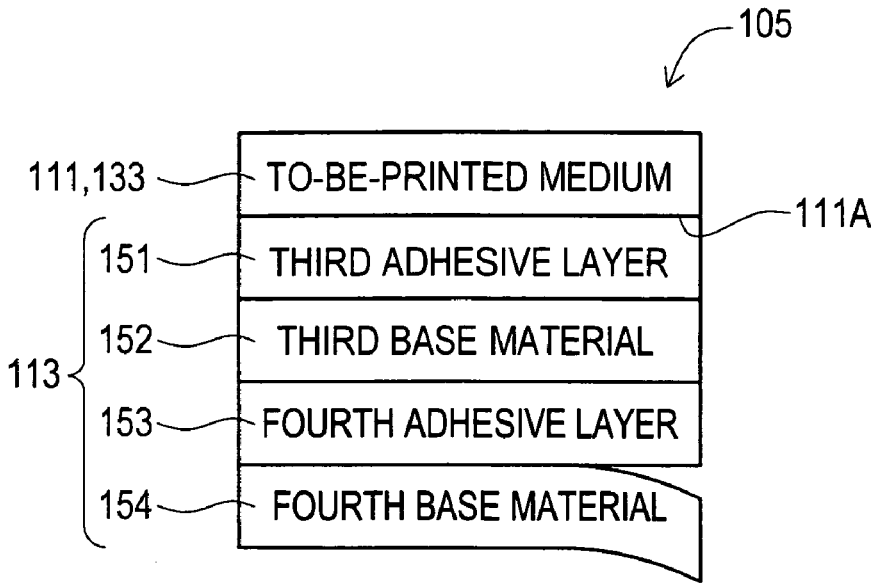
FIG. 54 is a cross-sectional view of the print tape not having the first base material according to the second embodiment being stuck to an adherend as a "laminated tape".

The print tape 105 produced using the first tape 111 constituted only of the to-be-printed medium 133 is not limited to the thermal transfer type but may be of the thermosensitive type. FIG. 54 is a view showing the section of such a thermosensitive type print tape 105.

In other words, as shown in FIG. 54, the thermosensitive type print tape 105 is constituted of a first tape 111 and a third tape 113. As described above, the first tape 111 is constituted only of a to-be-printed medium 133 composed of an urethane sheet having a sheet thickness of approximately 10 μm. At this point, the first face (side) of the to-be-printed medium 133 is coated with a thermosensitive coloring agent. A printing surface 111A of the first tape 111 is constituted thereof. As described above, the third tape 113 is configured such that the first face side of a third base material 152 composed of a "PET sheet" having a sheet thickness of approximately 12 μm is coated with a third adhesive agent to form a third adhesive layer 151 in a thickness of approximately 20 μm and the second face side of the third base material 152 is coated with a fourth adhesive agent to form a fourth adhesive layer 153 in a thickness of approximately 16 μm. Further, a fourth base material 154 having a thickness of approximately 53 μm adhered to the fourth adhesive layer 153. The printing surface 111A of the first tape 111 and the third adhesive layer 151 are overlapped with each other, so that the third tape 113 adheres to the first tape 111 to compose the thermosensitive type print tape 105.

Although in the second embodiment, the print tape 105 produced by a tape printer using the print cassette 101, even a sheet-like print tape (including a wide tape-like one) which cannot be produced using the tape printer in which the print cassette 101 is set can obtain the above-described various effects (excluding effects exerted within the print cassette 101). Further, although in this embodiment, the width of the ink ribbon 106 is wider than the width of the print tape 105, the width of the ink ribbon 106 may be equal to the width of the print tape 105.

Preferably, the thickness of the to-be-printed medium 133 is 2.5 μm to 30 μm.

Figure 56:
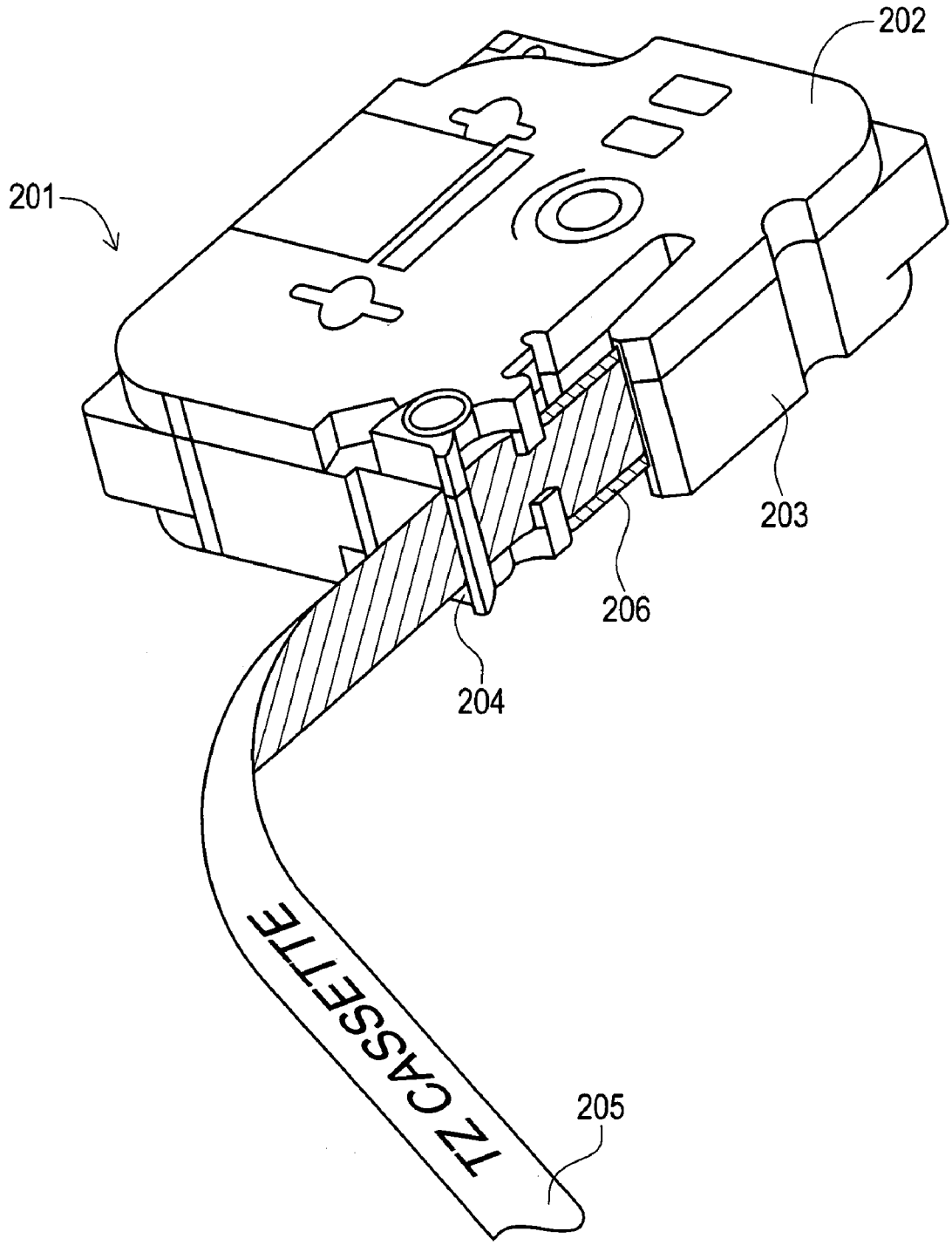
FIG. 56 is a perspective view of a print cassette of thermal transfer type according to the third embodiment.

Hereinafter, the print cassette of the present disclosure will be described in detail based on the third embodiment of the present disclosure with reference to the drawings. FIG. 56 is a perspective view of a print cassette. As shown in FIG. 56, a print cassette 201 of the third embodiment comprises an upper cassette case 202 and a lower cassette case 203. A print tape 205 is discharged from a tape discharging port 204. It is noted that a reference numeral 206 indicates an ink ribbon. The width of the ink ribbon 206 is wider than the width of the print tape 205.

FIG. 57A is a plan view of the print cassette 201 from which the upper cassette case 202 (see FIG. 56) is removed. As shown in FIG. 57A, a tape spool 212 on which a second tape 213 is wound, a film spool 214 on which a first tape 211 is wound, a ribbon supply spool 215 on which the ink ribbon 206 is wound, and a ribbon take-up spool 216 are provided on the lower cassette case 203 of the print cassette 201, being rotatable with cooperation of respective spool support members (not shown) formed on the upper cassette case 202 (see FIG. 56).

The first tape 211 has a first adhesive layer which is formed by being coated the second face side of a to-be-printed medium (a thin base film) composed of an urethane sheet having a sheet thickness of approximately 10 μm to 15 μm with an adhesive agent of approximately 16 μm thick. Further, a release sheet adhered to the first adhesive layer. Then, an inside surface (the first face side of the to-be-printed medium) wound on the film spool 214 will be a printing surface. Therefore, the first tape 211 wound on the film spool 214 is guided to an arm part 219 formed on the lower cassette case 203, via a guide pin 217 provided on the lower cassette case 203 in an upright position and a rotatable guide roller 218. The first tape 211 is further guided out of the arm part 219, being exposed outside a thermal head attachment space 220. After that, the first tape 211 is discharged from the tape cassette 201 through the tape discharging port 204, via a guide member 221 and a feed roller 222.

The ink ribbon 206 is wound on the ribbon supply spool 215 with an ink-coated surface side inside. The ink ribbon 206 wound on the ribbon supply spool 215 in this way is exposed out of the arm part 219 outside the thermal head attachment space 220. The ink ribbon 206 is further guided while the ink-coated surface and the printing surface of the first tape 211 are overlapped with each other. After that, the ink ribbon 206 is guided along an exterior of the guide member 221, thereby getting separated from the printing surface of the first tape 211. Finally, the ink ribbon 206 is taken up by the ribbon take-up spool 216.

Incidentally, when the print cassette 201 of the third embodiment is set in a cassette mount of a tape printer, a thermal head H3 of the tape printer exists on the thermal head arrangement portion 220. Then, the first tape 211 and the ink ribbon 206 are nipped by the thermal head H3 and a platen roller P3 of the tape printer opposing the head H3.

On the other hand, a second tape 213 has a second adhesive layer (a weak adhesive layer) which is formed by being coated with the first face side of a second base material (a handling auxiliary film) composed of a "PET sheet" with a second adhesive agent (a weak adhesive agent) of approximately 25 μm thick. The second tape 213 is wound on the tape spool 212 with the second base material side outside. The second tape 213 wound in this way is guided by the feed roller 222 while the adhesive-coated surface of the second adhesive layer and the printing surface of the first tape 211 are overlapped with each other. As a result, the second tape 213 adheres to the first tape 211, and discharged outside the print cassette 201 through the tape discharging port 204. Accordingly, the printing surface of the first tape 211 is an adhesion object surface of the second adhesive layer of the second tape 213.

Figure 58:
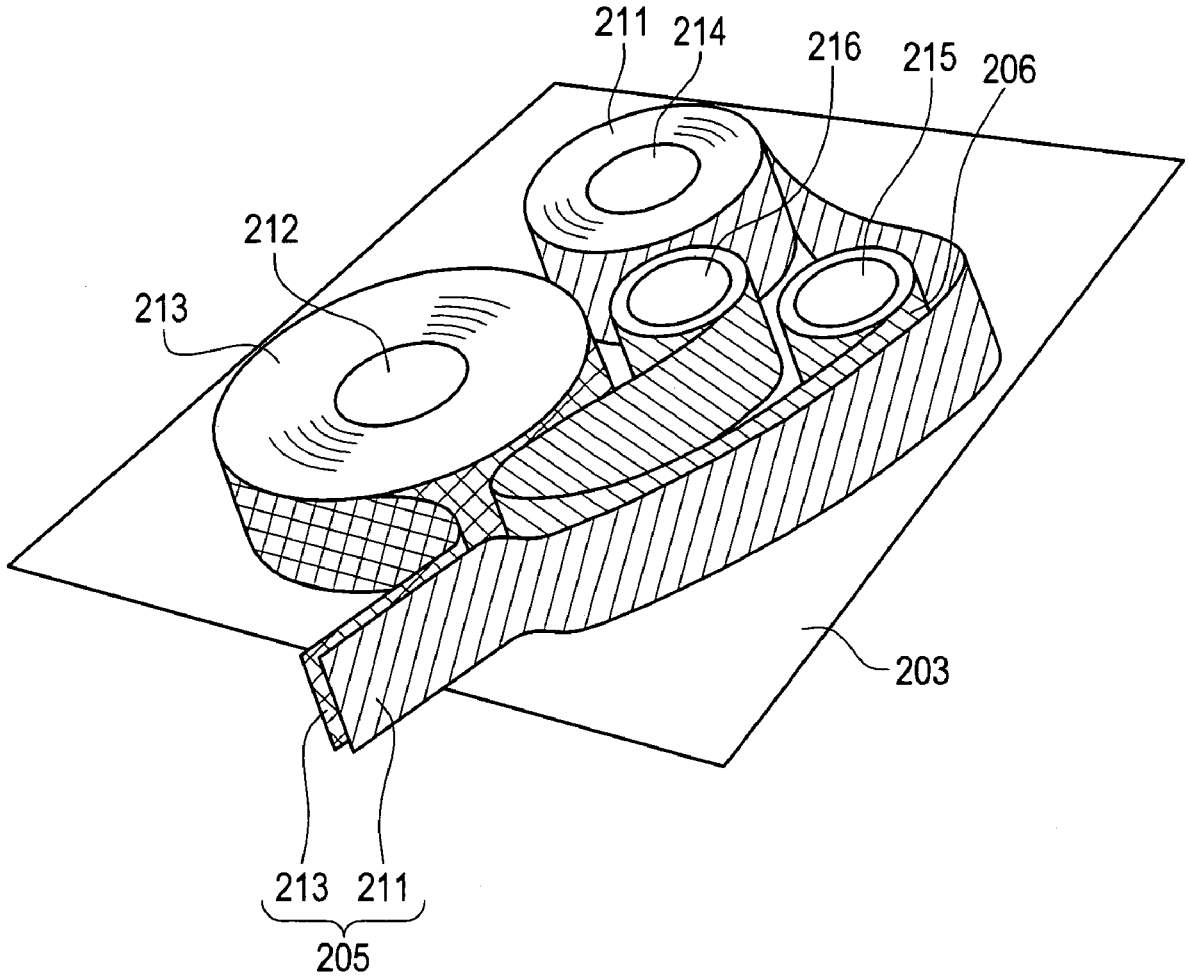

Accordingly, the print tape 205, which is composed of the first tape 211 and the second tape 213, is discharged from the tape discharging port 204 of the print cassette 201. FIG. 58 is a schematic view showing a process of the second tape 213, the first tape 211 and the ink ribbon 206 being guided on the lower cassette case 203 as described above.

Figure 55:
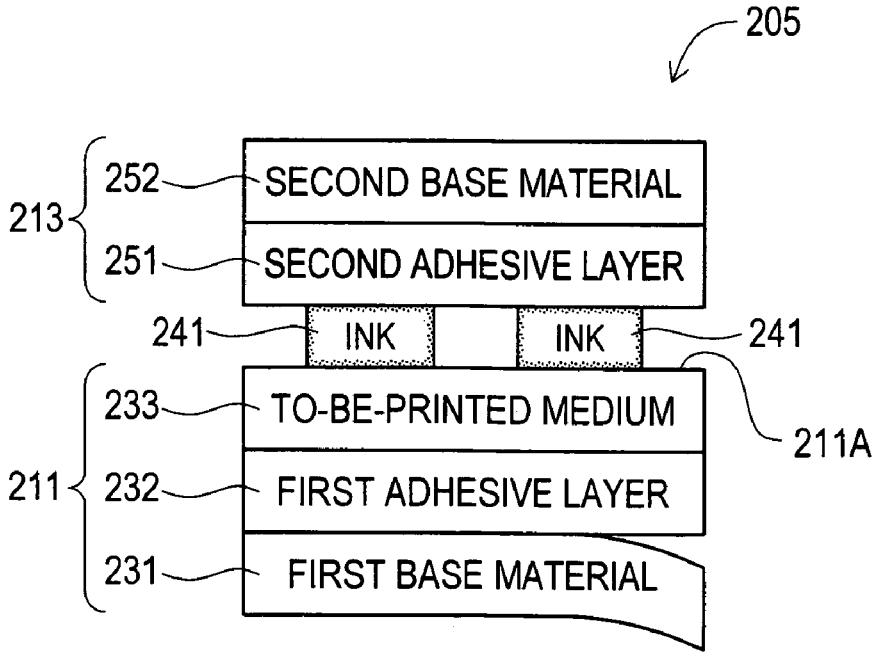
FIG. 55 is a cross-sectional view of a print tape of thermal transfer type according to a third embodiment, taken along a line C1-C1 illustrated in FIG. 57A.

FIG. 55 is a cross-sectional view of the print tape 205 taken along the line C1-C1 shown in FIG. 57A. As shown in FIG. 55, the print tape 205 is composed of the first tape 211 and the second tape 213. At this point, as described above, the second tape 213 has a second adhesive layer 251 which is formed by being coated with the first face side of the second base material 252 composed of a "PET sheet" with the second adhesive agent of approximately 25 μm thick. As described above, the first tape 211 has a first adhesive layer 232 which is formed by being coated with the second face side of the to-be-printed medium 233 composed of a urethane sheet having a sheet thickness of approximately 10 μm to 15 μm with the first adhesive agent of approximately 16 μm thick. Further, the first base material 231 is adhered to the to-be-printed medium 233. Then, a printing surface 211A (of the to-be-printed medium 233) of the first tape 211 on which ink 241 is put and the second adhesive layer 251 are overlapped with each other, so that the first tape 211 adheres to the second tape 213 to compose the print tape 205. Accordingly, the printing surface 211A (of the to-be-printed medium 233) of the first tape 211 is an adhesion object surface of the second adhesive layer 251 of the second tape 213.

Figure 59:
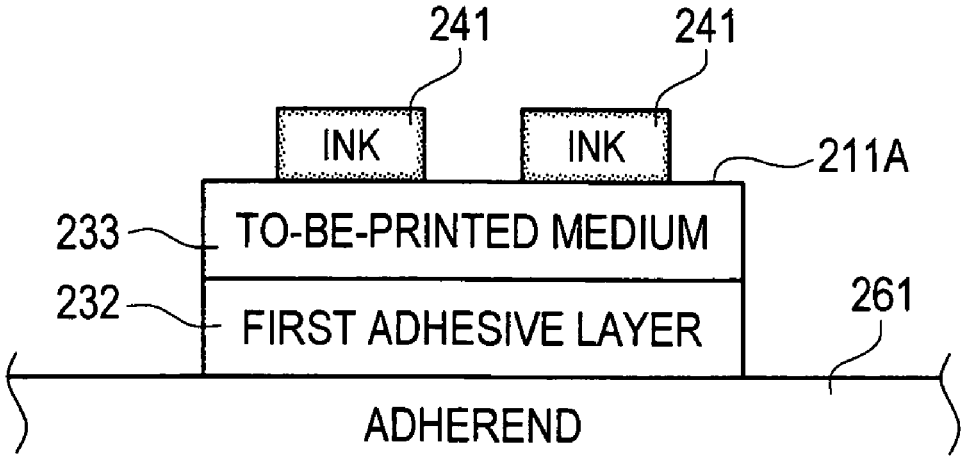

Further, the print tape 205, from which the first base material 231 is removed so that the adhesive-coated surface of the first adhesive layer 232 is exposed, can be stuck to an adherend. After that, the second tape 213 is slowly removed, and then, as shown in FIG. 59, the to-be-printed medium 233 can adhere to an adherend 261 with the first adhesive layer 232, along with the ink 241 which is thermally transferred to the printing surface 211A thereof.

Although in FIG. 55, the to-be-printed medium 233 and the second adhesive layer 251 appear to be in a floating state by the thickness of the ink 241, actually, the both adhered directly to each other because the thickness of the ink 241 is thin.

In order that the to-be-printed medium 233 on which the ink 241 is thermally transferred to the printing surface 211A adheres to the second tape 213 as described above, the second adhesive agent making up the second adhesive layer 251 includes a copolymer as a main material, made by the copolymerization of monomers of any series such as an acrylic series, a rubber series and a silicone series. The second adhesive agent can be made with or without various kinds of additives (such as a crosslinking agent, a tackifier, a softener, a fixture and a pigment). The second adhesive agent having a low adhesive property is adopted since this is used for temporary adhesion and a part which will be removed eventually.

On the other hand, the adhesive agent making up the first adhesive layer 232 includes a copolymer as a main material, made by the copolymerization of monomers of any series such as an acrylic series, a rubber series and a silicone series. The adhesive agent can be made with or without various kinds of additives (such as a crosslinking agent, a tackifier, a softener, a fixture and a pigment). The adhesive agent having an adhesive property appropriate to the adherend 261 is adopted.

Incidentally, the print cassette 201 is set in a cassette mount of a tape printer to produce the print tape 205. In the cassette mount of the tape printer, there is provided a cutter device (not shown) having a cutter to cut the print tape 205 discharged from the tape discharging port 204 of the print cassette 201. The structure of the print cassette 201 as explained with reference to FIG. 56 and other figures and the tape printer in which the print cassette 201 is installed to produce the print tape 205 have been publicly known, so the detailed explanation of the process for producing the print tape 205 with the print cassette 201 and the tape printer is omitted.

Next, the way of using the print tape 205 will be explained with reference to FIGS. 60A to 60E.

Figure 60A:
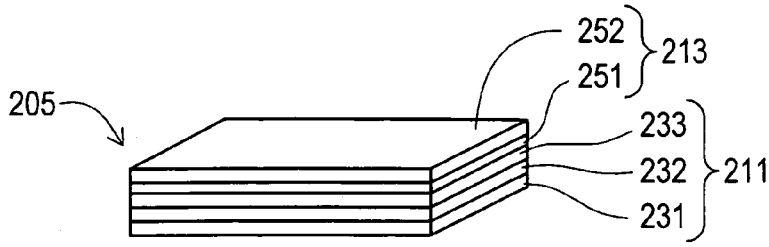
FIG. 60A is an explanatory diagram illustrating the way of using the print tape according to the third embodiment.
Figure 60B:
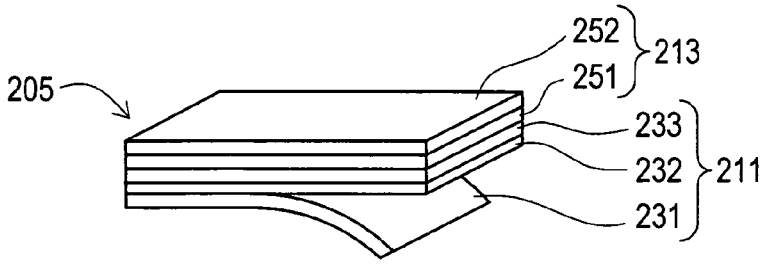
FIG. 60B is an explanatory diagram illustrating the way of using the print tape according to the third embodiment.
Figure 60C:
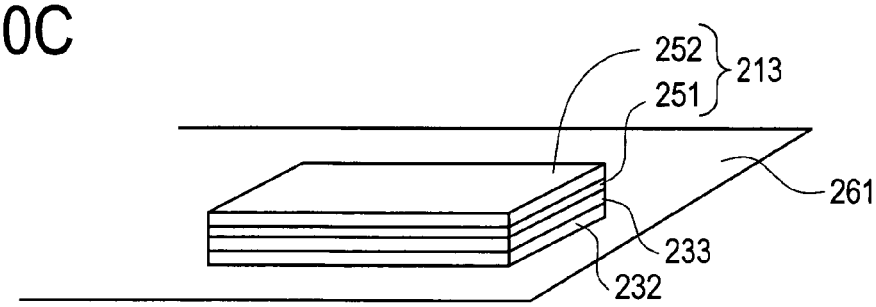
FIG. 60C is an explanatory diagram illustrating the way of using the print tape according to the third embodiment.

The print tape 205 is discharged from the tape discharging port 204 of the print cassette 201 of the present embodiment, the print cassette 201 being set in a cassette mount of a tape printer. The print tape 205 is cut with the cutter device of the tape printer (not shown) to be a strip-formed tape composed of the first tape 211 (the first base material 231, the first adhesive layer 232 and the to-be-printed medium 233) and the second tape 213 (the second adhesive layer 251 and the second base material 252) as shown in FIG. 60A. As shown in FIG. 60B, the first base material 231 of the first tape 211 is removed, so that the first adhesive layer 232 of the first tape 211 is exposed. Further, the first adhesive layer 232 of the first tape 211 is stuck to the adherend 261 as shown in FIG. 60C.

Figure 60D:
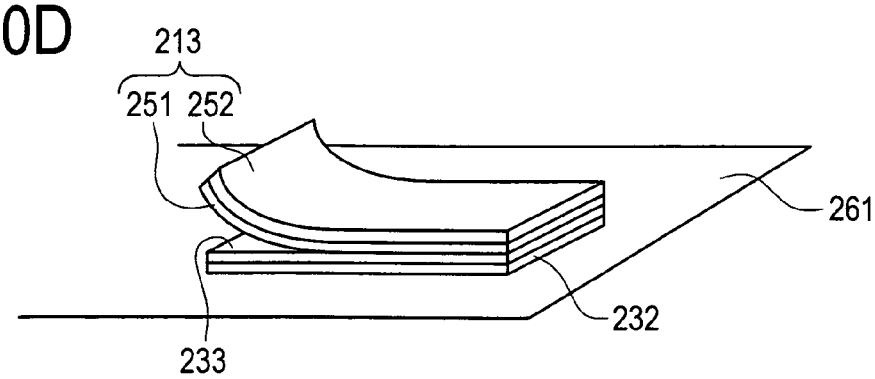
FIG. 60D is an explanatory diagram illustrating the way of using the print tape according to the third embodiment.
Figure 60E:
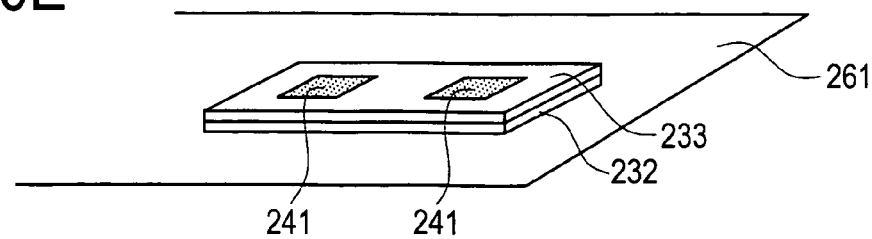
FIG. 60E is an explanatory diagram illustrating the way of using the print tape according to the third embodiment.

As shown in FIG. 60D, the second base material 252 is slowly removed from the adherend 261. At this time, the second adhesive layer 251 is also removed with the second base material 252, thus only the second tape 213 can be removed therefrom. Finally, as shown in FIG. 60E, the to-be-printed medium 233 on which the ink 241 is thermally transferred is in a state of adhering to the adherend 261 with the first adhesive layer 232. The ink 241 has been thermally transferred from the ink ribbon 206 (see FIG. 57A and other figures) to the printing surface 211A (of the to-be-printed medium 233) of the first tape 211 (see FIG. 55 and other figures) with the tape printer.

As described in detail above, the print cassette 201 of the third embodiment is set in a cassette mount of a tape printer to produce the print tape 205 which is discharged from the tape printer.

The print tape 205 discharged from the tape printer is cut by the cutter device of the tape printer, and then the first base material 231 is removed from the first tape 211 adhered to the second tape 213 (see FIG. 60B). The exposed first adhesive layer 232 of the first tape 211 is stuck to the adherend 261 (see FIG. 60C). Further, the second tape 213 is slowly removed from the adherend 261 (see FIG. 60D), so that the second tape 213 is removed and the to-be-printed medium 233 is left on the adherend 261 with the ink 241. As shown in FIG. 59, the to-be-printed medium 233 having the printing surface 211A, on which the ink 241 thermally transferred, exposed on the first face side can be stuck to the adherend 261 with the first adhesive layer 232. As a result, a "non-laminated tape" can be stuck to the adherend 261 (see FIG. 60E).

The to-be-printed medium 233 adhered to the first base material 231 with the first adhesive layer 232 to take the form of the first tape 211 (see FIG. 55) which is wound on the film spool 214 within the print cassette 201 of the third embodiment as shown in FIG. 57A. From this state, the to-be-printed medium 233 adheres to the second tape 213 with the second tape 213 and the second adhesive layer 251 thereof to be the print tape 205, which is discharged through the tape discharging port 204. Thus, the to-be-printed medium 233 can assure the feeding performance within the print cassette 201 of the third embodiment even though the to-be-printed medium 233 is thin.

As shown in FIGS. 60A and 60B, the second tape 213 is in a state of adhering to the first tape 211 when stuck to the adherend 261. The second tape 213 can thus keep the rigidity at least by the thickness of the second tape 213. Accordingly, however thin the to-be-printed medium 233 composing the "non-laminated tape" is, the "non-laminated tape" can easily be stuck to the adherend 261 as shown in FIG. 60.

When a sticking surface of the adherend 261 is the curved surface, in order to contact closely the second tape 213 to the sticking surface, the second tape 213 should be thin and stretch.

Preferably, the thickness of the second tape 213 is 30 μm to 50 μm, in the point of view which is the keeping of the easiness of the work of sticking.

Particularly, in the third embodiment, the to-be-printed medium 233 is thicker than the second base material 252. Accordingly, however thin the to-be-printed medium 233 is, the second base material 252 can easily be removed.

The second adhesive layer 251 which adheres the second base material 252 to the to-be-printed medium 233 is formed by being coated with the first adhesive agent to the first side of the second base material 252 in a thickness of approximately 25 μm. At this point, although the second adhesive agent may be filled to an entire range of the second base material 252, the second adhesive agent may be coated in a predetermined pattern so that the first adhesive agent is dispersed uniformly.

Figure 73A:
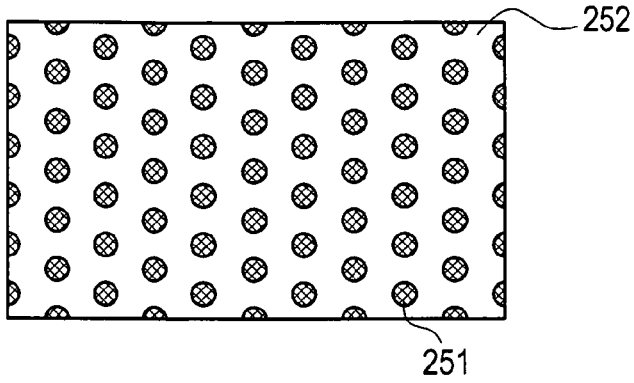
Figure 73B:
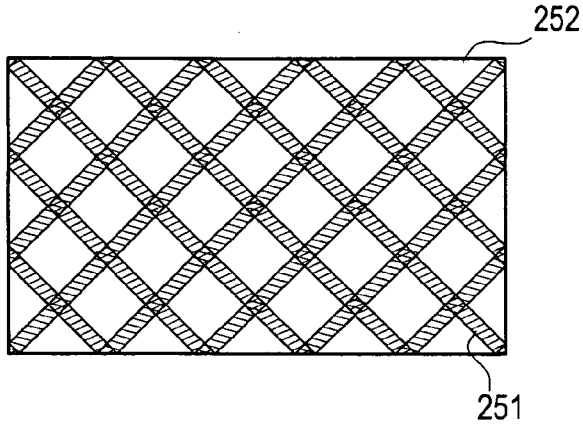
Figure 73C:
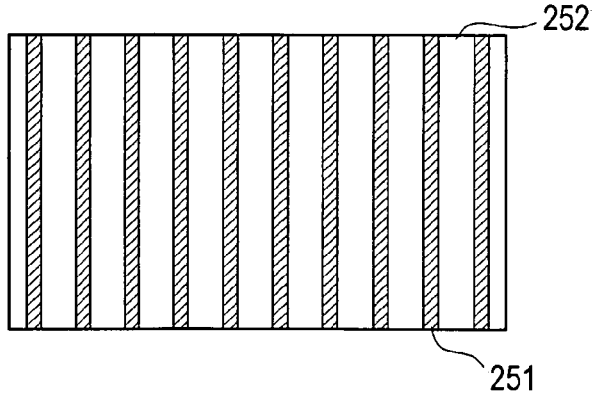
Figure 73D:
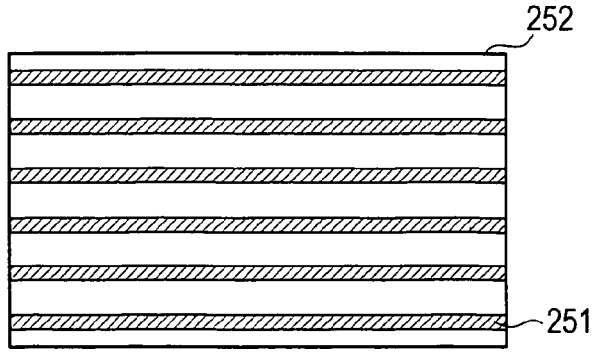

FIGS. 73A to 73D are views showing examples of coating patterns of the second adhesive agent to be coated for forming the second adhesive layer 251. FIG. 73A shows an example that the second adhesive layer 251 is formed in polka-dot pattern by being coated with the dot-like second adhesive agent to the second base material 252 intermittently (cyclically). FIG. 73B shows an example that the linear second adhesive agent is coated to the second base material 252 intermittently (cyclically) at an inclined angle so as to form the second adhesive layer 251 into a grid pattern. FIG. 73C shows an example that the linear second adhesive agent is coated to the second base material 252 intermittently (cyclically) in the width direction so as to form the second adhesive layer 251 in a striped pattern. FIG. 73D shows an example that the linear second adhesive agent is coated to the second base material 252 intermittently (cyclically) in the longitudinal direction so as to form the second adhesive layer 251 into a striped pattern.

In other words, with regard to the print tape 205 which is produced in a tape printer by using the print cassette 201 of the third embodiment, as described above, the to-be-printed medium 233 adhered to the second base material 252 with the second adhesive layer 251. The print tape 205 can thus keep the rigidity at least by the thickness of the second base material 252. Accordingly, the feeding performance within the print cassette 201 of the third embodiment can be secured. At this point, if the second adhesive agent which forms the second adhesive layer 251 is dispersed uniformly in a predetermined pattern as shown in FIGS. 73A, 73B, 73C and 73D, as compared with a case where the second adhesive agent is coated to the entire surface, the second adhesive agent which is to form the second adhesive layer 251 is not pushed out from between the to-be-printed medium 233 and the second base material 252 easily. Thus, the feeding performance of the to-be-printed medium 233 within the print cassette 201 of the third embodiment is stabilized further.

As described above, when the print tape 205 (that is, the to-be-printed medium 233) is stuck to the adherend 261, the second base material 252 adhered to the to-be-printed medium 233 with the second adhesive layer 251 so that the to-be-printed medium 233 can thus keep the rigidity at least by the thickness of the second base material 252. Accordingly, however thin the to-be-printed medium 233 is, the to-be-printed medium 233 can easily be stuck to the adherend 261 (see FIGS. 60A, 60B and 60C). At this point, if the second adhesive agent which forms the second adhesive layer 251 is dispersed uniformly in a predetermined pattern as shown in FIGS. 73A, 73B, 73C and 73D, it is easy to create a clue for releasing the second base material 252 from the to-be-printed medium 233 even if the to-be-printed medium 233 is kept stuck to the adherend 261 together with the second base material 252. After that, the second base material 252 can be removed from the to-be-printed medium 233 easily (see FIG. 60D).

Further, when the to-be-printed medium 233 is stuck to the adherend 261 with the first adhesive layer 232, the total thickness of the to-be-printed medium 233 and the first adhesive layer 232 is as thin as approximately 26 μm to 31 μm. Therefore, the outline of the to-be-printed medium 233 is hardly visible if it is transparent and colorless, so that the ink 241 (printed contents) on the to-be-printed medium 233 can be prominent. Additionally, the total weight of the to-be-printed medium 233 and the first adhesive layer 232 is so light as to reduce adverse effect on rotational balance of the adherend 261 as a body of rotation such as a CD and a DVD.

Further, when stuck to the curved surface of the adherend 261, the to-be-printed medium 233 is as thin as 10 μm to 15 μm, thus the to-be-printed medium 233 can be prevented from being gradually unstuck. This effect can be achieved even if the thickness of the to-be-printed medium 233 is as large as 30 μm.

The disclosure may be embodied in other specific forms without departing from the essential characteristics thereof.

Figure 61:
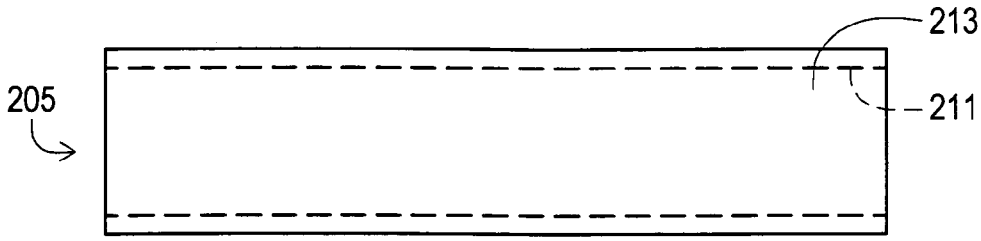
FIG. 61 is a plan view illustrating another print tape according to the third embodiment.
Figure 62:
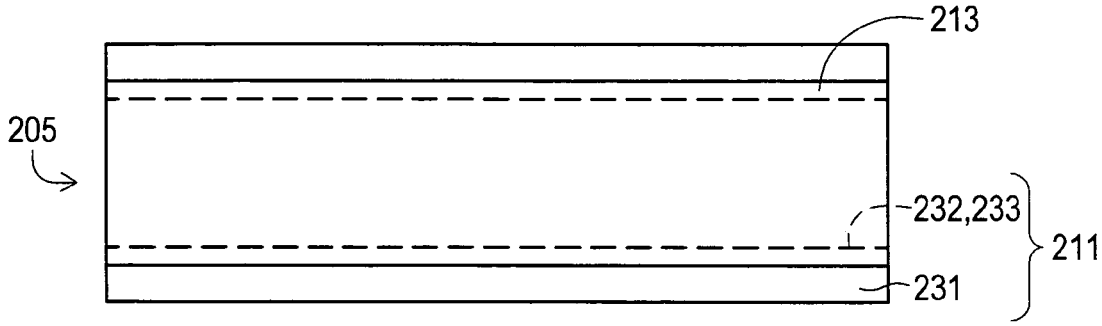
FIG. 62 is a plan view illustrating another print tape according to the third embodiment.
Figure 63:
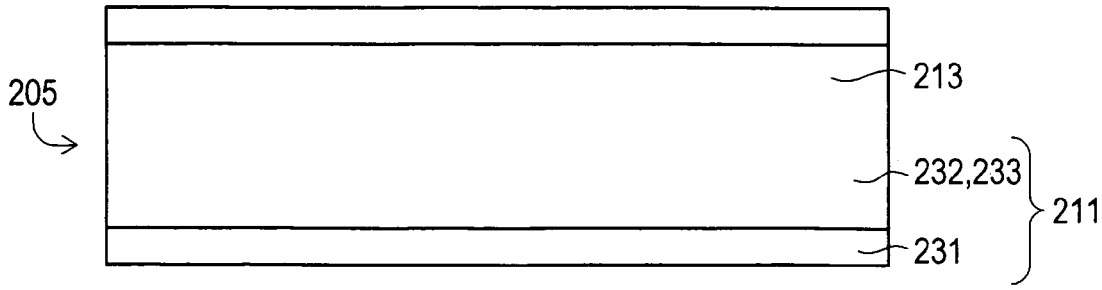
FIG. 63 is a plan view illustrating another print tape according to the third embodiment.

For instance, with regard to the print tape 205 which is produced in a tape printer by using the print cassette 201 of the third embodiment, for instance, the second tape 213 may have a width wider than that of the first tape 211 as shown in a plan view of FIG. 61. Conversely, the second tape 213 may have a width narrower than that of the first base material 231 of the first tape 211, as shown in a plan view of FIG. 63. Further, as shown in a plan view of FIG. 62, the to-be-printed medium 233 and first adhesive layer 232 of the first tape 211 may have a width narrower than that of the second tape 213. In both cases, the second tape 213 and the first base material 231 of the first tape 211 are different in width, which makes it easy to distinguish the second tape 213 and the first base material 231 of the first tape 211, and to unstick the second tape 2133 and the first base material 231 of the first tape 211.

Figure 64:
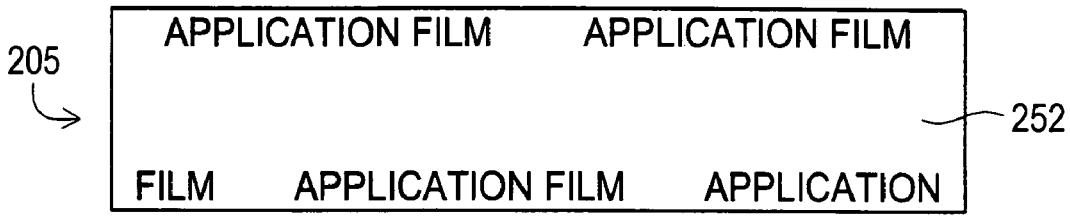
FIG. 64 is a plan view illustrating another print tape according to the third embodiment.

Even in the print tape 205 having the second tape 213 as wide as the first tape 211, as shown in a plan view of FIG. 64, the presence of the second base material 252 of the second tape 213 can be emphasized with prints such as characters and patterns (in FIG. 64, for example, characters of "APPLICATION FILM") representing the application tape preliminarily printed on the second tape 213 itself, thereby facilitating the work to unstick the second tape 213. In addition, if the top and bottom of the print tape 205 can be distinguished by the characters and patterns preliminarily printed on the second tape 213, the print tape 205 is allowed to be stuck readily to the adherend 261 (see FIG. 60 and other figures).

Figure 67:
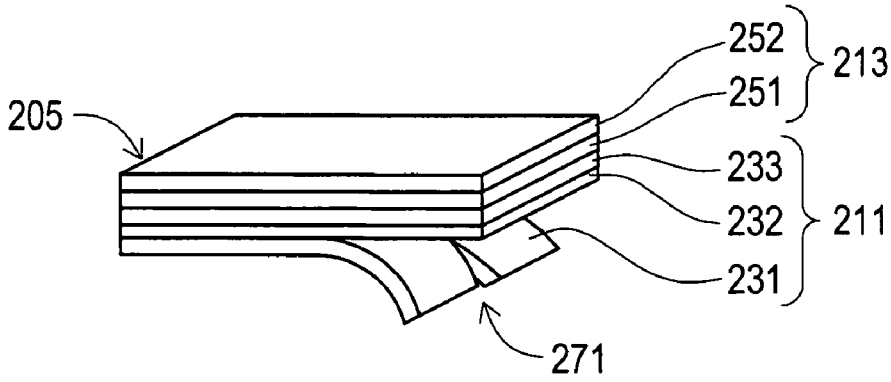
FIG. 67 is a perspective view illustrating another print tape according to the third embodiment.

Further, as shown in a perspective view of FIG. 67, the first base material 231 of the first tape 211 comprising the print tape 205 may preliminarily be provided with a half cut 271. This configuration can facilitate the work to remove the first base material 231 of the first tape 211. Similarly, as shown in a perspective view of FIG. 68, the second tape 213 may preliminarily be provided with a half cut 281 in advance, which allows the second tape 213 to be unstuck easily.

Figure 69A:
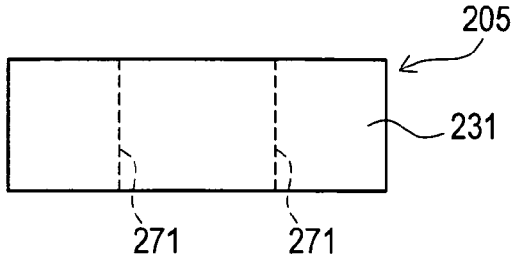
FIG. 69A is a plan view illustrating another print tape according to the third embodiment.
Figure 69B:
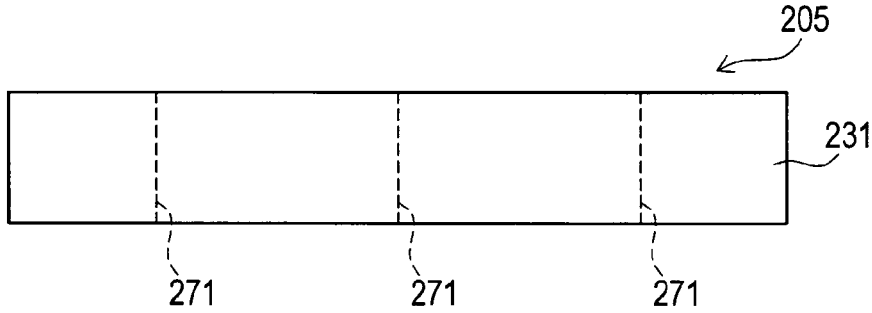
FIG. 69B is a plan view illustrating another print tape according to the third embodiment.
Figure 69C:
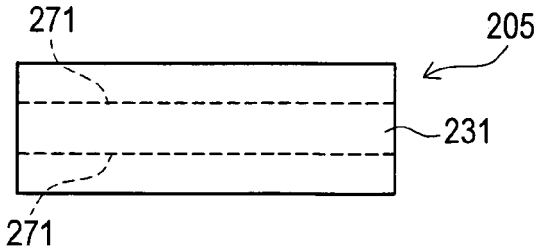
FIG. 69C is a plan view illustrating another print tape according to the third embodiment.
Figure 69D:
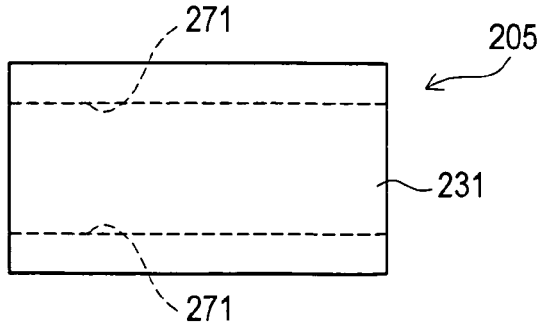
FIG. 69D is a plan view illustrating another print tape according to the third embodiment.
Figure 70A:
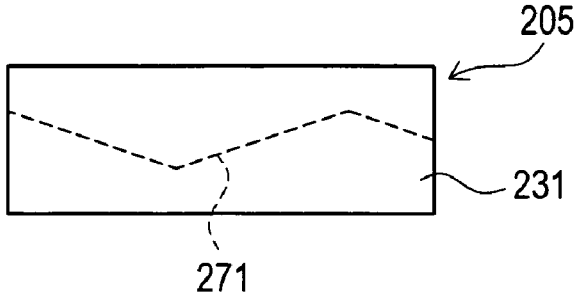
FIG. 70A is a plan view illustrating another print tape according to the third embodiment.
Figure 70B:
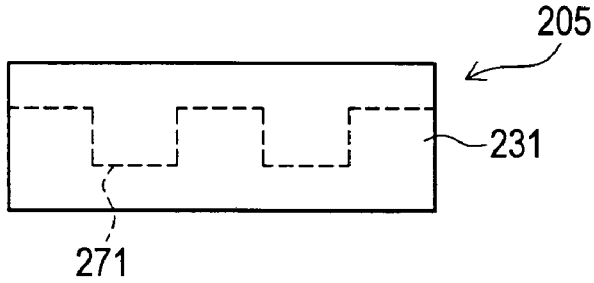
FIG. 70B is a plan view illustrating another print tape according to the third embodiment.
Figure 70C:
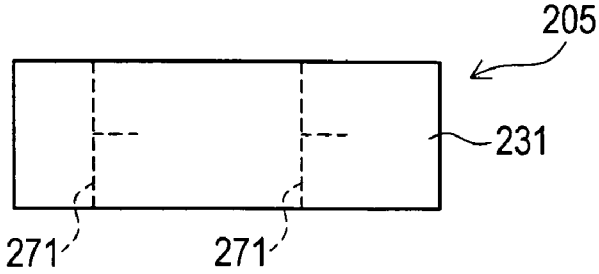
FIG. 70C is a plan view illustrating another print tape according to the third embodiment.
Figure 71A:
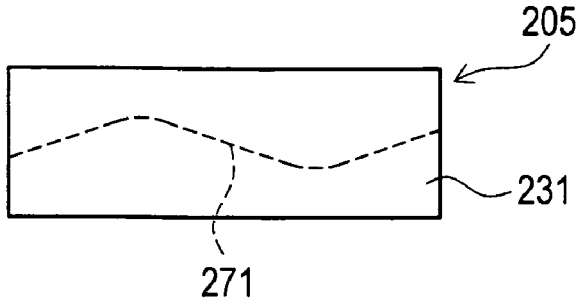
FIG. 71A is a plan view illustrating another print tape according to the third embodiment.
Figure 71B:
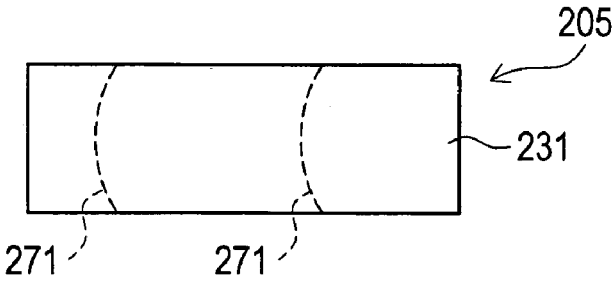
FIG. 71B is a plan view illustrating another print tape according to the third embodiment.
Figure 71C:
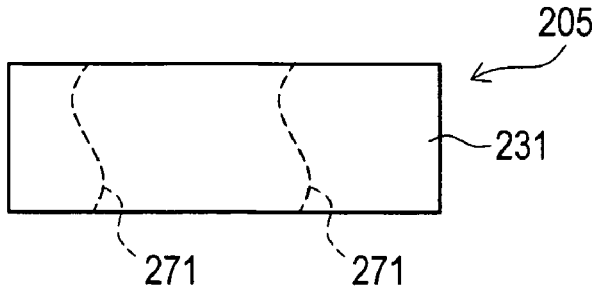
FIG. 71C is a plan view illustrating another print tape according to the third embodiment.
Figure 72A:
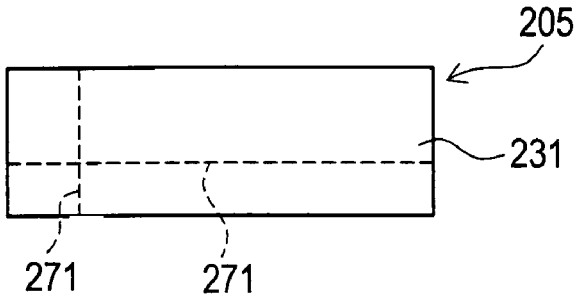
Figure 72B:
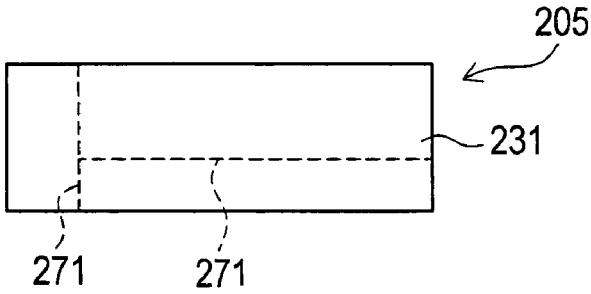
Figure 72C:
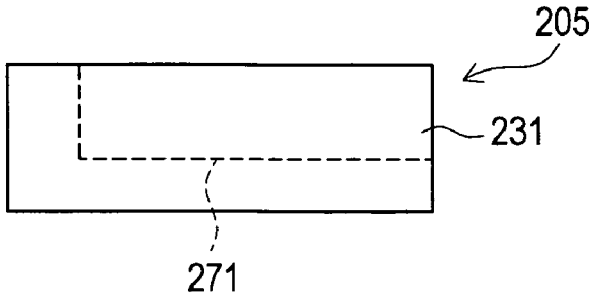

FIGS. 69A to 72C show various configurations of half cuts 271 implemented in the first base material 231 preliminarily. FIGS. 69A and 69B show an example that a plurality of half cuts 271 are implemented in the width direction of the first base material 231, and FIGS. 69C and 69D show an example that a plurality of half cuts 271 are implemented in the longitudinal direction of the first base material 231. FIGS. 70A, 70B, and 70C show an example that a linear half cut 271 is implemented in the first base material 231. FIGS. 71A, 71B, and 71C show an example that a curved half cut 271 is implemented in the first base material 231. FIGS. 72A, 72B, and 72C show an example that the half cuts 271 in the width direction and in the longitudinal direction are implemented by combination in the first base material 231.

In other words, in the print tape 205, which is produced in a tape printer by using the print cassette 201 of the third embodiment, as described above, the first base material 231 adhered to the to-be-printed medium 233 with the first adhesive layer 232, so that the to-be-printed medium 233 and the first base material 231 are integrally formed (see FIG. 60A). Then, when part of the first base material 231 is removed from the to-be-printed medium 233 along the half cut 271 in order to stick the to-be-printed medium 233 to the adherend 261 (see FIGS. 60B and 67), part of the first adhesive layer 232 is exposed, so that part of the to-be-printed medium 233 can be stuck to the adherend 261 with the part of the first adhesive layer 232 (see FIGS. 60C and 67).

At this time, the left portion of the first base material 231 still adhered to the to-be-printed medium 233, so that the to-be-printed medium 233 can thus keep the rigidity by the stiffness of the left portion of the first base material 231. Consequently, however thin the to-be-printed medium 233 is, the work of sticking part of the to-be-printed medium 233 to the adherend 261 securely without generation of wrinkles can be carried out. After that, because the left portion of the first adhesive layer 232 is exposed when the left portion of the first base material 231 is removed from the to-be-printed medium 233, the left portion of the to-be-printed medium 233 can be stuck to the adherend 261 with the left portion of the first adhesive layer 232. At this time, the to-be-printed medium 233 can thus keep the tension by part of the to-be-printed medium 233 stuck to the adherend 261. Consequently, however thin the to-be-printed medium 233 is, the work of sticking the left portion of the to-be-printed medium 233 to the adherend 261 securely without generation of wrinkles can be carried out.

In other words, by repeatedly releasing part of the first base material 231 from the to-be-printed medium 233 along the half cut 271, the to-be-printed medium 233 can be stuck to the adherend 261 step by step. This facilitates the work of securely sticking the to-be-printed medium 233 to the adherend 261 without generation of wrinkles.

Further, the second base material 252 adhered to the to-be-printed medium 233 (see FIGS. 60B and 67), so that the to-be-printed medium 233 can thus keep the rigidity by the stiffness of the second base material 252. Consequently, however thin the to-be-printed medium 233 is, the work of sticking the to-be-printed medium 233 to the adherend 261 securely without generation of wrinkles can be carried out.

Figure 68:
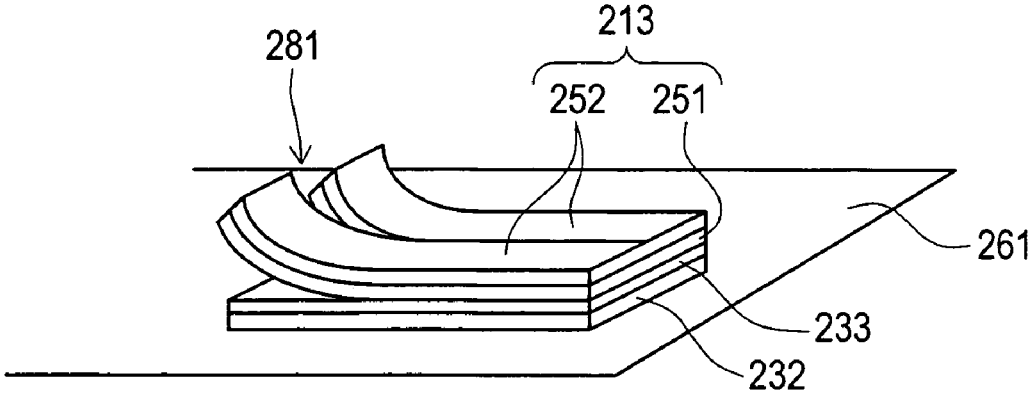
FIG. 68 is a perspective view illustrating another print tape according to the third embodiment.

After that, the second base material 252 can be removed easily from the to-be-printed medium 233 by the half cut 281 (see FIG. 68).

The various configurations of the half cuts 271 implemented in the first base material 231 preliminarily shown in FIGS. 69A to 72C may be adopted as configurations of the half cuts 281 to be implemented in the second tape 213 preliminarily.

In the print tape 205, which is produced in a tape printer by using the print cassette 201 of the third embodiment, the second tape 213 may be a transparent and colorless tape or a colored and transparent tape. In the case of the transparent and colorless second tape 213, this allows the ink 241 thermally transferred to the printing surface 211A (see FIG. 55 and other figures) of the first tape 211 to be visually identified therethrough, so that the top and bottom of the print tape 205 can be distinguished easily, thereby facilitating the work to stick the print tape 205 to the adherend 261. On the other hand, the colored and transparent second tape 213 allows not only the ink 241 thermally transferred to the printing surface 211A (see FIG. 55 and other figures) of the first tape 211 but also the presence of the second tape 213 itself to be identified visually. This can facilitate the work to stick the print tape 205 to the adherend 261 and the work to unstick the second tape 213.

On the other hand, if the second base material 252 is opaque, the ink 241 thermally transferred to the printing surface 211A (of the to-be-printed medium 233) of the first tape 211 (see FIG. 55 and other figures) cannot be recognized visually.

In other words, in the print tape 205, which is produced in a tape printer by using the print cassette 201 of the third embodiment, as described above, the second base material 252 adhered to the to-be-printed medium 233 with the second adhesive layer 251. Thus, if the second base material 252 is opaque, as described above, the ink 241 thermally transferred to the printing surface 211A (of the to-be-printed medium 233) of the first tape 211 (see FIG. 55 and other figures) cannot be recognized visually, the second base material 252 has the hiding performance. Accordingly, the to-be-printed medium 233 cannot be recognized visually via the second base material 252, so that the ink 241 (the printing content) of the to-be-printed medium 233 can be hidden. Consequently, the security effect to the printing content of the to-be-printed medium 233 is exerted.

Figure 65:
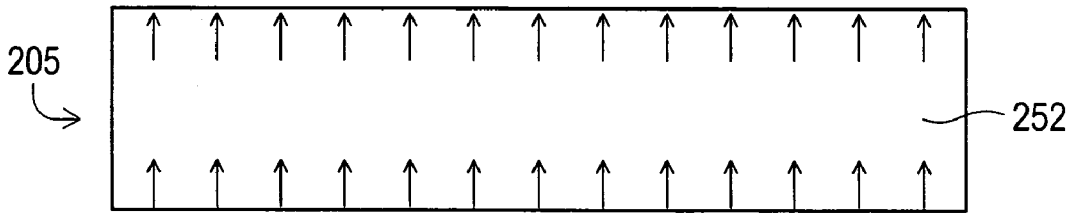
FIG. 65 is a plan view illustrating another print tape according to the third embodiment.
Figure 66:
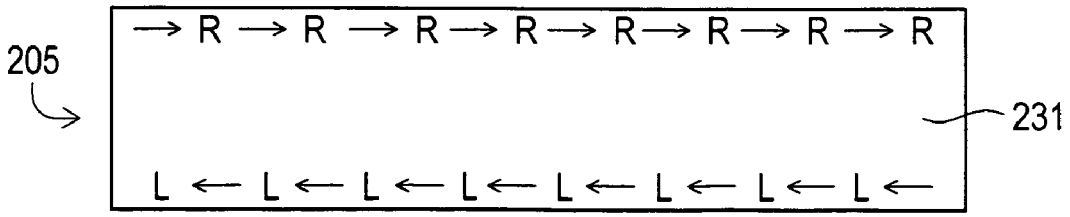
FIG. 66 is a plan view illustrating another print tape according to the third embodiment.

Unless the printing content of the to-be-printed medium 233 can be recognized visually, it is inconvenient when sticking the print tape 205 to the adherend 261. Thus, if a mark indicating the up-down direction or right-left direction of the printing surface 211A (of the to-be-printed medium 233) of the first tape 211 (see FIG. 55 and other figures) is provided on the first base material 231 or the second base material 252 preliminarily, it is convenient. FIG. 65 is a drawing showing an example that the mark (arrows) indicating the up-down direction of the printing surface 211A (of the to-be-printed medium 233) of the first tape 211 (see FIG. 55 and other figures) is provided on the second base material 252 preliminarily. Although the direction of this arrow indicates upward, it may indicate downward. Further, this arrow may be provided on the first base material 231. FIG. 66 is a drawing showing an example that the mark ("→R", "L←") indicating the right-left direction of the printing surface 211A (of the to-be-printed medium 233) of the first tape 211 (see FIG. 55 and other figures) is provided on the first base material 231 preliminarily. The direction of the mark "→R" indicates rightward. The direction of the mark "L←" indicates leftward. Further, these marks may be provided on the second base material 252 preliminarily.

The mark indicating the up-down direction or the right-left direction of the printing surface 211A (of the to-be-printed medium 233) of the first tape 211 (see FIG. 55 and other figures) is provided on the first base material 231 or the second base material 252 preliminarily. Thus, even if the to-be-printed medium 233 (the printing content) cannot be recognized visually, the up-down direction or the right-left direction of the to-be-printed medium 233 is never mistaken as long as this mark is used as a clue, so that the print tape 205 (to-be-printed medium 233) can be stuck to the adherend 261.

Figure 57B:
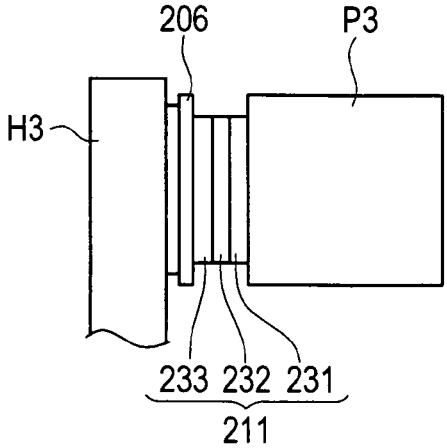
FIG. 57B is a cross-sectional view of the print cassette of thermal transfer type according to the third embodiment, from which the upper cassette case is removed, taken along a line F3-F3.

When the print cassette 201 of the third embodiment is set in a cassette mounting portion of a tape printer, the printing surface 211A (of the to-be-printed medium 233) of the first tape 211 (see FIG. 55 and other figures) is printed by the thermal head H3 of the tape printer designed to exist in the thermal head arrangement portion 220 and the platen P3 opposing the thermal head H3 as shown in FIG. 57A. At this time, the printing surface 211A (of the to-be-printed medium 233) of the first tape 211 (see FIG. 55 and other figures) opposes the thermal head H3 of the tape printer via the ink face of the ink ribbon 206 (see FIGS. 56 and 57A). FIG. 57B shows a view taken along the line F3-F3 of FIG. 57A in this state.

As shown in FIG. 57B, the to-be-printed medium 233 of the first tape 211 is covered with the ink ribbon 206, so that the to-be-printed medium 233 is hidden from the thermal head H3 of the tape printer.

Further, the width of the ink ribbon 206 is wider than the width of the first tape 211. With this configuration, even if the ink ribbon 206 is shifted in its width direction at the time of printing, a state in which the to-be-printed medium 233 of the first tape 211 is hidden by the ink ribbon 206 from the thermal head H3 of the tape printer is maintained. Consequently, heat generated by the thermal head H3 of the tape printer at the time of printing is transmitted to, the to-be-printed medium 233 of the first tape 211 via the ink ribbon 206, so that the heat is not transmitted directly to the to-be-printed medium 233 of the first tape 211. Thus, because print is made on the to-be-printed medium 233 of the first tape 211 in a state of being unsusceptible to bad influence of heat, print quality is excellent and print appearance is also excellent.

The print tape 205 produced by a tape printer using the print cassette 201 of the third embodiment is of thermal transfer type which is printed by the thermal head H3 of the tape printer and the ink ribbon 206.

However, even a thermosensitive type which does not require the ink ribbon 206 can obtain the above-described various effects (except an effect of blocking a bad influence by heat at the time of print by the ink ribbon 206 easily). Hereinafter, a case in which a thermosensitive type print tape 205 is produced by the tape printer will be described by applying this to the print cassette 201 of the third embodiment in order to mainly indicate a difference from the thermal transfer type print tape 205.

Figure 75:
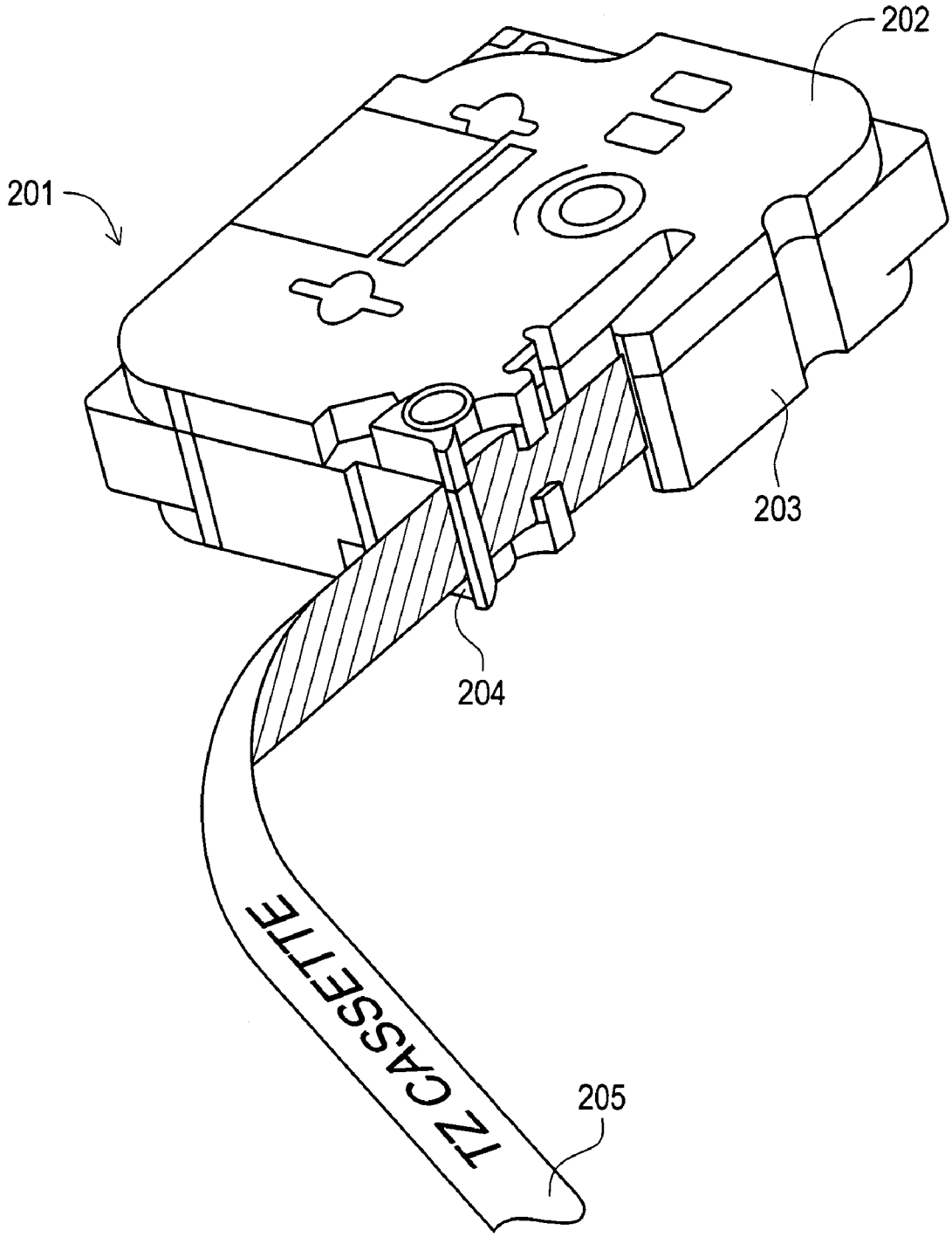

FIG. 75 is a perspective view of the print cassette. As shown in FIG. 75, the print cassette 201 of the third embodiment comprises an upper cassette case 202 and a lower cassette case 203. The print tape 205 is discharged from the tape discharge port 204. In the meantime, the ink ribbon 206 shown in FIG. 56 does not exist here.

Figure 76:
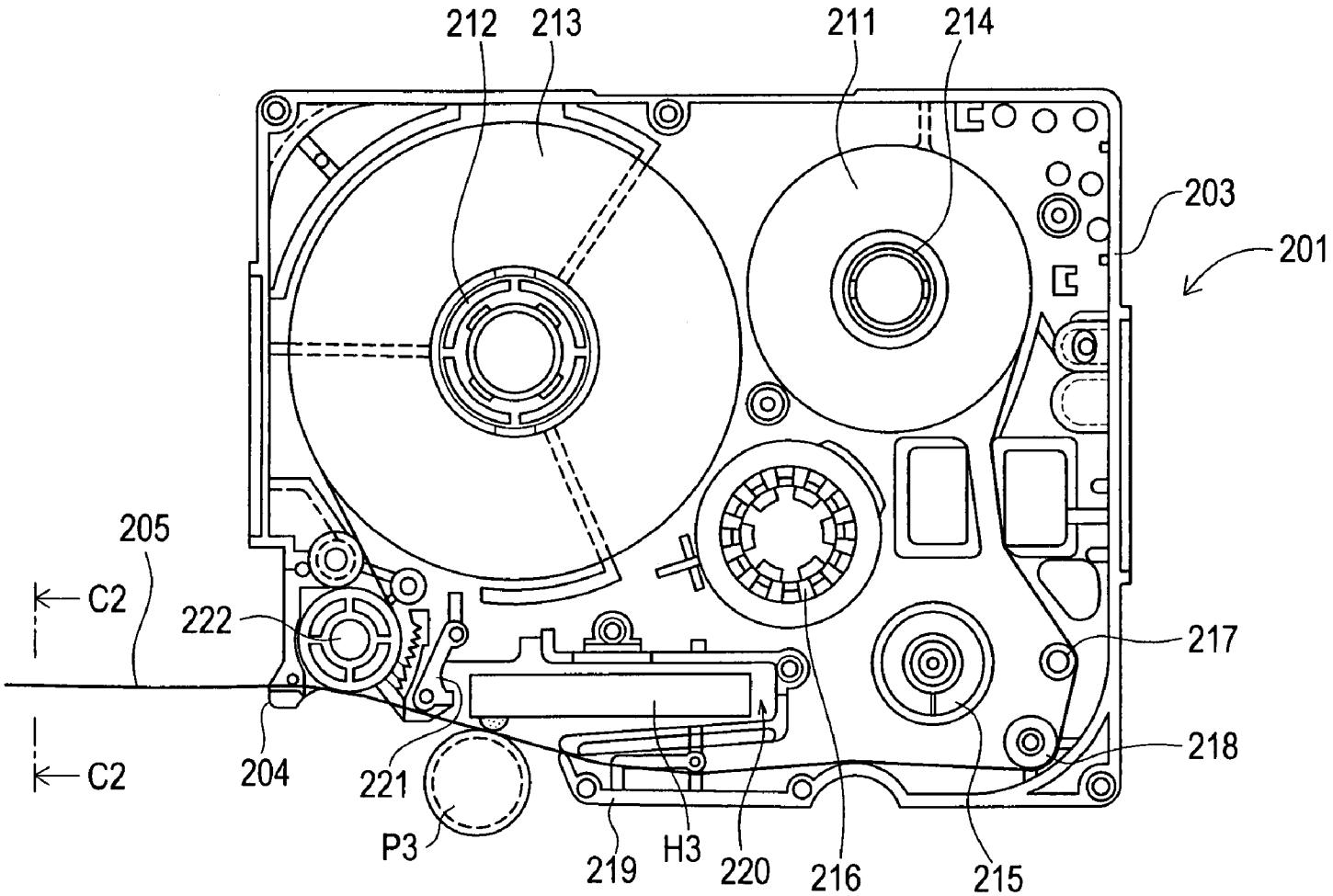

FIG. 76 is a plan view of the print cassette 201 from which the upper cassette case 202 (see FIG. 75) is removed. As shown in FIG. 76, a tape spool 212 on which a second tape 213 is wound, a film spool 214 on which a first tape 211 is wound, a ribbon supply spool 215 and a ribbon take-up spool 216 are provided on the lower cassette case 203 of the print cassette 201, being rotatable with cooperation of respective spool support members (not shown) formed on the upper cassette case 202 (see FIG. 75). No ink ribbon 206 exists on the ribbon supply spool 215 and the ribbon winding spool 216.

The first tape 211 has a first adhesive layer which is formed by being coated the second face side of a to-be-printed medium composed of an urethane sheet having a sheet thickness of approximately 10 μm to 15 μm with an adhesive agent of approximately 16 μm thick. Further, a release sheet adhered to the first adhesive layer. Then, an inside surface (the first face side of the to-be-printed medium) wound on the film spool 214 will be a printing surface. Therefore, the first tape 211 wound on the film spool 214 is guided to an arm part 219 formed on the lower cassette case 203, via a guide pin 217 provided on the lower cassette case 203 in an upright position and a rotatable guide roller 218. The first tape 211 is further guided out of the arm part 219, being exposed outside a thermal head attachment space 220. After that, the first tape 211 is discharged from the tape discharging port 204, via a guide member 221 and a feed roller 222.

Incidentally, when the print cassette 201 of the third embodiment is set in a cassette mount of a tape printer, a thermal head H3 of the tape printer exists on the thermal head arrangement portion 220. Then, the first tape 211 is nipped by the thermal head H3 and a platen roller P3 of the tape printer opposing the head H3.

On the other hand, the second tape 213 has a second adhesive layer (a weak adhesive layer) which is formed by being coated the first face side of a second base material (a handling auxiliary film) composed of a "PET sheet" with a second adhesive agent (a weak adhesive agent) of approximately 25 μm thick. The second tape 213 is wound on the tape spool 212 with the second base material side outside. The second tape 213 wound in this way is guided by the <feed roller 222 while the adhesive-coated surface of the second adhesive layer and the printing surface of the first tape 211 are overlapped with each other. As a result, the second tape 213 adheres to the first tape 211, and discharged outside the print cassette 201 through the tape discharging port 204. Accordingly, the printing surface of the first tape 211 is an adhesion object surface of the second adhesive layer of the second tape 213.

Figure 77:
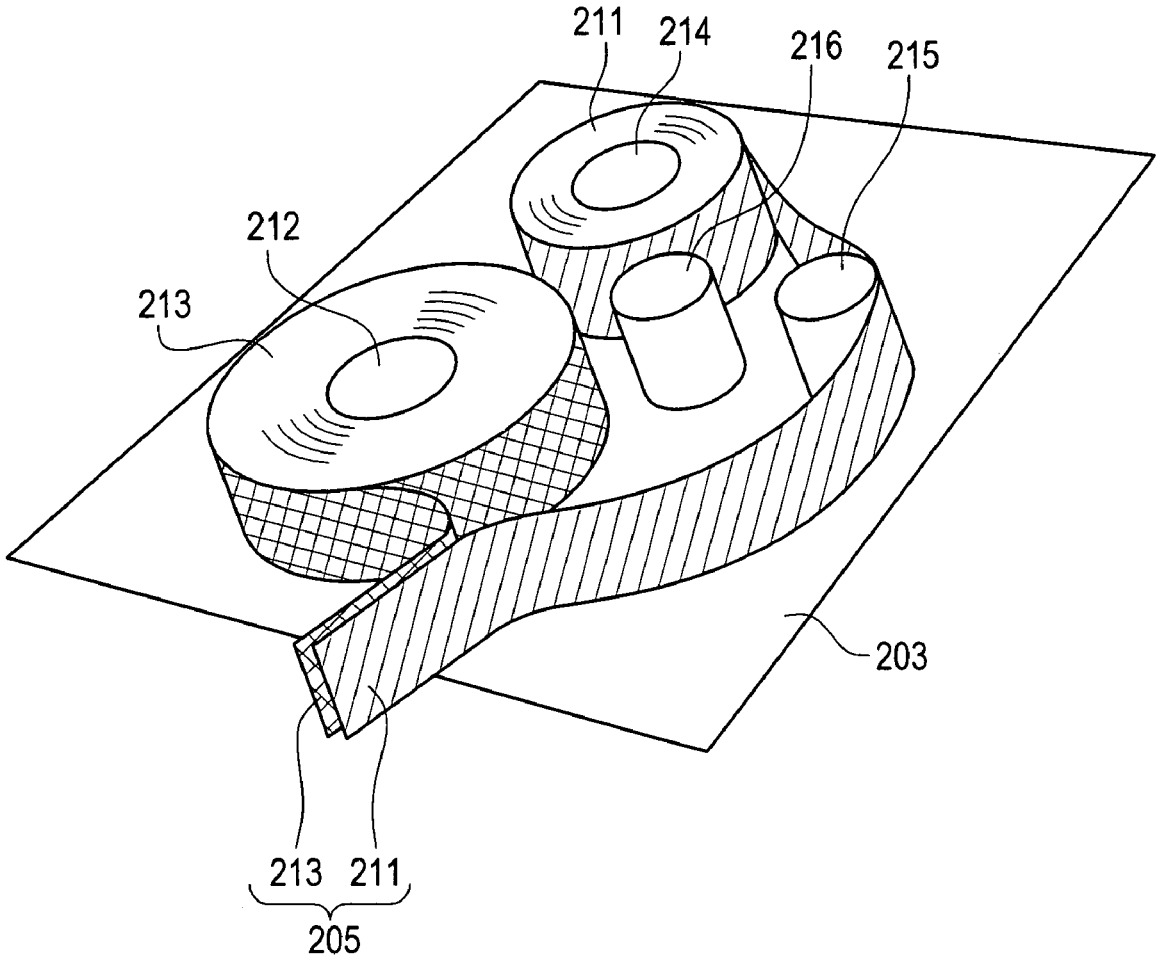

Accordingly, the print tape 205, which is composed of the first tape 111 and the second tape 213, is discharged from the tape discharging port 204 of the print cassette 201 FIG. 77 is a schematic view showing a process of the first tape 211 and the second tape 213 being guided on the lower cassette case 203 as described above.

Figure 74:
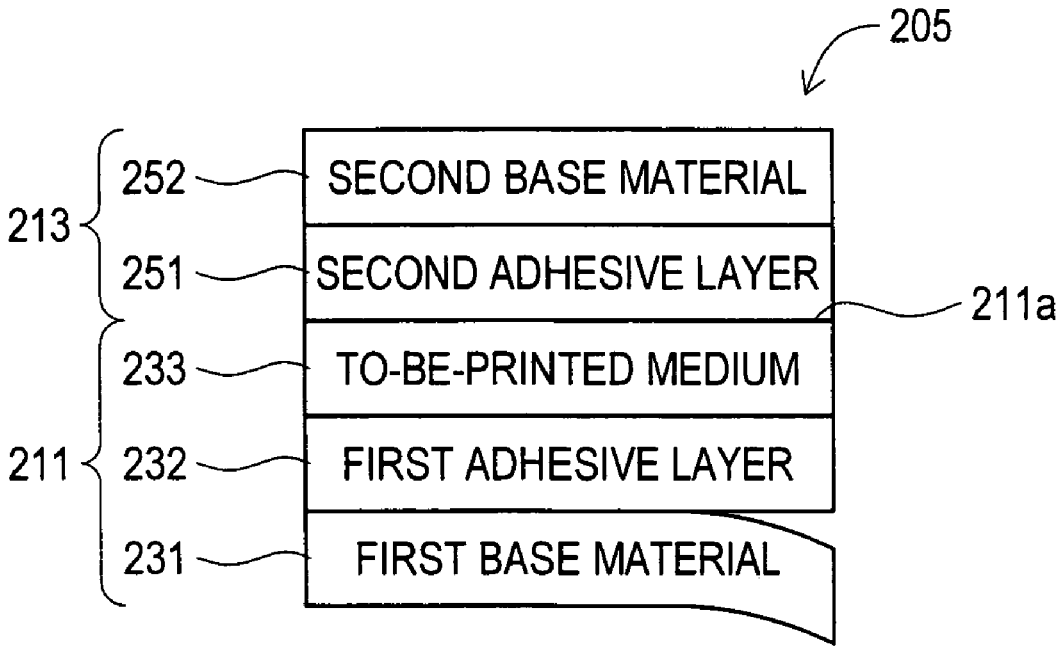

FIG. 74 is a cross-sectional view of the print tape 205 taken along the line C2-C2 shown in FIG. 76. As shown in FIG. 74, the print tape 205 is composed of the first tape 211 and the second tape 213. As described above, the first tape 211 has a first adhesive layer 232 which is formed by being coated the second face side of a to-be-printed medium 233 composed of an urethane sheet having a sheet thickness of approximately 10 μm to 15 μm with an adhesive agent of approximately 16 μm thick. Further, a first base material 231 adhered to the first adhesive layer 233.

The first face (side) of the to-be-printed medium 233 is coated with a thermosensitive coloring agent. The printing surface 211A of the first tape 211 is formed thereof.

When the print cassette 201 of the third embodiment is set on a cassette mounting portion of a tape printer, the thermosensitive coloring agent coated to the printing surface 211A (of the to-be-printed medium 233) of the first tape 211 (see FIG. 55 and other figures) is discolored by the thermal head H3 of the tape printer designed to exist in the thermal head arrangement portion 220 so as to print.

As described above, the second tape 213 has a second adhesive layer 251 which is formed by being coated the first face side of a second base material 252 composed of a "PET sheet" with a second adhesive agent of approximately 25 μm thick. A printing surface 211A (of the to-be-printed medium 233) of the first tape 211 and the second adhesive layer 251 are overlapped with each other, so that the first tape 211 adheres to the second tape 213 to compose the print tape 205. Accordingly, the printing surface 211A (of the to-be-printed medium 233) of the first tape 211 is an adhesion object surface of the second adhesive layer 251 of the second tape 213.

Figure 78:
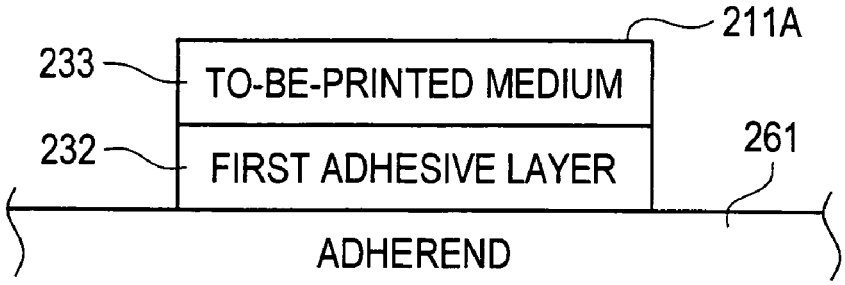

Further, the print tape 205, from which the first base material 231 is removed so that the adhesive-coated surface of the first adhesive layer 232 is exposed, can be stuck to an adherend. After that, the second base material 252 is slowly removed, and then, as shown in FIG. 78, the to-be-printed medium 233 can be stuck to an adherend 261 with the first adhesive layer 232.

Although in the print cassette 201 of the third embodiment, the print tape 205 is composed of the first tape 211 and the second tape 213, the print tape 205 may be constituted of only the first tape 211. FIG. 79 is a view showing a section of the print tape 205 produced using only the first tape 211.

In other words, the print tape 205 is constituted only of the first tape 211 as shown in FIG. 79. As described above, the first tape 211 has the first adhesive layer 232 which is formed by being coated the second face side of the to-be-printed medium 233 composed of an urethane sheet having a sheet thickness of approximately 10 μm to 15 μm with an adhesive agent of approximately 16 μm thick. Further, the first base material 231 adhered to the first adhesive layer 233. The ink 241 is thermally transferred to the printing surface 211A of the first tape 211 to compose the print tape 205.

Next, the way of using the print tape 205 will be explained with reference to FIGS. 80A to 80C.

The print tape 205 is discharged from the tape discharging port 204 of the print cassette 201 of the third embodiment, the print cassette 201 being set in a cassette mount of a tape printer. The print tape 205 is cut with the cutter device of the tape printer to be a strip-formed tape composed only of the first tape 211 (the first base material 231, the first adhesive layer 232 and the to-be-printed medium 233) as shown in FIG. 80A. As shown in FIG. 80B, the first base material 231 of the first tape 211 is removed, so that the first adhesive layer 232 of the first tape 211 is exposed. Further, the first adhesive layer 232 of the first tape 211 is stuck to the adherend 261 as shown in FIG. 80C.

Further, as shown in a perspective view of FIG. 81, the first base material 231 of the first tape 211 comprising the print tape 205 may preliminarily be provided with a half cut 271.

This configuration can facilitate the work to remove the first base material 231 of the first tape 211. Then, the half cut 271 to be implemented preliminarily in the first base material 231 may be of various configurations showing in FIGS. 69 to 72 as described above and even in this case, the above-described effect which the half cut 271 exerts can be obtained.

The print tape 205 produced using only the first tape 211 is not limited to the thermal transfer type but may be of the thermosensitive type. FIG. 82 is a view showing the section of such a thermosensitive type print tape 205.

In other words, as shown in FIG. 82, the thermosensitive type print tape 205 is constituted only of a first tape 211. As described above, the first tape 211 has a first adhesive layer 232 which is formed by being coated the second face side of a to-be-printed medium 233 composed of an urethane sheet having a sheet thickness of approximately 10 μm to 15 μm with an adhesive agent of approximately 16 μm thick. Further, a first base material 231 adhered to the first adhesive layer 233. As described above, the first face (side) of the to-be-printed medium 233 is coated with a thermosensitive coloring agent. A printing surface 211A of the first tape 211 is formed thereof. Then, when a print cassette 201 of the third embodiment is set on a cassette mounting portion of a tape printer, the thermosensitive coloring agent coated to the printing surface 211A (of the to-be-printed medium 233) of the first tape 211 (see FIG. 82 and other figures) is discolored by the thermal head H3 of the tape printer designed to exist in a thermal head arrangement portion 220 so as to print. The thermosensitive type print tape 205 is composed thereof.

Although in the third embodiment, the print tape 205 produced by a tape printer using the print cassette 201, even a sheet-like print tape (including a wide tape-like one) which cannot be produced using the tape printer in which the print cassette 201 is set can obtain the above-described various effects (excluding effects exerted within the print cassette 201). Further, although in this embodiment, the width of the ink ribbon 206 is wider than the width of the print tape 205, the width of the ink ribbon 206 may be equal to the width of the print tape 205.

Preferably, the thickness of the to-be-printed medium 233 is 2.5 μm to 30 μm.

Hereinafter, the print cassette of the present disclosure will be described in detail based on the fourth embodiment of the present disclosure with reference to the drawings. FIG. 84 is a perspective view of the print cassette. As shown in FIG. 84, a print cassette 1001 of the fourth embodiment comprises an upper cassette case 1002 and a lower cassette case 1003. A print tape 1005 is discharged from a tape discharging port 1004. It is noted that a reference numeral 1006 indicates an ink ribbon.

FIG. 85 is a plan view of the print cassette 1001 from which the upper cassette case 1002 (see FIG. 84) is removed. As shown in FIG. 95, a tape spool 1012 on which a both sides adhesive tape 1013 is wound, a film spool 1014 on which a multilayer laminated tape 1011 is wound, a ribbon supply spool 1015 on which the ink ribbon 1006 is wound, and a ribbon take-up spool 1016 are provided on the lower cassette case 1003 of the print cassette 1001, being rotatable with cooperation of respective spool support members (not shown) formed on the upper cassette case 1002 (see FIG. 84).

In the multilayer laminated tape 1011, a handling auxiliary film composed of a "PET sheet" having a sheet thickness of approximately 70 μm and a thin laminated film composed of an urethane sheet having a sheet thickness of approximately 10 μm are stacked and further, a weak adhesive layer is formed between the handling auxiliary film and the thin laminated film by being coated with a weak adhesive agent in a thickness of approximately 25 μm. Then, the multilayer laminated tape 1011 is wound on the film spool 1014 with its to thin laminated film side out side. In the multilayer laminated tape 1011 wound in this way, an inside surface (the first face side of the thin laminated film) wound on the film spool 1014 will be a printing surface. Therefore, the multilayer laminated tape 1011 wound on the film spool 1014 is guided to an arm part 1019 formed on the lower cassette case 1003, via a guide pin 1017 provided on the lower cassette case 1003 in an upright position and a rotatable guide roller 1018. The multilayer laminated tape 1011 is further guided out of the arm part 1019, being exposed outside a thermal head attachment space 1020. After that, the multilayer laminated tape 1011 is discharged from the tape cassette 1001 through the tape discharging port 1004, via a guide member 1021 and a feed roller 1022.

The ink ribbon 1006 is wound on the ribbon supply spool 1015 with an ink-coated surface side inside. The ink ribbon 1006 wound on the ribbon supply spool 1015 in this way is exposed out of the arm part 1019 outside the thermal head attachment space 1020. The ink ribbon 1006 is further guided while the ink-coated surface and the first face (side) of the thin laminated film are overlapped with each other. After that, the ink ribbon 1006 is guided along an exterior of the guide member 1021, thereby getting separated from the printing surface of the multilayer laminated tape 1011. Finally, the ink ribbon 1006 is taken up by the ribbon take-up spool 1016.

On the other hand, the both sides adhesive tape 1013 has a first adhesive layer which is formed by being coated the first face side of a base film composed of a "PET sheet" having a sheet thickness of approximately 12 μm with a first adhesive agent of approximately 20 μm thick. The second face side of the base film is coated with a second adhesive agent so as to form a second adhesive layer having a thickness of approximately 16 μm. Further, a release sheet having a thickness of approximately 53 μm adhered to the second adhesive layer. The both sides adhesive tape 1013 is wound on the tape spool 1012 with the release sheet side outside. The both sides adhesive tape 1013 wound in this way is guided by the feed roller 1022 while the adhesive-coated surface of the first adhesive layer and the printing surface of the multilayer laminated tape 1011 are overlapped with each other. As a result, the both sides adhesive tape 1013 adheres to the multilayer laminated tape 1011, and discharged outside the print cassette 1001 through the tape discharging port 1004.

Accordingly, the print tape 1005, which is composed of the multilayer laminated tape 1011 and the both sides adhesive tape 1013, is discharged from the tape discharging port 1004 of the print cassette 1001. FIG. 86 is a schematic view showing a process of the multilayer laminated tape 1011, the both sides adhesive tape 1013 and the ink ribbon 1006 being guided on the lower cassette case 1003 as described above.

FIG. 83 is a cross-sectional view of the print tape 1005 taken along the line D-D shown in FIG. 85. As shown in FIG. 83, the print tape 1005 is composed of the multilayer laminated tape 1011 and the both sides adhesive tape 1013. In the multilayer laminated tape 1011, as described above, a handling auxiliary film 1051 composed of a "PET sheet" having a sheet thickness of approximately 70 μm and a thin laminated film 1053 composed of an urethane sheet having a sheet thickness of approximately 10 μm are stacked and further, a weak adhesive layer 1052 is formed between the handling auxiliary film 1051 and the second face (side) of the thin laminated film 1053 by being coated with a weak adhesive agent in a thickness of approximately 25 μm. As described above, the both sides adhesive tape 1013 is configured such that the first face side of the base film 1032 composed of a "PET sheet" having a sheet thickness of approximately 12 μm is coated with a first adhesive agent to form a first adhesive layer 1031 in a thickness of approximately 20 μm and the second face side of the base film 1032 is coated with a second adhesive agent to form a second adhesive layer 1033 in a thickness of approximately 16 μm. Further, a release sheet 1034 having a thickness of approximately 53 μm adhered to the second adhesive layer 1033. A printing surface 1011A of the multilayer laminated tape 1011 on which ink 1041 is put and the first adhesive layer 1031 are overlapped with each other, so that the both sides adhesive tape 1013 adheres to the multilayer laminated tape 1011 to compose the print tape 1005.

Further, the print tape 1005, from which the release sheet 1034 is removed so that the adhesive-coated surface of the second adhesive layer 1033 is exposed, can be stuck to an adherend. After that, the handling auxiliary film 1051 is slowly removed, and then, as shown in FIG. 87, the thin laminated film 1053 can be stuck to an adherend 1061 with the both sides adhesive tape 1013 (or the second adhesive layer 1033), along with the ink 1041 which is thermally transferred to the printing surface 1011A thereof.

In order that the thin laminated film 1053 on which the ink 1041 is thermally transferred to the printing surface 1011A adheres to the handling auxiliary film 1051 as described above, the weak adhesive agent making up the weak adhesive layer 1052 includes a copolymer as a main material, made by the copolymerization of monomers of any series such as an acrylic series, a rubber series and a silicone series. The weak adhesive agent can be made with or without various kinds of additives (such as a crosslinking agent, a tackifier, a softener, a fixture and a pigment). The week adhesive agent having a low adhesive property is adopted since this is used for temporary adhesion and a part which will be removed eventually.

On the other hand, the adhesive agent making up the first adhesive layer 1031 and the second adhesive layer 1033 include a copolymer as a main material, made by the copolymerization of monomers of any series such as an acrylic series, a rubber series and a silicone series. The adhesive can be made with or without various kinds of additives (such as a crosslinking agent, a tackifier, a softener, a fixture and a pigment). The adhesive agent having an adhesive property appropriate to the adherend 1061 is adopted. Particularly as the adhesive agent making up the second adhesive layer 1033, the adhesive agent having an adhesive property appropriate to the adherend 1061 is adopted.

Incidentally, the print cassette 1001 is set in a cassette mount of a tape printer (not shown) to produce the print tape 1005. In the cassette mount of the tape printer, there is provided a cutter device (not shown) having a cutter to cut the print tape 1005 discharged from the tape discharging port 1004 of the print cassette 1001. The structure of the print cassette 1001 as explained with reference to FIG. 84 and other figures and the tape printer in which the print cassette 1001 is installed to produce the print tape 1005 have been publicly known, so the detailed explanation of the process for producing the print tape 1005 with the print cassette 1001 and the tape printer is omitted.

Next, the way of using the print tape 1005 will be explained with reference to FIGS. 88A to 88E.

The print tape 1005 is discharged from the tape discharging port 1004 of the print cassette 1001 of the fourth embodiment, the print cassette 1001 being set in a cassette mount of a tape printer (not shown). The print tape 1005 is cut with the cutter device of the tape printer (not shown) to be a strip-formed tape composed of the multilayer laminated tape 1011 (the handling auxiliary film 1051, the weak adhesive layer 1052 and the thin laminated film 1053) and the both sides adhesive tape 1013 (the first adhesive layer 1031, the base film 1032, the second adhesive layer 1033 and the release sheet 1034) as shown in FIG. 88A. As shown in FIG. 88B, the release sheet 1034 of the both sides adhesive tape 1013 is removed, so that the second adhesive layer 1033 of the both sides adhesive tape 1013 is exposed. Further, the second adhesive layer 1033 of the both sides adhesive tape 1013 is stuck to the adherend 1061 as shown in FIG. 88C.

As shown in FIG. 88D, the handling auxiliary film 1051 is slowly removed from the adherend 1061. At this time, the weak adhesive layer 1052 is also removed with the handling auxiliary film 1051, thus only the thin laminated film 1053 can be left there. Finally, as shown in FIG. 88E, the thin laminated film 1053 on which the ink 1041 is thermally transferred is in a state of adhering to the adherend 1061 with (the second adhesive layer 1033 of) the both sides adhesive tape 1013. The ink 1041 has been thermally transferred from the ink ribbon 1006 (see FIG. 85 and other figures) to the printing surface 1011A (of the thin laminated film 1053) of the multilayer laminated tape 1011 (see FIG. 83 and other figures) with the tape printer (not shown).

As described in detail above, the print cassette 1001 of the fourth embodiment is set in a cassette mount of a tape printer (not shown) to produce the print tape 1005 which is discharged from the tape printer (not shown).

The print tape 1005 discharged from the tape printer (not shown) is cut by the cutter device of the tape printer (not shown), and then the release sheet 1034 is removed from the both sides adhesive tape 1013 adhered to the multilayer laminated tape 1011 (see FIG. 88B). The exposed second adhesive layer 1033 of the both sides adhesive tape 1013 is stuck to the adherend 1061 (see FIG. 88C). Further, the handling auxiliary film 1051 is slowly removed from the adherend 1061 (see FIG. 88D), so that the weak adhesive layer 1052 is removed together with the handling auxiliary film 1051 and the thin laminated film 1053 is left on the adherend 1061 with the ink 1041. As shown in FIG. 87, the thin laminated film 1053 having the printing surface 1111A on which the ink 1041 is thermally transferred on the back side thereof is stuck to the adherend 1061 with (the second adhesive layer 1033 of) the both sides adhesive tape 1013. As a result, a "laminated tape" can be stuck to the adherend 1061 (see FIG. 88E).

The thin laminated film 1053 adhered to the handling auxiliary film 1051 with the week adhesive layer 1052 to take the form of the multilayer laminated tape 1011 (see FIG. 83) which is wound on the film spool 1014 within the print cassette 1001 of the fourth embodiment as shown in FIG. 85. From this state, the thin laminated film 1053 adheres to the both sides adhesive tape 1013 with the both sides adhesive tape 1013 and the first adhesive layer 1031 thereof to be the print tape 1005, which is discharged through the tape discharging port 1004. Thus, the thin laminated film 1053 can assure the feeding performance within the print cassette 1001 of the fourth embodiment even though the thin laminated film 1053 is thin.

Particularly, in the fourth embodiment, because the handling auxiliary film 1051 is thicker than the thin laminated film 1053, the feeding performance of the multilayer laminated tape 1011 within the print cassette 1001 of the fourth embodiment can be secured even however thin the thin laminated film 1053 is.

As shown in FIGS. 88A and 88B, the multilayer laminated tape 1011 is in a state of adhering to the both sides adhesive tape 1013 when stuck to the adherend 1061. The thin laminated film 1053 can thus keep the rigidity at least by the thickness of the multilayer laminated tape 1011. Accordingly, however thin the thin laminated film 1053 composing the "laminated tape" is, the "laminated tape" can easily be stuck to the adherend 1061 as shown in FIG. 88.

Particularly, in the fourth embodiment, the handling auxiliary film 1051 is thicker than the thin laminated film 1053. Accordingly, however thin the thin laminated film 1053 is, the handling auxiliary film 1051 can easily be removed.

Further, when the thin laminated film 1053 is stuck to the adherend 1061 with (the second adhesive layer 1033 of) the both sides adhesive tape 1013, the total thickness of the thin laminated film 1053 and the both sides adhesive tape 1013 is as thin as approximately 58 μm. Therefore, the outline of the thin laminated film 1053 is hardly visible if the thin laminated film 1053 is transparent and colorless, so that the ink 1041 (printed contents) on the thin laminated film 1053 can be prominent. Additionally, the total weight of the thin laminated film 1053 and the both sides adhesive tape 1013 is so light as to reduce adverse effect on rotational balance of the adherend 1061 as a body of rotation such as a CD and a DVD.

Further, when stuck to the curved surface of the adherend 1061, the thin laminated film 1053 is as thin as 10 μm, thus the thin laminated film 1053 can be prevented from being gradually unstuck. This effect can be achieved even if the thickness of the thin laminated film 1053 is as large as 15 μm.

As shown in FIG. 87, the printing surface 1011A on which the ink 1041 is thermally transferred exists on the back side of the thin laminated film 1053, that is, the printing surface 1011A is laminated by the thin laminated film 1053, thereby presenting abrasion resistance which is a feature of the "laminated tape".

The disclosure may be embodied in other specific forms without departing from the essential characteristics thereof.

For instance, with regard to the print tape 1005 which is produced in a tape printer (not shown) by using the print cassette 1001 of the fourth embodiment, for instance, the handling auxiliary film 1051 may have a width wider than that of the thin laminated film 1053 as shown in a plan view of FIG. 89. Conversely, the handling auxiliary film 1051 may have a width narrower than that of the thin laminated film 1053, as shown in the plan view of FIG. 90. In both cases, the handling auxiliary film 1051 and the thin laminated film 1053 are different in width, which makes it easy to distinguish the handling auxiliary film 1051, and to unstick the handling auxiliary film 1051.

This is the same if the width of the release sheet 1034 of the both sides adhesive tape 1013 is wider (not shown).

Even in the print tape 1005 having the handling auxiliary film 1051 as wide as the thin laminated film 1053, as shown in a plan view of FIG. 91, the presence of the handling auxiliary film 1051 can be emphasized with prints such as characters and patterns (in FIG. 91, for example, characters of "APPLICATION FILM") representing the handling auxiliary film 1051 preliminarily printed on the handling auxiliary film 1051 itself, thereby facilitating the work to unstick the handling auxiliary film 1051. In addition, if the top and bottom of the print tape 1005 can be distinguished by the characters and patterns preliminarily printed on the handling auxiliary film 1051, the print tape 1005 is allowed to be stuck readily to the adherend 1061 (see FIG. 88 and other figures).

Further, as shown in a perspective view of FIG. 92, the release sheet 1034 of the both sides adhesive tape 1013 comprising the print tape 1005 may preliminarily be provided with a half cut S1. This configuration can facilitate the work to remove the release sheet 1034 of the both sides adhesive tape 1013. Similarly, as shown in a perspective view of FIG. 93, the handling auxiliary film 1051 may preliminarily be provided with a half cut S2 in advance, which allows the handling auxiliary film 1051 to be unstuck easily.

In the print tape 1005, which is produced in a tape printer (not shown) by using the print cassette 1001 of the fourth embodiment, the handling auxiliary film 1051 may be a transparent and colorless tape or a colored and transparent tape. In the case of the transparent and colorless handling auxiliary film 1051, this allows the ink 1041 thermally transferred to the printing surface 1011A (see FIG. 83 and other figures) of the multilayer laminated tape 1011 to be visually identified therethrough, so that the top and bottom of the print tape 1005 can be distinguished easily, thereby facilitating the work to stick the print tape 1005 to the adherend 1061. On the other hand, the colored and transparent handling auxiliary film 1051 allows not only the ink 1041 thermally transferred to the printing surface 1011A (see FIG. 83 and other figures) of the multilayer laminated tape 1011 but also the presence of the handling auxiliary film 1051 itself to be identified visually. This can facilitate the work to stick the print tape 1005 to the adherend 1061 and the work to unstick the handling auxiliary film 1051.

In the print tape 1005 produced with a tape print device (not shown) using the print cassette 1001 of the fourth embodiment, instead of the both sides adhesive tape 1013, a monolayer adhesive tape 1101 may be used as shown with a sectional view of FIG. 94 taken along the line D-D of FIG. 85.

In other words, in the monolayer adhesive tape 1101, the release sheet 1034 having a thickness of approximately 53 μm is coated with a third adhesive agent to form a third adhesive layer 1035 in a thickness of approximately 16 μm.

A printing surface 1011A of the multilayer laminated tape 1011 on which ink 1041 is put and the third adhesive layer 1035 are overlapped with each other, so that the monolayer adhesive tape 1101 adheres to the multilayer laminated tape 1011 to compose the print tape 1005.

Further, the print tape 1005 can be stuck to an adherend with the adhesive-coated surface of the third adhesive layer 1035 exposed by releasing the release sheet 1034. Thereafter, by releasing the handling auxiliary film 1051 slowly, as shown in FIG. 95, the thin laminated film 1053 can be stuck to the adherend 1061 with the third adhesive layer 1035, along with the ink 1041 which is thermally transferred to the printing surface 1011A thereof.

In the meantime, available examples of the adhesive making up the third adhesive layer 1035 include the adhesive agent making up the second adhesive layer 1033.

In case where the monolayer adhesive tape 1101 is used instead of the both sides adhesive tape 1013 also, the above-described respective effects can be exerted.

Because the thickness (approximately 69 μm) of the monolayer adhesive tape 1101 is smaller than the thickness (approximately 101 μm) of the both sides adhesive tape 1013 although the release sheet 1034 having the same thickness is provided as a component, the outline of the "laminated tape" is more visible. Also, if the adherend 1061 is a rotary object (a CD or a DVD, etc.), its rotation balance is not badly affected easily.

Hereinafter, the print cassette of the present disclosure will be described in detail based on the fifth embodiment of the present disclosure with reference to the drawings.

FIG. 97 is a perspective view of a print cassette. As shown in FIG. 97, a print cassette 2001 of the fifth embodiment comprises an upper cassette case 2002 and a lower cassette case 2003. A print tape 2005 is discharged from a tape discharging port 2004. It is noted that a reference numeral 2006 indicates an ink ribbon.

FIG. 98 is a plan view of the print cassette 2001 from which the upper cassette case 2002 (see FIG. 97) is removed. As shown in FIG. 98, a tape spool 2012 on which an application tape 2013 is wound, a film spool 2014 on which a thin film tape 2011 is wound, a ribbon supply spool 2015 on which the ink ribbon 2006 is wound, and a ribbon take-up spool 2016 are provided on the lower cassette case 2003 of the print cassette 2001, being rotatable with cooperation of respective spool support members (not shown) formed on the upper cassette case 2002 (see FIG. 97).

The thin film tape 2011 has an adhesive layer which is formed by being coated the second face side of a thin base film composed of an urethane sheet having a sheet thickness of approximately 10 μm to 15 μm with an adhesive agent of approximately 16 μm thick. Further, a release sheet adhered to the adhesive layer. Then, an inside surface (the first face side of the thin base film) wound on the film spool 2014 will be a printing surface. Therefore, the thin film tape 2011 wound on the film spool 2014 is guided to an arm part 2019 formed on the lower cassette case 2003, via a guide pin 2017 provided on the lower cassette case 2003 in an upright position and a rotatable guide roller 2018. The thin film tape 2011 is further guided out of the arm part 2019, being exposed outside a thermal head attachment space 2020. After that, the thin film tape 2011 is discharged from the tape cassette 2001 through the tape discharging port 2004, via a guide member 2021 and a feed roller 2022.

The ink ribbon 2006 is wound on the ribbon supply spool 2015 with an ink-coated surface side inside. The ink ribbon 2006 wound on the ribbon supply spool 2015 in this way is exposed out of the arm part 2019 outside the thermal head attachment space 2020. The ink ribbon 2006 is further guided while the ink-coated surface and the printing surface of the thin film tape 2011 are overlapped with each other. After that, the ink ribbon 2006 is guided along an exterior of the guide member 2021, thereby getting separated from the printing surface of the thin film tape 2011. Finally, the ink ribbon 2006 is taken up by the ribbon take-up spool 2016.

On the other hand, the application tape 2013 has a weak adhesive layer which is formed by being coated the first face side of a handling auxiliary film composed of a "PET sheet" with a weak adhesive agent of approximately 25 μm thick. The application tape 2013 is wound on the tape spool 2012 with the handling auxiliary film side outside. The application tape 2013 wound in this way is guided by the feed roller 2022 while the adhesive-coated surface of the weak adhesive layer and the printing surface of the thin film tape 2011 are overlapped with each other. As a result, the application tape 2013 adheres to the thin film tape 2011, and discharged outside the print cassette 2001 through the tape discharging port 2004. Accordingly, the printing surface of the thin film tape 2011 is an adhesion object surface of the week adhesive layer of the application tape 2013.

Accordingly, the print tape 2005, which is composed of the thin film tape 2011 and the application tape 2013, is discharged from the tape discharging port 2004 of the print cassette 2001. FIG. 99 is a schematic view showing a process of the application tape 2013, the thin film tape 2011 and the ink ribbon 2006 being guided on the lower cassette case 2003 as described above.

FIG. 96 is a cross-sectional view of the print tape 2005 taken along the line E-E shown in FIG. 98. As shown in FIG. 96, the print tape 2005 is composed of the thin film tape 2011 and the application tape 2013. As described above, the application tape 2013 is configured such that the first face side of a handling auxiliary film 2051 composed of a "PET sheet" is coated with a week adhesive agent of approximately 25 μm thick to form a week adhesive layer 2052. As described above, the thin film tape 2011 is configured such that the second face side of a thin base film 2031 composed of an urethane sheet is coated with an adhesive agent of approximately 16 μm thick to form an adhesive layer 2033. Further, a release sheet 2034 adhered to the adhesive layer 2033. A printing surface 2011A of the thin film tape 2011 on which ink 2041 is put and the weak adhesive layer 2052 are overlapped with each other, so that the thin film tape 2011 adheres to the application tape 2013 to compose the print tape 2005. Accordingly, the printing surface 2011A of the thin film tape 2011 is an adhesion object surface of the week adhesive layer 2052 of the application tape 2013.

Further, the print tape 2005, from which the release sheet 2034 is removed so that the adhesive-coated surface of the adhesive layer 2033 is exposed, can be stuck to an adherend. After that, the application tape 2013 is slowly removed, and then, as shown in FIG. 100, the thin base film 2031 can be stuck to an adherend 2061 with the adhesive layer 2033, along with the ink 2041 which is thermally transferred to the printing surface 2011A thereof.

In order that the thin base film 2031 on which the ink 2041 is thermally transferred to the printing surface 2011A adheres to the application tape 2013 as described above, the weak adhesive agent making up the weak adhesive layer 2052 includes a copolymer as a main material, made by the copolymerization of monomers of any series such as an acrylic series, a rubber series and a silicone series. The weak adhesive agent can be made with or without various kinds of additives (such as a crosslinking agent, a tackifier, a softener, a fixture and a pigment). The week adhesive agent having a low adhesive property is adopted since this is used for temporary adhesion and a part which will be removed eventually.

On the other hand, the adhesive agent making up the adhesive layer 2033 includes a copolymer as a main material, made by the copolymerization of monomers of any series such as an acrylic series, a rubber series and a silicone series. The adhesive agent can be made with or without various kinds of additives (such as a crosslinking agent, a tackifier, a softener, a fixture and a pigment). The adhesive agent having an adhesive property appropriate to the adherend 2061 is adopted.

Incidentally, the print cassette 2001 is set in a cassette mount of a tape printer (not shown) to produce the print tape 2005. In the cassette mount of the tape printer, there is provided a cutter device (not shown) having a cutter to cut the print tape 2005 discharged from the tape discharging port 2004 of the print cassette 2001. The structure of the print cassette 2001 as explained with reference to FIG. 97 and other figures and the tape printer in which the print cassette 2001 is installed to produce the print tape 2005 have been publicly known, so the detailed explanation of the process for producing the print tape 2005 with the print cassette 2001 and the tape printer is omitted.

Next, the way of using the print tape 2005 will be explained with reference to FIGS. 101A to 101E.

The print tape 2005 is discharged from the tape discharging port 2004 of the print cassette 2001 of the fifth embodiment, the print cassette 2001 being set in a cassette mount of a tape printer (not shown). The print tape 2005 is cut with the cutter device of the tape printer (not shown) to be a strip-formed tape composed of the thin film tape 2011 (the thin base film 2031, the adhesive layer 2033 and the release sheet 2034) and the application tape 2013 (the handling auxiliary film 2051 and the weak adhesive layer 2052) as shown in FIG. 101A. As shown in FIG. 101B, the release sheet 2034 of the thin film tape 2011 is removed, so that the adhesive layer 2033 of the thin film tape 2011 is exposed. Further, the adhesive layer 2033 of the thin film tape 2011 is stuck to the adherend 2061 as shown in FIG. 101C.

As shown in FIG. 101D, the handling auxiliary film 2051 is slowly removed from the adherend 2061. At this time, the weak adhesive layer 2052 is also removed with the handling auxiliary film 2051, thus only the application tape 2013 can be removed therefrom. Finally, as shown in FIG. 101E, the thin base film 2031 on which the ink 2041 is thermally transferred is in a state of adhering to the adherend 2061 with the adhesive layer 2033. The ink 2041 has been thermally transferred from the ink ribbon 2006 (see FIG. 98 and other figures) to the printing surface 2011A (of the thin base film 2031) of the thin film tape 2011 (see FIG. 96 and other figures) with the tape printer (not shown).

As described in detail above, the print cassette 2001 of the fifth embodiment is set in a cassette mount of a tape printer (not shown) to produce the print tape 2005 which is discharged from the tape printer (not shown).

The print tape 2005 discharged from the tape printer (not shown) is cut by the cutter device of the tape printer (not shown), and then the release sheet 2034 is removed from the thin film tape 2011 adhered to the application tape 2013 (see FIG. 101B). The exposed adhesive layer 2033 of the thin film tape 2011 is stuck to the adherend 2061 (see FIG. 101C). Further, the application tape 2013 is slowly removed from the adherend 2061 (see FIG. 101D), so that the application tape 2013 is removed and the thin base film 2031 is left on the adherend 2061 with the ink 2041. As shown in FIG. 100, the thin base film 2031 having the printing surface 2011A, on which the ink 2041 thermally transferred, exposed on the first face side can be stuck to the adherend 2061 with the adhesive layer 2033. As a result, a "non-laminated tape" can be stuck to the adherend 2061 (see FIG. 101E).

The thin base film 2031 adhered to the release sheet 2034 with the adhesive layer 2033 to take the form of the thin film tape 2011 (see FIG. 96) which is wound on the film spool 2014 within the print cassette 2001 of the fifth embodiment as shown in FIG. 98. From this state, the thin base film 2031 adheres to the application tape 2013 with the application tape 2013 and the weak adhesive layer 2052 thereof to be the print tape 2005, which is discharged through the tape discharging port 2004. Thus, the thin base film 2031 can assure the feeding performance within the print cassette 2001 of the fifth embodiment even though the thin base film 2031 is thin.

As shown in FIGS. 101A and 101B, the application tape 2013 is in a state of adhering to the thin film tape 2011 when stuck to the adherend 2061. The thin base film 2031 can thus keep the rigidity at least by the thickness of the application tape 2013. Accordingly, however thin the thin base film 2031 composing the "non-laminated tape" is, the "non-laminated tape" can easily be stuck to the adherend 2061 as shown in FIG. 101.

When a sticking surface of the adherend 2061 is the curved surface, in order to contact closely the application tape 2013 to the sticking surface, the application tape 2013 should be thin and stretch.

Preferably, the thickness of the application tape 2013 is 30 μm to 50 μm, in the point of view which is the keeping of the easiness of the work of sticking.

Further, when the thin base film 2031 is stuck to the adherend 2061 with the adhesive layer 2033, the total thickness of the thin base film 2031 and the adhesive layer 2033 is as thin as approximately 26 μm to 31 μm. Therefore, the outline of the thin base film 2031 is hardly visible if it is transparent and colorless, so that the ink 2041 (printed contents) on the thin base film 2031 can be prominent. Additionally, the total weight of the thin base film 2031 and the adhesive layer 2033 is so light as to reduce adverse effect on rotational balance of the adherend 2061 as a body of rotation such as a CD and a DVD.

Further, when stuck to the curved surface of the adherend 2061, the thin base film 2031 is as thin as 10 μm to 15 μm, thus the thin base film 2031 can be prevented from being gradually unstuck.

The disclosure may be embodied in other specific forms without departing from the essential characteristics thereof.

For instance, with regard to the print tape 2005 which is produced in a tape printer (not shown) by using the print cassette 2001 of the fifth embodiment, for instance, the application tape 2013 may have a width wider than that of the thin film tape 2011 as shown in a plan view of FIG. 102. Conversely, the application tape 2013 may have a width narrower than that of the release sheet 2034 of the thin film tape 2011, as shown in a plan view of FIG. 104. Further, as shown in a plan view of FIG. 103, the thin base film 2031 and adhesive layer 2033 of the thin film tape 2011 may have a width narrower than that of the application tape 2013. In both cases, the application tape 2013 and the release sheet 2034 of the thin film tape 2011 are different in width, which makes it easy to distinguish the application tape 2013 and the release sheet 2034 of the thin film tape 2011, and to unstick the application tape 2013 and the release sheet 2034 of the thin film tape 2011.

Even in the print tape 2005 having the application tape 2013 as wide as the thin film tape 2011, as shown in a plan view of FIG. 105, the presence of the handling auxiliary film 2051 of the application tape 2013 (see FIG. 101 and other figures) can be emphasized with prints such as characters and patterns representing the application tape 2013 preliminarily printed on the application tape 2013 itself, thereby facilitating the work to unstick the application tape 2013. In addition, if the top and bottom of the print tape 2005 can be distinguished by the characters and patterns (in FIG. 105, for example, characters of "APPLICATION FILM") preliminarily printed on the application tape 2013, the print tape 2005 is allowed to be stuck readily to the adherend 2061 (see FIG. 101 and other figures).

Namely, the disclosure having such a characteristic is the print cassette, wherein a printing is printed preliminarily on the handling auxiliary film.

Further, as shown in a perspective view of FIG. 106, the release sheet 2034 of the thin film tape 2011 comprising the print tape 2005 may preliminarily be provided with a half cut S11. This configuration can facilitate the work to remove the release sheet 2034 of the thin film tape 2011. Similarly, as shown in a perspective view of FIG. 107, the application tape 2013 may preliminarily be provided with a half cut S12 in advance, which allows the application tape 2013 to be unstuck easily.

In the print tape 2005, which is produced in a tape printer (not shown) by using the print cassette 2001 of the fifth embodiment, the application tape 2013 may be a transparent and colorless tape or a colored and transparent tape. In the case of the transparent and colorless application tape 2013, this allows the ink 2041 thermally transferred to the printing surface 2011A (see FIG. 96 and other figures) of the thin film tape 2011 to be visually identified therethrough, so that the top and bottom of the print tape 2005 can be distinguished easily, thereby facilitating the work to stick the print tape 2005 to the adherend 2061. On the other hand, the colored and transparent application tape 2013 allows not only the ink 2041 thermally transferred to the printing surface 2011A (see FIG. 96 and other figures) of the thin film tape 2011 but also the presence of the application tape 2013 itself to be identified visually. This can facilitate the work to stick the print tape 2005 to the adherend 2061 and the work to unstick the application tape 2013.

INDUSTRIAL APPLICABILITY

The disclosure may be applied to a producing technology of a print tape or a print cassette by using a to-be-printed medium which is a thin film.

The invention claimed is:

1. A print cassette accommodating a first tape and a second tape, designed to be mounted on a print device having a printing position, wherein the first tape includes:

a first base material;

a to-be-printed medium; and a first adhesive layer formed of a first adhesive agent interposed between the first base material and the to-be-printed medium, the second tape includes:

a second base material; and a second adhesive layer formed of a second adhesive agent applied to the second base material, the to-be-printed medium adopts a rear face of the face to which the first adhesive layer adheres as its printing surface, and a print tape is formed by discharging, from the print device, the first tape and the second tape adhered together, interposing the second adhesive layer between the first and second base layers, an adhesion force between the first adhesive layer and the to-be-printed medium is smaller than an adhesion force between the second adhesive layer and the to-be-printed medium, when the print tape is adhered to an adherend:

the second adhesive layer is exposed by removing the second base material adhered to the adherend; and by removing the first base material from the adherend, the first adhesive layer is removed together with the first base material so that the to-be-printed medium is separated from the first adhesive layer while the to-be-printed medium is adhered to the adherend, interposing the second adhesive layer therebetween, and a sum of dimensions of the second adhesive layer and the to-be-printed medium adhered to the adherend, in thickness direction thereof, is smaller than a sum of dimensions of the first adhesive layer and the first base material separated from the to-be-printed medium, in a thickness direction thereof.

2. The print cassette according to claim 1, wherein the first adhesive agent is dispersed uniformly in a predetermined pattern.

3. The print cassette according to claim 1, wherein a print of thermosensitive coloring agent is made on the printing surface side of the to-be-printed medium.

4. The print cassette according to claim 1, further accommodating an ink ribbon having an ink face, wherein the ink face of the ink ribbon and the printing surface of the to-be-printed medium face each other at the print position of the print device.

5. The print cassette according to claim 4, wherein a print head is disposed at the printing position of the print device, the width of the ink ribbon is wider than the width of the to-be-printed medium, and when the printing surface of the to-be-printed medium faces the printing head of the print device through the ink face of the ink ribbon, the to-be-printed medium is covered with the ink ribbon so that the to-be-printed medium is hidden with respect to the print head of the print device.

6. The print cassette according to claim 1, wherein the width of the first base material and the width of the to-be-printed medium are different from each other.

7. The print cassette according to claim 1, wherein the first base material is transparent.

8. The print cassette according to claim 1, wherein a half cut is implemented preliminarily in the first base material.

9. The print cassette according to claim 1, wherein a half cut is implemented preliminarily in the second base material.

10. A print cassette accommodating a first tape and a third tape, designed to be mounted on a print device having a printing position, wherein the first tape includes:

a first base material;

a to-be-printed medium; and a first adhesive layer formed of a first adhesive agent interposed between the first base material and the to-be-printed medium, the third tape includes:

a third base material;

a third adhesive layer formed of a third adhesive agent applied to a first face side of the third base material;

a fourth base material; and a fourth adhesive layer formed of a fourth adhesive agent interposed between a second face side of the third base material and the fourth base material, wherein the to-be-printed medium adopts a rear face of the face to which the first adhesive layer adheres as its printing surface, a print tape is formed by discharging, from the print device, the first tape and the second tape adhered together, interposing the second adhesive layer between the first and second base layers an adhesion force between the first adhesive layer and the to-be-printed medium is smaller than an adhesion force between the second adhesive layer and the to-be-printed medium, when the print tape is adhered to an adherend:

the second adhesive layer is exposed by removing the second base material adhered to the adherend; and by removing the first base material from the adherend, the first adhesive layer is removed together with the first base material so that the to-be-printed medium is separated from the first adhesive layer while the to-be-printed medium is adhered to the adherend, interposing the second adhesive layer therebetween, and a sum of dimensions of the second adhesive layer and the to-be-printed medium adhered to the adherend, in thickness direction thereof, is smaller than a sum of dimensions of the first adhesive layer and the first base material separated from the to-be-printed medium, in a thickness direction thereof.

11. The print cassette according to claim 10, wherein a half cut is implemented preliminarily in the fourth base material.

12. The print cassette according to claim 10, wherein the first adhesive agent is dispersed uniformly in a predetermined pattern.

13. The print cassette according to claim 10, wherein a print of thermosensitive coloring agent is made on the printing surface side of the to-be-printed medium.

14. The print cassette according to claim 10, further accommodating an ink ribbon having an ink face, wherein the ink face of the ink ribbon and the printing surface of the to-be-printed medium face each other at the print position of the print device.

15. The print cassette according to claim 14, wherein a print head is disposed at the printing position of the print device, the width of the ink ribbon is wider than the width of the to-be-printed medium, and when the printing surface of the to-be-printed medium faces the printing head of the print device through the ink face of the ink ribbon, the to-be-printed medium is covered with the ink ribbon so that the to-be-printed medium is hidden with respect to the print head of the print device.

16. The print cassette according to claim 10, wherein the width of the first base material and the width of the to-be-printed medium are different from each other.

17. The print cassette according to claim 10, wherein the first base material is transparent.

18. The print cassette according to claim 10, wherein a half cut is implemented preliminarily in the first base material.

* * * * *